US007730924B2

(12) United States Patent
Ito

(10) Patent No.: US 7,730,924 B2
(45) Date of Patent: Jun. 8, 2010

(54) COMPOSITE AWNING DEVICE

(76) Inventor: Osamu Ito, Mizuho Skymansion 101, Chome-5, Takou-cho, Mizuho-ku, Nagoya, Aichi 4670828 (JP)

( * ) Notice: Subject to any disclaimer, the term of this patent is extended or adjusted under 35 U.S.C. 154(b) by 0 days.

(21) Appl. No.: 11/852,870

(22) Filed: Sep. 10, 2007

(65) Prior Publication Data

US 2008/0053624 A1 Mar. 6, 2008

Related U.S. Application Data

(63) Continuation of application No. PCT/JP2005/004843, filed on Mar. 10, 2005.

(51) Int. Cl.
*E04F 10/06* (2006.01)
*E04F 10/00* (2006.01)

(52) U.S. Cl. ..... 160/55; 160/45

(58) Field of Classification Search ..... 160/120, 160/22, 23.1, 238, 263, 241, 242, 243, 25, 160/26, 45, 65, 66, 61, 54, 55, 56, 59, 70, 160/75, 85, 905
See application file for complete search history.

(56) References Cited

U.S. PATENT DOCUMENTS 584,076 A * 6/1897 Fogh ..... 401/79
1,594,643 A * 8/1926 Stuart ..... 160/68

(Continued)

FOREIGN PATENT DOCUMENTS

DE 2246746 * 3/1985

(Continued)

OTHER PUBLICATIONS

Website of the Japan Awning Association searched on Aug. 17, 2004, which has been updated, and its URL is http://www.awning-j.com (Hardcopy Not Available).

(Continued)

*Primary Examiner*—Katherine W Mitchell
*Assistant Examiner*—Jeremy C Ramsey
(74) *Attorney, Agent, or Firm*—Hiroe & Associates; Taras P. Bemko

(57) ABSTRACT

A composite awning device, wherein an awning device for projected corner having a projected corner canvas windup device is combined with a rectangular awning device having a rectangular canvas windup device, mainly the awning device for projected corner is mounted near the corner of a projected corner portion, and the rectangular awning device is mounted in a linear district following the corner part when used. The windup device of the awning device for projected corner comprises projected corner canvas windup shafts and front bars. The windup shafts comprise inner rotating shafts and outer rollers supportedly inserted into the rotating shaft. The projected corner canvas front bars are supportedly inserted into the rectangular canvas front bars so as to be movably guided. The rectangular canvas front bars are moved parallel with each other in the longitudinal direction by swing arms supporting both front bars, and the projected corner canvas front bars are moved parallel with each other in a diagonal direction. Thus, epoch-making and fresh products providing sufficient interest and serviceability as the composite awning device can be provided to industries by remarkably increasing the aesthetic appearance of the projected corner portions of various buildings and the external portions of the building including the projected corner portions and recessed corner portions.

26 Claims, 58 Drawing Sheets

U.S. PATENT DOCUMENTS

| | | | | |
|---|---|---|---|---|
| 1,749,197 | A * | 3/1930 | Stuart | 160/68 |
| 1,842,598 | A * | 1/1932 | Fogh | 160/42 |
| 4,615,371 | A * | 10/1986 | Clauss | 160/22 |
| 6,457,508 | B1 * | 10/2002 | Tomita | 160/67 |

FOREIGN PATENT DOCUMENTS

| | | |
|---|---|---|
| JP | 38-14241 | 7/1938 |
| JP | 4-9381 | 3/1992 |
| JP | 4-40336 | 9/1992 |
| JP | 4-40337 | 9/1992 |
| JP | 4-40338 | 9/1992 |
| JP | 6-36157 | 9/1994 |
| JP | 7-51545 | 11/1995 |
| JP | 11-270089 | 10/1999 |
| JP | 3084798 | 12/2001 |

OTHER PUBLICATIONS

Page 9-11 of "Awning sales manual" published by the Japan Awning Association in Jan. 2004 with English Translation.

* cited by examiner

Fig. 15A
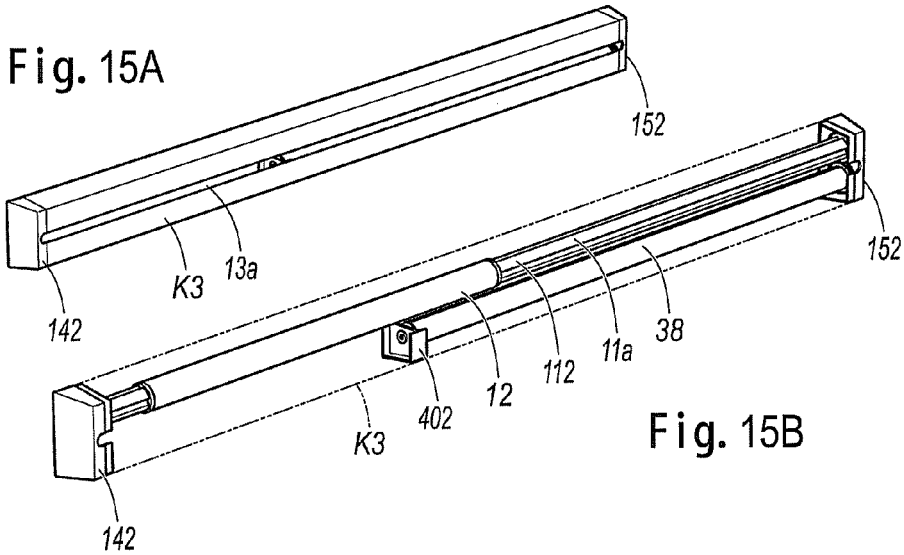
Fig. 15B
Fig. 16A
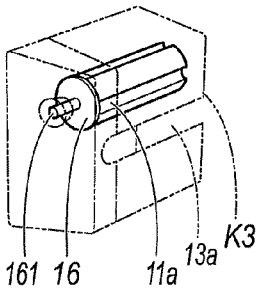
Fig. 16B
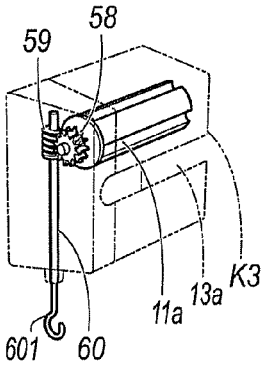
Fig. 16C
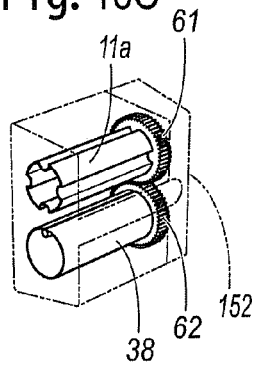
Fig. 17A
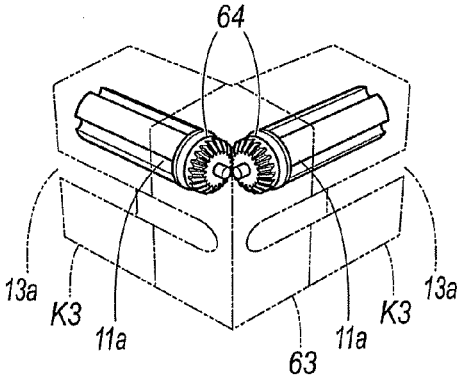
Fig. 17B
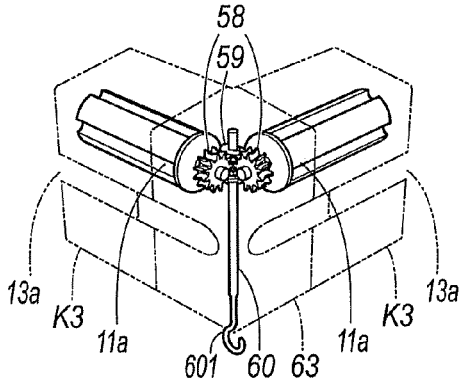

E1
E2
691
69
951
95
66
Y1
952
70
701
701

E2
E1
69
951
95
66
952

E1
E2
69
951
95
66
661
952

E1
E2
69
961
96
66
691
70a
702
703
663
662
661

COMPOSITE AWNING DEVICE

TECHNICAL FIELD

The present invention relates to a movable awning device having a composite structure, that is, a composite awning device, capable of attractively covering building peripheries including protruded corners and recessed corners of various buildings.

BACKGROUND ART

Conventionally, as shown in FIG. 68, movable awning devices are configured as follows: a rectangular canvas that generally extends forward at an angle from a wall is wound or unwound around a take-up roller that is supported by an outer wall of a building by means of a manual lever or electric motor, etc.; and a front bar fixed at the front end portion of the canvas is configured to be translated by means of foldable swing arms such as bi-foldable arms or y-like arms (for example, see the following Patent documents 4 to 7 and Non-patent documents 1 to 2). Many of them are used for sun-shielding or rain-shielding at terraces or along the perimeters of shops, or for ornamental purposes for buildings or shops.

On the other hand, the following three kinds of movable awning devices have been thought out for covering a corner space portion of a protruded corner portion of a building (that is, a protruded outside corner portion butted at a right angle, at an obtuse angle, and at an acute angle).

(1) An awning supporting frame incorporating the entire device is supported to be extended obliquely forward at a fixing bracket at a corner end portion. Two rollers for winding and unwinding a long side of a substantially right-angled triangular canvas by an electric motor are bearing supported at opposite fore and rear end portions of the awning supporting frame. Then, a base end portion of a bi-foldable connection arm biased toward a spreading direction is attached to an midpoint of a base pipe, and a top portion of the triangular canvas is attached to an arm holder located at the top end portion of the base pipe. Further, a decoration panel is pivotally provided to be extendable at a top end portion of the awning supporting frame, whereas an arm holder is supported slidably along a groove portion of the rear portion of said decoration panel.

Further, the awning supporting frame is suspended to be supported at its portion in the vicinity of the top end by a wire rope, and is further lifted rearward above the corner end portion by a winding machine, thereby storing the entire device in an inverted posture (see Patent Document 1; hereinafter, referred to as Document 1).

(2) A screw shaft is perpendicularly supported at a corner end portion. A parasol-like canvas assembled to said shaft and its folding frame mechanism are moved upward and downward so as to open and close the canvas (see Patent document 2; hereinafter, referred to as Document 2).

(3) A circular arculate guide plate is provided in a horizontal posture to a corner end portion. A fan-like canvas and its folding frame mechanism are rotated horizontally along said guide plate so as to push to extend the canvas or fold it by the wall into the shape of bellows (see Patent document 3; hereinafter, referred to as Document 3).

List of Publication Information of Prior Art

Patent document 1: Japanese Utility Model Publication No. 4-40336

Patent document 2: Japanese Utility Model Publication No. 4-40337

Patent document 3: Japanese Utility Model Publication No. 4-40338

Patent document 4: Japanese Utility Model Publication No. 4-9381

Patent document 5: Japanese Utility Model Publication No. 6-36157

Patent document 6: Japanese Utility Model Publication No. 7-51545

Patent document 7: Japanese Laid-Open Patent Publication No. 11-270089

Non-patent document 1: Japan awning association, "Awning sales manual", pages 9 to 11, issued in January 2004

Non-patent document 2: Japan awning association, "Awning-sunshade-Japan Awning association-JAA" [online], Internet, searched on Aug. 17, 2004 <URL:http://www.awning.org/index.html>

DISCLOSURE OF THE INVENTION

Problem to be Solved by the Invention

The former awning device is mainly intended for use in a linear zone (or a mildly circular arcuate curving zone) along the building periphery, and thus, cannot cover a corner space at a protruded corner portion. If such a corner space is forcedly covered, the take-up roller will be attached beyond the protruded corner portion into the corner space.

In many cases, a protruded corner portion of a building faces two-directional sideway and roadway, or faces at an intersection, and is visible by unspecified numerous people. Such a location has good conditions in combination for sales, such as being advantageous as a shop, being capable of offering excellent advertisement effect, and the like.

If an awning device incorporated into such a conspicuous location inevitably winds up the rectangular canvas in a state where the canvas remains protruded from the protruded corner portion, the awning device lacks technical amusement and good appearance.

On the other hand, the latter awning device supports, at its one side, either one of a triangular canvas, parasol-like canvas, and fan-like canvas extended in a corner space at a corner end portion of a protruded corner portion. At this time, in the case of the Documents 1 and 3, the load of the entire device results in concentrating to a fixing bracket and a circular arcuate guide plate extended to a corner end.

Among them, in Document 1, since the awning supporting frame is suspended by a wire rope, the entire device is likely to swing leftward and rightward at the time when the canvas is extended. Especially, the device tends to be influenced by wind and is unstable. In addition, since the entire device is suspended by a wire rope and lifted up to the corner end to be stored in a perpendicularly inverted state, there is a fear that the device may fall to hit the head of a person staying below the device in considering a possibility that the wire rope wears and tears. Further, as a result that the device is stored into a perpendicular upright posture, the back side of the entire device is exposed on the front surface of the corner end portion, resulting in degrading the appearance when the device is in a stored state.

Further, in the case of Document 2, no problem is assumed in the stability of the device when the parasol-like canvas is extended to the corner space. Contrarily, when the parasol-like canvas is folded along the corner end, it is doubtful if the canvas can be always attractively folded as is the case of a parasol.

If the canvas remains in a state folded into a bellows, it receives an influence of wind and flutters. Such a canvas exhibits insufficient appearance when stored into a corner end portion into a perpendicular posture.

Further, in the case of Document 3, there still remains a problem to be solved in practicing the device whether or not the base end portion of the frame mechanism can be always rotated smoothly along a round circular guide plate.

The present inventors has proposed "a corner canvas and take-up shaft therefor, and corner awning device" in his own prior patent application No. PCT/JP2004/9751 (Jan. 7, 2004) that addresses the technical problem described above by extending a corner canvas toward an obliquely forward corner space while unwinding the corner canvas, or contrarily, by retracting while winding the extended corner canvas obliquely rearward for storage.

The present invention has been made by further advancing and developing the invention of the prior patent application. In addition, the present invention provides several kinds of movable awning devices (hereinafter referred to as "composite awning devices" or simply "composite devices") of a composite structure capable of attractively covering building peripheries including protruded corner portions and recessed corner portions (meaning butted inward corner portions at a right angle, an obtuse angle, and an acute angle), and have also solved various technical problems expected in putting these devices into practical use.

Means for Solving the Problems

As to the invention related to composite devices SQIII1 to 9, SQII1 to 2, and SQIV1 to 5 of a first type (hereinafter, referred to as a first invention), and its effect The first invention is characterized in (1) . . . combining a protruded corner awning device S1 equipped with a take-up device for winding and unwinding a protruded corner canvas G1, and a rectangular awning device Q equipped with a take-up device for winding and unwinding a rectangular canvas P.

With the result that two main structures are combined into a composite structure as described above, as compared with the inventor's own prior invention (PCT/JP2004/9751) described above, the appearance of the building peripheries including protruded corner portions of various buildings can be significantly enhanced.

Specifically, (2) . . . The take-up device of a protruded corner awning device S1 is equipped with take-up shafts J1 to J4 for the protruded corner canvas G1, and a front bars F1, E1. The take-up shafts J1 to J4 are comprised of an inner shaft and an outer roller 12, 12*a* fitted on and inserted into said inner shaft. The take-up device of a rectangular awning device Q is equipped with a take-up roller 38 for said rectangular canvas P and front bars F2, F2*a*, E2. The front bars F1, E1 for the protruded corner canvas G1 are fitted on and supported by the front bars F2, F2*a*, E2 for the rectangular canvas P to be slidably guided. The front bars F2, F2*a*, E2 at one side are translated forward and rearward by swing arms supporting the front bars F1, F2, F2*a*, E1, E2, whereas the front bars F1, E1 at the other side are translated obliquely.

Thereby, an epoch-making and novel product having technical amusement and utility as a composite device is provided to this industrial field.

Further, a positional relationship related to two main structures is as follows (3) . . . In use, the protruded corner awning device S1 is attached to a position in the vicinity of the corner of the protruded corner portion N1, and the rectangular awning device Q is attached to a linear zone subsequent to the protruded corner portion N1.

Further, as to one of the functions of the front bars, (4) . . . The front bars F1, E1 for the protruded corner canvas G1 described in (1) (2) above are structured so that they are translated obliquely forward or withdrawn obliquely rearward as they are movably guided by the front bars F2, F2*a*, E2 for the rectangular canvas P.

Further, to effectively support the front bars themselves, (5) . . . The front bars F1, F2, F2*a*, E1, E2 are supported by either two or more of swing arms selected from linear I-like arms I1, I2, bi-foldable V-like arms V1, V2, Y-like arms Y1, Y2 in the shape of reversed letter y, and L-like arms L1, L2 expandable and contractible in two phases.

Subsequently, various dependent inventions related to the swing arms described in (2), (5) above are listed below. Reference numerals in parentheses show composite devices disclosed in embodiments.

(6) . . . Front end portions of two V-like arms V1, V2 located at symmetrically fore and rear positions are attached to the opposite fore and rear end portions of the front bars F2, E2 for the rectangular canvas P, respectively, whereas a front end portion of the I-like arm I1 is attached in the vicinity of the midpoint of the front bar F1, E1 for the protruded corner canvas G1 (SQIII1).

(7) . . . A connection rod 65 is bridged between the vicinity of the midpoint of the I-like arm I1 and a bi-foldable connecting portion 513 of the V-like arm V1 described in (6) above to be in parallel with the front bars F1, E1 for the protruded corner canvas G1 (SQIII2).

(8) . . . One of the V-like arms V1 described in (6) above is replaced by a Y-like arm Y1 comprised of a main link 65 and a sub-link 66. Among them, a front end portion of the sub-link 67 is attached to the top end portions of the front bars F2, E2 for the rectangular canvas P, whereas the front end portion of the main link 66 is attached to the rear end portion of the respective front bars F1, E1 for the protruded corner canvas G1 and is also attached to the front bars F2, E2 to be movably guided (SQIII3).

(9) . . . A Y-like arm Y1 comprised of a main link 66 and a sub-link 67 is attached in the vicinity of the top end portion of the respective front bars F2*a*, E2 for the rectangular canvas P extended to reach the top end portion of the device. Among them, the front end portion of the sub-link 67 is attached to the top end portion of the respective front bars F2*a*, E2. The front end portion of the main link 66 is attached to the vicinity of the midpoint of the respective front bars F1, E1 for the protruded corner canvas G1, and at the same time, is supported by the respective front bars F2*a*, E2 to be movably guided. The front end portion of the V-like arm V2 is attached to the rear end portion of the respective front bars F2*a*, E2. The front end portion of the I-like arm I2 is attached to the rear end portion of the front bars F1, E1. The I-like arm I2 and the main link 66 are formed to be parallel to each other (SQIII4).

(10) . . . The I-like arm I2 described in (9) above is replaced by a Y-like arm Y2 comprised of a main link 66 and a sub-link 67. Among them, a front end portion of the main link 66 is attached to the rear end portion of the respective front bars F1, E1 for the protruded corner canvas G1, and at the same time, is attached to the respective front bars F2*a*, E2 for the rectangular canvas P to be slidably guided. Further, a front end portion of the sub-link 67 is attached to the vicinity of a midpoint of the respective front bars F2*a*, E2 (SQIII5).

(11) . . . The V-like arm V2 described in (9) above is replaced by a Y-like arm Y2 comprised of a main link 66 and a sub-link 67. Among them, a front end portion of the sub-link 67 is connected to the rear end portion of the respective front bars F2*a*, E2 for the rectangular canvas P, whereas a front end portion of the main link 66 is attached to the respective front bars F2*a*, E2 to be movably guided (SQIII6).

(12) . . . A Y-like arm Y2 comprised of a main link 66 and a sub-link 67 is attached to the vicinity of the rear end portion of the respective front bars F2*a*, E2 for the rectangular canvas P extended to the top end portion of the device. Among them, a front end portion of the sub-link 67 is attached to the rear end portion of the respective front bars F2*a*, E2, and a front end portion of the main link 66 is attached to the respective front bars F2*a*, E2 to be movably guided. In addition, front end portions of two I-like arms I1, I2 parallel to each other are attached to the vicinity of a midpoint and a rear end portion of the respective front bars F1, E1 for the protruded corner canvas G1 (SQIII7).

(13) . . . The I-like arm I2 described in (12) above is replaced by a Y-like arm Y1 comprised of a main link 66 and a sub-link 67. Among them, a front end portion of the sub-link 67 is attached to the top end portion of the respective front bars F2, E2 for the rectangular canvas P, whereas a front end portion of the main link 66 is attached to the rear end portion of the respective front bars F1, E1 for the protruded corner canvas G1, and at the same time, is attached to the respective front bars F2, E2 to be movably guided (SQIII8).

(14) . . . A Y-like arm Y2 comprised of a main link 66 and a sub-link 67 is attached in the vicinity of the rear end portion of the respective front bars F2, E2 for the rectangular canvas P. Among them, a front end portion of the sub-link 67 is attached to the rear end portion of the respective front bars F2, E2, whereas a front end portion of the main link 66 is attached to the respective front bars F2, E2 to be movably guided. Front end portions of two L-like arms L1, L2 are attached to the vicinity of a midpoint and a rear end portion of the front bars F1, E1 for the protruded corner canvas G1. A connection rod 65 is bridged between bi-foldable connecting portions of the L-like arms L1, L2 (SQIII9).

(15) . . . A Y-like arm Y1 comprised of a main link 66 and a sub-link 67 is attached to the vicinity of the front end portion of the respective front bars F2*a*, E2 for the rectangular canvas P extended to the top end portion of the device. Among them, a front end portion of the sub-link 67 is attached to the top end portion of the respective front bars F2*a*, E2, whereas a front end portion of the main link 66 is attached to the vicinity of a midpoint of the respective front bars F1, E1 for the protruded corner canvas G1. In addition, a front end portion of the V-like arm V2 is attached to the rear end portion of the respective front bars F2*a*, E2 (SQII1).

(16) . . . The V-like arm V2 described in (15) above is replaced by a Y-like arm Y2 comprised of a main link 66 and a sub-link 67. Among them, a front end portion of the sub-link 67 is attached to the rear end portion of the respective front bars F2*a*, E2 for the rectangular canvas P, whereas a front end portion of the main link 66 is attached to the respective front bars F2*a*, E2 to be movably guided (SQII1).

(17) . . . As to (15), (16) above, the rotation shaft 37 of the take-up roller 38 described in (2) above is extended to the top end portion of the device. A take-up roller 73 is attached to the top end portion of the rotation shaft 37, and a synchronization belt 74 is bridged between the take-up roller 73 and the top end portion of the respective front bars F2*a*, E2 for the rectangular canvas P (SQII2). Thereby, synchronization at the time of winding and unwinding is assured.

(18) . . . As to (15), (16) above, the inner shaft described in (2) above is an inner rotation shaft 11. The inner rotation shaft 11 is extended to the rear end portion of the device, and a synchronization belt 74 is bridged between said rear end portion and the rear end portion of the respective front bars F2*a*, E2 for the rectangular canvas P (SQII2). Thereby, synchronization at the time of winding and unwinding is assured.

(19) . . . Front end portions of two V-like arms V1, V2 located symmetrically at fore and rear positions are attached to the vicinity of a midpoint and a rear end portion of the respective front bars F2, E2 for the rectangular canvas P. In addition, front end portions of two parallel I-like arms I1, I2 are attached to the vicinity of a midpoint and a rear end portion of the respective front bars F1, E1 for the protruded corner canvas G1 (SQIV1).

(20) . . . A connection rod 65 is bridged between the vicinity of a midpoint of the I-like arm I2 attached to the rear end portion of the respective front bars F1, E1 for the protruded corner canvas G1 described in (19) above, and a bi-foldable connecting portion 513 of the V-like arm V1 at the midpoint of the device in such a manner that the connection rod 65 is in parallel with the front bars F1, F2, E1, E2 (SQIV2).

(21) . . . The I-like arm I2 described in (19) above is replaced by a Y-like arm comprised of a main link 66 and a sub-link 67. Among them, a front end portion of the sub-link 67 is attached to the top end portion of the respective front bars F2, E2 for the rectangular canvas P, whereas a front end portion of the main link 66 is attached to the rear end portion of the respective front bars F1, E1 for the protruded corner canvas G1, and at the same time, is attached to the respective front bars F2, E2 to be movably guided (SQIV3).

(22) . . . The I-like arm I2 and the V-like arm V2 described in (19) above are replaced by two Y-like arms Y1, Y2 located symmetrically at fore and rear positions and each composted of a main link 66 and a sub-link 67. Top end portions of the sub-links 67 are attached to the top end portion and the rear end portion of the front bars F2, E2 for the rectangular canvas P, respectively. A top end portion of the main link 66 of the Y-like arm Y1 in the vicinity of the top end portion of the respective front bars F2, E2 is attached to the rear end portion of the respective front bars F1, E1 for the protruded corner canvas G1, and at the same time, is attached to the respective front bars F2, E2 to be movably guided. A front end portion of the main link 66 of the Y-like arm Y2 in the vicinity of the rear end portion of the respective front bars F2, E2 is attached to the respective front bars F2, E2 to be movably guided (SQIV4).

(23) . . . Front end portions of two V-like arms V1, V2 located symmetrically at fore and rear positions are respectively attached to the vicinity of midpoint and the rear end portion of the front bars F2, E2 for the rectangular canvas P. Front end portions of two L-like arms L1, L2 are respectively attached to the vicinity of midpoint and the rear end portion of the front bars F1, E1 for the protruded corner canvas G1. A connection rod 65 is bridged between bi-foldable connecting portions of the L-like arms L1, L2 to be parallel to the respective front bars F1, E1 (SQIV5).

As to the Invention Related to Composite Devices SUIII, SUII of a Second Type (Hereinafter, Referred to as a Second Invention), and its Advantageous Effect The second invention (24) . . . is in the case where the composite devices SQIII1 to 9, SQII1 to 2, and SQIV1 to 5 of the first type, that is, the rectangular awning device Q described in (1), (2) above is replaced by a recessed corner awning device U equipped with a take-up device for winding and unwinding recessed corner canvas T1, T2.

By combining two main constituent elements into a composite structure in the manner as described above, appearance of building periphery having a protruded corner portion at its one side and a recessed corner portion at the other side can be significantly enhanced.

Specifically, (25) . . . The take-up device of the recessed corner awning device U is equipped with a take-up roller 38 for recessed corner canvases T1, T2 and front bars F2, F2*a*, F2*b*, E2, whereas front bars F1, E1 for protruded corner canvas G1 are fitted on and supported by the front bars F2, F2*a*, F2*b*, E2 for the recessed corner canvases T1, T2 to be movably guided. By the swing arms supporting both the front bars F1, F2, F2*a*, F2*b*, E1, E2, the front bars F2, F2*a*, F2*b*, E2 at one side are translated forward and rearward, and the front bars F1, E1 at the other side are obliquely translated as being movably guided by the front bars F2, F2*a*, F2*b*, E2.

Thereby, an epoch-making and novel product rich in technical amusement and utility as a composite device is provide to this industrial field.

Further, a positional relationship related to two main structures is as follows (26) . . . In use, the protruded corner awning device S1 is attached to a position in the vicinity of the corner of the protruded corner portion N1, and the recessed corner awning device U is attached to a position in the vicinity of the corner of the recessed corner portion Z adjacent to the protruded corner portion N1.

Further, as to one of the functions of the front bars, (27) . . . The front bars F2, F2*a*, E2 for the rectangular canvas P described in (4), (6), (8) to (19), (21) to (23) above are replaced by the front bars F2, F2*a*, E2 of the recessed corner canvases T1, T2, and the front bars F1, E1 for the protruded corner canvas G1 are structured so that they are translated obliquely forward or retracted obliquely rearward as they are movably guided by the front bars F2, F2*a*, F2*b*, E2 of the recessed corner canvases T1, T2.

Subsequently, various dependent inventions related to the swing arms described in (25) above are listed below. Reference numerals in parentheses show composite devices disclosed in embodiments.

(28) . . . Two Y-like arms Y1, Y2 each comprised of a main link 66 and a sub-link 67 are attached symmetrically at fore and rear positions in the vicinity of the top end and in the vicinity of the rear end of the respective front bars F2, F2*a*, F2*b*, E2 of the recessed corner canvas T1. Front end portions of the sub-links 67 are attached to opposite fore and rear portions of the respective front bars F2, E2, whereas the front end portion of the main link 66 of the Y-like arm Y2 at the rear end portion is attached to the respective front bars F2, E2 to be movably guided. A front end portion of the main link 66 of the Y-like arm Y1 located at a midpoint of the device is attached to the rear portion of the respective front bars F1, E1 for the protruded corner canvas G1. A front end portion of the I-like arm I1 at the top end portion of the device is attached to the vicinity of the midpoint of the respective front bars F1, E1 (SUIII).

(29) . . . A Y-like arm Y1 comprised of a main link 66 and a sub-link 67 is attached to the vicinity of the top end of the respective front bars F2*b*, E2 of the recessed corner canvas T2. Among them, a front end portion of the sub-link 67 is attached to the top end portion of the respective front bars F2*b*, E2. A front end portion of the main link 66 is attached to the rear portion of the respective front bars F1, E2 for the protruded corner canvas G1. A front end portion of the I-like arm I1 at the top end portion of the device is attached to the vicinity of the midpoint of the respective front bars F1, E1 (SUII).

As to the Invention Related to Composite Devices SQSIV1 to 4 and SQSVI of Third Type (Hereinafter, Referred to as a Third Invention), and its Advantageous Effect Third invention is characterized in (30) . . . combining a rectangular awning device Q equipped with a take-up device for winding and unwinding a rectangular canvas P with two protruded corner awning devices S1, S2 each equipped with a take-up device for winding and unwinding protruded corner canvases G1, G2 and located symmetrically at fore and rear positions.

By combining three main constituent elements into a composite structure as described above, appearance of building periphery having a protruded corner portion at its one side and the other sides respectively can be significantly enhanced.

Specifically, (31) . . . The protruded corner awning devices S1, S2 are respectively equipped with take-up shafts J1 to J4 for the protruded corner canvases G1, G2 and the front bars F1, F3, F11, F13. The take-up shafts J1 to J4 are respectively comprised of an inner shaft and an outer roller 12, 12*a* fittedly inserted into said inner shaft. The rectangular awning device Q is comprised of a take-up roller 38 for a rectangular canvas P and a front bar F2, F2*c*, or F12. The front bars F1, F3, or F11, F13 for the protruded corner canvases G1, G2 are respectively fitted on and supported at the fore and rear positions of the front bars F2, F2*c*, or F12 of the rectangular canvas P to be movably guided. Thereby, the front bar F2, F2*c*, or F12 is translated forward and rearward by the swing arms supporting these three front bars F1 to F3 or F11 to F13, whereas the front bars F1, F3, or F11, F13 at fore and rear positions are translated obliquely as they are movably guided by the front bars F2, F2*c*, or F12.

Thereby, an epoch-making and novel product rich in technical amusement and utility as a composite device is provide to this industrial field.

Further, a positional relationship related to three main structures is as follows (32) . . . In use, the protruded corner awning device S1 is attached to the vicinity of the corner of the protruded corner portion N1 at one side, and the protruded corner awning device S2 is attached to the vicinity of the corner of the protruded corner portion N2 at the other side. Then, the rectangular awning device Q is attached to the linear zone between these awning devices S1, S2.

Here, dependent inventions related to the swing arms described in (31) above are listed below.

(33) The front end portions of the V-like arms V1, V2 are respectively attached to the fore and rear positions of the front bar F2 for the rectangular canvas P, respectively. The front end portions of the I-like arms I1, I2 are attached to the vicinity of the midpoints of the front bars F1, F3 for the protruded corner canvases G1, G2 (SQSIV1).

(34) . . . The front end portions of two V-like arms V1, V2 are respectively attached at an appropriately distance to the front bar F2*c* for the rectangular canvas P extended forward and rearward. The Y-like arms Y1, Y2 each comprised of the main link 66 and the sub-link 67 are attached symmetrically at fore and rear positions to the vicinity of the midpoints of the front bars F1, F3 for the protruded corner canvases G1, G2, in proximity to the opposite fore and rear end portions of the front bar F2*c* respectively. The front end portions of the sub-links 67 are attached to the opposite fore and rear end portions of the front bar F2*c*, respectively, whereas the front end portions of the main links 66 are attached to the vicinity of the midpoints of the front bars F1, F3, respectively (SQSIV2).

(35) . . . The V-like arms V1, V2 described in (33) above are replaced by Y-like arms Y1, Y2 each comprised of a main link 66 and a sub-link 76. The front end portions of the sub-links 76 are attached to the opposite fore and rear end portions of the front bar F12 for the rectangular canvas P, respectively, whereas the front end portions of the main links 66 are attached to the rear end portion of the front bar F11 for the protruded corner canvas G1 at one side and to the top end portion of the front bar F13 for the protruded corner canvas G2 at the other side, respectively (SQSIV3).

(36) . . . The front end portions of two parallel I-like arms I1, I2 are attached to the vicinity of midpoint and the rear end portion of the front bar F1 for the protruded corner canvas G1 at one side, respectively. The front end portions of two parallel I-like arms I1, I2 are attached to the top end portion and the vicinity of the midpoint of the front bar F13 for the protruded corner canvas G2 at the other side, respectively (SQSIV4).

(37) . . . the Y-like arms Y1, Y2 described in (34) above are replaced by two pairs of L-like arms L1 to L4 expandable and contractible in two phases. Among them, the front end portions of the L-like arms L1, L2 at one side are attached to the vicinity of the midpoint and to the rear end portion of the front bar F1 for the protruded corner canvas G1, whereas the front end portions of the L-like arms L3, L4 are attached to the top end portion and to the vicinity of the midpoint of the front bar F3 for the protruded corner canvas G2, respectively. A connection rod 65 is attached to a bi-foldable connecting portion of said L-like arms L1, L2, L3, L4 two of which respectively constitute one pair (SQSVI).

As to an Invention Related to Composite Devices SSII, SSIV of Fourth Type (Hereinafter, Referred to as a Fourth Invention), and its Advantageous Effect A first point of the fourth invention is in the case where the rectangular awning device Q at the midpoint of the device of the third type is not needed.

That is, (38) . . . A composite awning device is comprised of a combination of two protruded awning devices S1, S2 symmetrically at fore and rear positions, each equipped with a take-up device for winding and unwinding protruded corner canvases G1, G2. The protruded corner awning devices S1, S2 are equipped with take-up shafts J1 to J4 for the protruded corner canvases G1, G2, and their respective front bars F1, F3. The take-up shafts J1 to J4 are respectively comprised of an inner shaft and an outer roller 12, 12*a* fittedly inserted into the inner shaft. Two front bars F1, F3 for the protruded corner canvases G1, G2 are fitted on and supported to be movably guided to their guide rails F4. The guide rail F4 is translated forward and rearward by swing arms supporting the guide rail F4 and the front bars F1, F3, whereas the front bars at fore and rear positions are translated obliquely as they are movably guided by the guide rail F4.

By combining two protruded corner awning devices into a composite structure, appearance of building periphery including protruded corner portions at one side and the other sides is significantly enhanced, and an epoch-making and novel product rich in technical amusement and utility as a composite device is provide to this industrial field.

Further, dependent invention related to the swing arms described in (38) above is as follows.

(39) . . . The swing arms are two Y-like arms Y1, Y2 each comprised of a main link 66 and a sub-link 67 attached to the opposite fore and rear positions of the guide rail F4 to be symmetrically frontward and rearward. The front end portions of the sub-links 67 are attached to the opposite fore and rear end portions of the guide rail F4, respectively, whereas the front end portions of the main links 66 are attached to the vicinity of the midpoints of the front bars F1, F3 for the protruded corner canvases G1, G2, respectively (SSII).

Next, a second point of the fourth invention is in the case where the guide rail F4 described in (38) above is not needed.

That is, (40) - - - , specifically, a composite awning device includes a combination of two protruded corner awning devices S1, S2 located symmetrically at fore and rear positions and each equipped with a device for winding and unwinding the protruded corner canvases G1, G2. The protruded corner awning devices S1, S2 are equipped with take-up shafts J1 to J4 for the protruded corner canvases G1, G2 and front bars F1, F2. The take-up shafts J1 to J4 are comprised of an inner shaft and an outer roller 12, 12*a* fittedly inserted into the inner shaft. The respective front bars F1, F2 are translated obliquely as they are relatively movably guided by the swing arms that are fittedly inserted to support two front bars F1, F2 for the protruded corner canvases G1, G2 to be relatively movably guided and also support the front bars F1, F2.

By combining two protruded corner awning devices into a composite structure, appearance of building periphery including protruded corner portions at one side and the other sides is significantly enhanced, and an epoch-making and novel product rich in technical amusement and utility as a composite device is provide to this industrial field.

Further, a positional relationship related to three main structures is as follows (41) . . . In use, the protruded corner awning devices S1, S2 are installed to a position in the vicinity of the corner of the protruded corner portion N1 at one side and to another position in the vicinity of the corner of the protruded corner portion N2 at the other side to be in a symmetrically fore and rear relation.

Further, dependent inventions related to the swing arms described in (40) above are as follows.

(42) . . . Front end portions of two L-like arms L1, L2 expandable and contractible in two phases are attached to the vicinity of the midpoint and to the rear end portion of the front bar F1 for a protruded corner canvas G1 at one side, respectively. Front end portions of two L-like arms L3, L4 expandable and contractible in two phases are attached to the top end portion and to the vicinity of the midpoint of the front bar F2 for a protruded corner canvas G2 at the other side. A connection rod 65 is attached to a bi-foldable connecting portion of the L-like arms L1 to L4 two of which constitute one pair, respectively (SSIV).

(43) . . . The L-like arms L1 to L4 described in (42) above are replaced by I-like arms I1 to I4.

As to an Invention Related to Composite Devices WSQIV1 to 2 of Fifth Type (Hereinafter, Referred to as a Fifth Invention), and its Advantageous Effect The fifth invention employs a combination of the composite devices of the first type and also develops them into an integral structure.

(44) . . . Two pairs of composite awning devices SQIII1 to 9, SQII1 to 2, SQIV1 to 5 each comprised of a protruded corner awning device S1 equipped with a device for winding and unwinding a protruded corner canvas G1, and a rectangular awning device Q equipped with a device for winding and unwinding a rectangular canvas P are attached to one side and the other sides of a protruded corner portion N1 to be faced to each other.

By combining two pairs of composite devices as described above, appearance including a protruded corner portion of various building can be significantly enhanced.

Specifically, (45) . . . The protruded corner awning device S1 is equipped with take-up shafts J1 to J4 for a protruded corner canvas G1, and front bars F1, E1. The take-up shafts J1 to J4 are comprised of an inner shaft and an outer roller 12, 12*a* fittedly inserted into the shaft. The rectangular awning device Q is equipped with a take-up roller 38 for a rectangular canvas P and front bars F2, F2*a*, E2. The front bars F1, E1 for the protruded corner canvas G1 are fitted on and supported to the front bars F2, F2*a*, E2 for the rectangular canvas P to be movably guided. The front bars F2, F2*a*, E2 for the rectangular canvas P at one side are translated forward and rearward, whereas the front bars F2, F2*a*, E2 of the rectangular canvas at the other side are translated leftward and rightward, so that the front bars F1, E1 for the protruded corner canvas G1 are translated obliquely by means of swing arms supporting both the front bars F1, F2, F2*a*, E1, E2.

Thereby, an epoch-making and novel product rich in technical amusement and utility as a composite device is provide to this industrial field.

(46) . . . Top end portions of the front bars F1, E1 faced to each other and located at one side and the other side of the protruded corner portion N1 are connected with each other with a stretching rope, chain, or any other connecting tool. Thereby, two pairs of composite devices can be assuredly looked like as if they are integral into one piece unit.

(47) . . . The top end portions of the front bars F1, F1 faced to each other and located at one side and the other side of the protruded corner portion N1, and are connected and fixed, so that the corresponding corner frame F5 is moved linearly obliquely (WSQIV1). Thereby two pairs of composite devices are integrated into one piece unit.

Further, dependent inventions related to the front bars and the swing arms are as follows.

(48) . . . Bi-foldable V-like arms V1, V2 are attached to the opposite fore and rear end portions of the front bars F2*a* extended to the vicinity of the corner end portion of the protruded corner portion N1 (WSQIV1).

(49) . . . The V-like arm V1 described in (48) above is replaced by a Y-like arm Y1 comprised of a main link 66 and a sub-link 67. Among them, the front end portion of the sub-link 67 is attached to the top end portion of the front bar F2*a* of the rectangular canvas P, whereas the front end portion of the main link 66 is attached to the vicinity of the front bar F1 of the corner frame F5.

(50) . . . The V-like arm V1 described in (48) above is comprised of a rear link 511 and a front link 512 so that the V-like arm V1 is bi-foldable. A bent link 514 bent at an appropriate angle θ is protruded outward from the front end portion of the front link 512. The top end portion of the bent link 514 and the vicinity of the recessed corner of the corner frame F5 are connected to each other by means of a connection rod 78 (QSQIV2).

Thereby, reliability of operation for the corner frame F5 is assured.

(51) . . . The bent angle θ described in (50) above is set to be substantially the same as the angle of the protruded corner portion N1. Thereby, compact storage to the wall surface is enabled in both the cases where the angle of the protruded corner portion is an obtuse angle and an acute angle.

Other cases where either two pairs of composite devices of first to fourth types are combined are listed below.

(52) . . . one pair of composite awning devices SQIII1 to 9, SQII1 to 2, SQIV1 to 5 described in (1), (2) above and one pair of composite awning devices SUIII, SUII described in (24), (25) above are faced to each other and located at one side and the other side of the protruded corner portion N1.

(53) . . . Two pairs of composite awning devices SUIII, SUII described in (24), (25) above are faced to each other and located at one side and the other side of the protruded corner portion N1.

(54) . . . One pair of composite awning devices SQIII1 to 9, SQII1 to 2, SQIV1 to 5 described in (1), (2) above, and a pair of composite awning devices SSII, SSIV described in (38), (49) above are faced to each other and located at one side and the other side of the protruded corner portion N1.

(55) . . . One pair of composite awning devices SQIII1 to 9, SQII1 to 2, SQIV1 to 5 in (1), (2) above and a pair of composite awning devices SQSIV1 to 4, SQSVI described in (30), (31) above are faced to each other and located at one side and the other side of the protruded corner portion N1.

(56) . . . Two pairs of composite awning devices SQSIV1 to 4, SQSVI described in (30), (31) above are faced to each other and located at one side and the other side of the protruded corner portion N1.

Here, dependent inventions related to the protruded corner canvases G1, G2 constituting the protruded corner awning devices S1, S2 of the present invention, their take-up shafts J1 to J4, and their relationship with the front bars F1, E1, and their operational structures, and the like of the present invention are listed below.

(57) . . . The protruded corner canvases G1, G2 are in a substantially right-angled trapezoidal shape when extended, and are comprised of a rectangular canvas main body portion R1 and a canvas extending portion R2 extended from one side of the canvas main body portion R1. The canvas top sides 1 of the protruded corner canvases G1, G2 are attached to the outer roller 12, 12*a*, whereas the canvas bottom sides 2 thereof are attached to the front bars F1, E1.

(58) . . . The canvas main body portion R1 described in (57) above is structured to be wound around the outer roller 12, 12*a*, whereas the canvas extending portion R2 is structured to be exposed as the outer roller 12, 12*a* are moved rearward.

(59) . . . To unwind the protruded corner canvases G1, G2 wound around the take-up shafts J1 to J4, the outer roller 12, 12*a* is moved forward in the axial direction as it is rotated to be unwound.

(60) . . . Tensioning members such as connection wires 26 27 and a connection belt are attached between the outer roller 12, 12*a* and the front bars F1, F3, F11, F13, E1 into the shape of the letters X and V when seen from top. Thereby, in-plane deformation such as shrinkage and distortion of the protruded corner canvas when wound is prevented.

(61) . . . The inner shaft is an inner rotation shaft 11, 11*a*, 11*b*. An outer roller 12, 12*a* is fitted on and supported by the inner rotation shaft 11, 11*a*, 11*b* to be movably guided. Thereby, the protruded corner canvas is wound without protruded from the axial length of its take-up shaft.

(62) . . . Guide grooves 111, 113 and a guide projection 112 are formed in the axial direction of the inner rotation shaft 11, 11*a*, 11*b* described in (61) above.

(63) . . . End caps 20, 20*a*, 21 are fitted to the outer roller 12, 12*a* described in (61) above. On the inner peripheral surface of the end caps 20, 20*a*, 21, guide projections 201, 203, 211, and guide grooves 202, 212 to be fittedly inserted into the guide grooves 111, 113 and guide projection 112 described in (62) above are formed.

These guide projections and guide grooves enable the inner rotation shaft and the outer roller to integrally rotate forwardly and reversely, and also enable the outer roller to smoothly move forward and rearward.

(64) . . . End caps 14, 15 are fitted to the casing K1 for winding and storing the protruded corner canvas G1. An inner rotation shaft 11, 11*a*, 11*b* having end caps 16, 17, 17*a*, 17*b* fitted to its opposite fore and rear end portions is bearing supported by the end caps 14, 15. An outer roller 12, 12*a* having end caps 20, 20*a*, 21 fitted at its opposite fore and rear end portions is fitted on and supported by the inner rotation shaft 11, 11*a*, 11*b*.

(65) . . . A wheel guide groove 113 is formed in the axial direction of the inner rotation shaft 11*b*. The outer roller 12*a* fittedly inserted into the inner rotation shaft 11*b* is structured with a wheel 79 incorporated therein to move along the guide groove 113. Due to the take-up shaft in a rolling structure, the take-up shaft can more smoothly move forward and rearward relative to the outer roller.

(66) . . . A fitting groove 122 formed on the inner surface of the outer roller 12*a*, and a wheel unit D is fitted to the fitting groove 122, so that a wheel 79 assembled to the unit D can roll along a wheel guide groove 113. Thereby, a simple assembly is enabled for use in practical use.

(67) . . . An electric motor M1 for forwardly and reversely rotating the inner rotation shaft 11, 11*a*, 11*b* and the outer roller 12, 12*a* is incorporated inside the inner rotation shaft 11, 11*a*, 11*b*.

(68) . . . A motor output shaft 181 and a rigid shaft portion 182 are provided to the opposite fore and rear end portions of the electric motors M1 described in (67) above. A gear socket 19 fitted to the motor output shaft 181 at one side is fittedly inserted and engaged with the inside of the inner rotation shaft 11, 11*a*, 11*b*. The rear portion of the electric motor M1 is fittedly inserted into the end cap 17 of the inner rotation shaft 11, 11*a*, 11*b*. The rigid shaft portion 182 at the other side is fitted to the end cap 15 of the casing K1.

(69) . . . A manually or electrically driven unit for forwardly and reversely rotating the inner rotation shaft 11, 11*a*, 11*b* and the outer roller 12, 12*a* are incorporated into the shaft end portion of the inner rotation shaft 11, 11*a*, 11*b*.

(70) . . . A coil spring for storing and releasing a forward and reversal rotation force of the outer roller 12, 12*a* as elastic energy is incorporated inside the inner rotation shaft 11, 11*a*, 11*b*.

(71) . . . A rigid shaft 57 is threaded through the coil spring 55 described in (70) above. One side of the coil spring 55 is locked with a spring socket 56 fitted to the top end portion of the rigid shaft 57 to be fitted on and supported inside the inner rotation shaft 11, whereas the other side of the rigid shaft 57 is threaded through the end cap 17*a* of the inner rotation shaft 11. Upon locking the other side of the coil spring 55 with the end cap 17*a*, the coil spring 55 is fitted to the end cap 15 of the casing K1.

Next, dependent inventions related to the rectangular canvas Q and the recessed corner canvases T1, T2 constituting the rectangular awning device Q and the recessed corner awning devices U1, U2, and their take-up rollers 38, 38*a*, their relationship with the front bars F2, E2, and their operational structures and the like of the present invention are listed below.

(72) . . . Pouched passages 24*a*, 24*b*, 24*b*, 25*b* in the shape of the letter X or V when seen from above is formed on the main body portion of the rectangular canvas P. One of the connection wires 26, 27 threaded through inside the pouched passages is connected to the take-up roller 38, whereas the other one is connected the front bars F2, F2*a*, E2, respectively. Thereby, in-plane deformation of the rectangular canvas P can be prevented.

(73) . . . The recessed corner canvases T1, T2 are formed into a substantially right-angled reversal trapezoidal shape when extended. Pouched passages 24*c*, 25*c* in the shape of the letter X or V when seen from above are formed on the main body rectangular portion of the recessed corner canvases T1, T2. One of the connection wires inserted into the pouched passages 24*c*, 25*c* is connected to the take-up rollers 38, 38*a*, whereas the other one is connected to the front bars F2, F2*b*, E2, respectively. Thereby, in-plane deformation of the recessed corner canvases T1, T2 can be prevented.

(74) . . . An electric motor M2 is contained into the take-up rollers 38, 38*a*, and the opposite fore and rear end portions thereof are provided with a motor output shaft 181 and a rigid shaft portion 182, respectively. Among them, a gear socket 42 fitted to the motor output shaft 181 at one side is fittedly inserted and engaged with the inside of the take-up rollers 38, 38*a*, whereas the rear portion of the electric motor M2 is fittedly inserted into the end cap 44 of the take-up rollers 38, 38*a*. The rigid shaft portion 182 at the other side is fitted to the end cap 41 of the casing K2.

(75) . . . A coil spring 55 for storing and releasing the forward and reversal rotation force of the take-up shafts 38, 38*a* as elastic energy is incorporated inside the take-up rollers 38, 38*a*.

(76) . . . A rigid shaft 57 is threaded through the coil spring 55 described in (75) above. One side of the coil spring 55 is locked with a spring socket 56 fitted to the top end portion of the rigid shaft 57 to be fitted on and supported inside the take-up rollers 38, 38*a*, whereas the other side of the rigid shaft 57 is threaded through the end cap 44*a* of the take-up rollers 38, 38*a*. Upon locking the other side of the coil spring 55 with the end cap 44*a*, the coil spring 55 is fitted to the end cap 41 of the casing K2.

(77) . . . The rotation shaft 37 of the take-up roller 38 for the rectangular canvas P is extended to the corner end portion of the protruded corner portion N1. Two take-up rollers 38 butted against each other at the lower side of the protruded corner portion N1 and two inner rotation shafts 11, 11*a*, 11*b* of the take-up shafts J2 to J4 butted against each other at the upper side of the protruded corner portion N1 are interlocked with each other to be forwardly and reversely rotatable by double manually or electrically driven structures.

Here, dependent inventions related to the relationship between the take-up shafts J1 to J4 and the take-up rollers 38, 38*a* of the present invention are listed below.

(78) . . . The former half at the upper position of the take-up rollers 38, 38*a* are combined with the latter half at the lower position of the take-up shafts J1 to J4 at a proper shaft interval. The protruded corner canvases G1, G2 are lower-wound around the take-up shafts J1 to J4, whereas the rectangular canvas P or the recessed corner canvases T1, T2 are upper-wound around the take-up rollers 38, 38*a*.

(79) . . . The former half at the lower position of the take-up rollers 38, 38*a* is combined with the latter half at the upper position of the take-up shafts J1 to J4 at a proper shaft interval. The protruded corner canvases G1, G2 are upper-wound around the take-up shafts J1 to J4, whereas the rectangular canvas P or the recessed corner canvases T1, T2 are lower-wound around the take-up rollers 38, 38*a*.

(80) . . . The latter half portion of the take-up shafts J1 to J4 for the protruded corner canvas G1 at one side is combined with the former half portion of the take-up shafts J1 to J4 for the protruded corner canvas G2 at the other side symmetrically at fore and rear positions shifted upward and downward from each other at an appropriate shaft distance. The protruded corner canvas G1 at one side is lower-wound around its take-up shafts J1 to J4, whereas the protruded corner canvas G2 at the other side is upper-wound around its take-up shafts J1 to J4.

(81) . . . The take-up shafts J1 to J4 for the protruded corner canvas G1 and the take-up rollers 38, 38*a* for the rectangular canvas P or the recessed corner canvases T1, T2 are incorporated into one and the same casing K3 at its upper side and lower side, respectively. Thereby, integrity as a device is enhanced.

(82) . . . Two casings K1 containing the take-up shafts J1 to J4 for the protruded corner canvases G1, G2 are attached to the former half at the upper position and the latter half at the upper position of the casing K2 containing the roller 38 of the rectangular canvas P to be symmetrically at fore and rear positions. The protruded corner canvases G1, G2 are lower-wound around the take-up shafts J1 to J4, whereas the rectangular canvas P is upper-wound around the take-up roller 38.

(83) . . . Two casings K1 containing the take-up shafts J1 to J4 for the protruded corner canvases G1, G2 are attached to the former half at the upper position and to the latter half at the upper position of the casing K2 containing the roller 38 for the rectangular canvas P to be in a symmetrically fore and rear relation. The protruded corner canvases G1, G2 are upper-wound around the take-up shafts J1 to J4, whereas the rectangular canvas P is lower-wound around the take-up roller 38.

(84) . . . The inner rotation shaft 11, 11*a* of the take-up shafts J1 to J4 described in (81) above and the take-up rollers 38, 38*a* are meshed and engaged with each other via flat wheels 61, 62.

Next, dependent inventions for narrowing the gap and step at the canvas top portion are listed below.

(85) . . . At the last stage of the canvas withdrawing, the position in the vicinity of the canvas top portion of either one or both of the protruded corner canvases G1, G2 and the rectangular canvas P or the rectangular corner canvases T1, T2 is depressed down or pushed upward by a swinging flap 97 to narrow the gap of the vicinity of the canvas top portion.

(86) . . . At the last stage of the canvas withdrawing, the position in the vicinity of the canvas top portion of the respective protruded corner canvases G1, G2 is depressed down or pushed upward by a swinging flap 97 to narrow the gap of the vicinity of the canvas top portion.

(87) . . . At the last stage of the canvas withdrawing, the swinging flap 97 is engaged with the protrusion 99 and the engagement hole formed at a position in the vicinity of the canvas top portion. As the canvas is further withdrawn, the swinging flap 97 swings to depress downward and push up the position in the vicinity of the canvas top portion, thereby narrowing the gap of the canvas top portion.

(88) . . . The swinging flap 97 is attached to either one or both of immediately above or immediately below the canvas outlets 13, 13*a* of the casings K1, K3 containing the take-up shafts J1 to J4 for the protruded corner canvases G1, G2.

(89) . . . The swinging flap 97 is attached to either one or both of immediately above or immediately below the canvas outlets 39, 13*a* of the casings K2, K3 containing the take-up rollers 38, 38*a* for the rectangular canvas P and the recessed corner canvases T1, T2.

(90) . . . The swinging flap 97 is attached to the take-up shafts J1 to J4 for the protruded corner canvases G1, G2 or to the cover plates of the take-up rollers 38, 38*a* for the rectangular canvas P or the recessed corner canvases T1, T2.

Further, dependent inventions related to the relationship between the front bars and their structures are listed below.

(91) . . . The front bars F1, F3, E1 for the protruded corner canvases G1, G2 are at outer sides, whereas the front bars F2, F2*a*, F2*b*, F2*c*, E2 of the rectangular canvas P or the recessed corner canvases T1, T2 are at inner sides.

(92) . . . The front bars F11, F13 for the protruded corner canvas G1 is at inner sides, whereas the front bar F12 for the rectangular canvas P is at an outer side.

(93) . . . The front bars F1, E1 at the outer sides are formed with, in the longitudinal direction, fitting grooves 291, 841 to which the canvas bottom sides 2 of the protruded corner canvases G1, G2 are to be fitted, and fitting grooves 292, 842 of the front skirt 31, respectively. The front bars F2, F2*a*, F2*b*, F2*c*, E2 at the inner sides are formed with fitting grooves 471, 901 to which the canvas bottom side 6 of the rectangular canvas P or the recessed corner canvases T1, T2, respectively, in the longitudinal direction.

(94) . . . The front bars F12, E1 at the outer sides are formed with fitting grooves 291, 841 to which the canvas bottom side 6 of the rectangular canvas P is to be fitted, and fitting grooves 292, 842 of the front skirt 49, respectively, in the longitudinal direction. The front bars F11, F13, E2 at the inner sides are formed with, in the longitudinal direction, fitting grooves 471, 901 to which the canvas bottom side 2 of the protruded corner canvases G1, G2 are to be fitted, and fitting grooves 472, 902 of the front skirt 31, respectively.

(95) . . . The front bars F2, F2*a*, F2*b*, F2*c*, F11, F13 at the inner sides described in (93), (94) above are formed with, in the longitudinal direction, fitting grooves 461, 462 for slidably guiding the front bars F1, F12 at the outer sides.

(96) . . . To fittedly inserting the front bar E1 at the outside into the front bar E2 at the inner side to be guided while rolling, guide wheels 861, 862 which horizontally rotate are contained into the front bar E1 at its rear end portion. Guide wheels 931, 932 that horizontally rotate are provided to the top end portion of the front bar E2. Thus, the guide wheels 931, 932 roll on the inner side surface of the front bar E1, whereas the guide wheels 861, 862 roll in wheel rooms 881, 882 formed above and below the front bar E2.

(97) . . . A wheel holder 92 is fittedly inserted to be fixed at the top end portion of the front bar E2 at the inner side described in (96) above, and guide wheels 931, 932 that horizontally rotate are bearing supported above and below the top end portion of the wheel holder 92.

(98) . . . The front bar E1 at the outer side is made of a molded steel member having an opening at the center on its back surface, and includes a front plate portion 831, an upper plate portion 832, and a lower plate portion 833. At a boundary between the front bar E1 and a cover plate portion 834 protruded rearward of the upper plate portion 832, an upper fitting groove 841 to which the canvas bottom side 2 of the protruded corner canvases G1, G2 is formed. An engagement flanged edge 851 is suspended from the lower portion of the upper fitting groove 841, and at the same time, a flanged edge 852 is protruded from the engagement flanged edge 851 toward the inside of the front bar E1. At the rear position of the bottom plate portion 833, a lower fitting groove 842 to which front skirt 31 is to be attached is formed, and an engagement flanged edge 853 is protruded perpendicularly above the lower fitting groove 842.

(99) . . . Guide wheels 861, 862 are contained in the front bar E1 described in (96), (98) above at upper and lower positions in its rear end portion. Among them, the upper wheel 861 is horizontally rotatably supported by a protrusion 854 of the flanged edge 852, whereas the lower wheel 862 is horizontally rotatably supported inside the lower plate portion 833.

(100) . . . The front bar E2 at the inner side is a molded steel member having the shape of rectangular cylinder in cross section, and includes a front plate portion 871, a rear plate portion 872, an upper plate portion 873, and a lower plate portion 874. Above and below the front bar E2, wheel rooms 881, 882 partitioned from each other by partitions 891, 892, for guiding the upper wheel 861 and the lower wheel 862 while rolling respectively are formed. At the end portions of the partitions 891, 892 protruded rearward from the rear plate portion 872, an upper fitting groove 901 to which the canvas bottom side 6 of the rectangular canvas P or the recessed corner canvases T1, T2 is to be attached, and a lower fitting groove 902 to which the front skirt 49 is to be attached are formed, respectively. An engagement flanged edge 911 is formed downward on the bottom of the upper fitting groove 901, whereas an upward engagement flanged edge 912 is extended above the upper portion of the lower fitting groove 902.

(101) . . . A wheel holder 92 is fitted and fixed to the top end portion of the front bar E2 described in (100) above. Above and below the top end protrusion thereof, guide wheels 931, 932 are horizontally rotatably supported. At the center portion of the lower plate portion 874, a guide slit 941 for movably guiding a shaft pin 864 of the lower wheel 862 is opened. At the upper portion of the rear plate portion 872, a guide slit 942 is formed to pass and guide the flanged edge 852 therethrough.

(102) . . . A front bar E1 containing guide wheels 861, 862 in its rear end portion at upper and lower positions is inserted and fitted to the front bar E2 including guide wheels 931, 932 at its top end portion and wheel rooms 881, 882 at upper and lower positions. Thereby, The guide wheels 931, 932 at one side are fitted above and below the front bar E1, whereas the guide wheels 861, 862 at the other side are fitted to the wheel rooms 881, 882.

Here, dependent inventions related to means for attaching the brackets are mainly listed below.

(103) . . . Brackets 68, 95 are pivotally provided to the front end portion of the main link 66 of the respective Y-like arms Y1, Y2 described in (8) to (11), (13), (15), (21), (22), (28), (29), (34), (35), (39), (49). The brackets 68, 95 are fixed to the front bars F1, E1 at the outer sides, and are also slidably attached to the front bars F2, F2*a*, F2*b*, E2 at the inner sides.

(104) . . . The brackets 68, 95 described in (102) above include rising portions 681, 951 and receiving base portion 682, 952. Among them, the central protrusion of the rising portions 681, 951 is fitted into the opening on the back surface of the front bars F2, F2*a*, F2*b*, E2. The upper and lower flanged edges 481, 482, 911, 912 on the back surface portion of the front bars F2, F2*a*, F2*b*, E2 are pinched by an attachment plate 69 fitted inside position of the upper flanged edges 481, 482, 911, 912.

(105) . . . A rod is fittedly inserted into guide grooves 292, 842 of the front bars F1, E1. Then, the rod 70 is fixed to the base receiving portion 682, 952 of the brackets 68, 95 described in (103), (104) above.

(106) . . . A mechanism for increasing a lateral movement stroke of the protruded corner canvas G1 relative to the front bars F1 is added.

(107) . . . A mechanism for increasing a lateral movement stroke is installed to either one of the front end portions of the main link 66 and the I-like arm I2 described in (9), (11) above, the front end portion of the main link 66 of the Y-like arms Y1, Y2 described in (10), (34), the front end portions of the I-like arms I1, I2 described in (12) above, and the front end portion of the main link 66 of the Y-like arm Y1 described in (15) above.

(108) . . . Brackets 68*a*, 96 are pivotally supported to be horizontally rotatable in the vicinity of the front end portion of either one or both of the main link 66 of the Y-like arms Y1, Y2 and I-like arms I1, I2. The center protrusions of the rising portions 681, 961 of the brackets 68*a*, 96 are fitted into the openings on the back surfaces of the front bars F2*a*, E2 extended to the top end portion of the device, respectively. Upper and lower flanged edges 481, 482, 911, 912 on the back surfaces of the front bars F2*a*, E2 are pinched by an attachment plate 69 fitted inside the upper and lower flanged edges 481, 482, 911, 912.

(109) . . . A protrusion 662 bent at an appropriate angle obliquely forward is formed at the front end portions of the main link 66 and the I-like arms I1, I2 described in (106), (107) above. A long hole 663 is opened at the front end portion of the protrusion 662. On the other hand, a rod 70*a* having a screw 702 is fittedly inserted into downward fitting grooves 292, 842 of the front bars F1, E1 at the outer sides, and a cylindrical nut 703 fitted into the long hole 663 is fixed to the screw 702.

(110) . . . An engagement piece 72 is protruded from the bottom on the back surface of the front bar F1 described in (15), (39) above, and a shaft pin 661 formed at the front end portion of the main link 66 is loosely fitted and engaged with the long hole 721 of the engagement piece 72.

(111) . . . Engagement pieces 76 are protruded from the opposite fore and rear positions on the bottom of the front bar F12, and the rising portion 752 formed at the front end portion of the sub-rod 75 is locked with the engagement piece 76.

Finally, dependent inventions related to L-like arms L1 to L4 slidably expandable and contractible in two phases are listed below.

(112) . . . The L-like arms L1, L2, L3, L4 described in (14), (23), (37), (42) above are respectively comprised of a rear link 711 and a front link 712 foldably connected to each other, and the bi-foldable connecting portion is connected by a connection rod 65.

(113) . . . A spring with a relatively weak spring elastic force is incorporated into the base end portion of the rear link 711 described in (111) above, whereas a spring with a relatively strong elastic force is incorporated into the foldable connecting portion between the rear link 711 and the front link 712.

(114) . . . To wind the protruded corner canvases G1, G2 around their take-up shafts J1 to J4, firstly, a pair of rear links 711 described in (111), (112) biased by a relatively weak spring elastic force is rotated rearward in parallel against the elastic biasing force, so as to obliquely linearly translate the front bars F1, F11, F3, F13 for the protruded corner canvases G1, G2 to fold these rear links 711. Secondly, a pair of front links 712 biased by a relatively strong spring elastic force is rotated obliquely linearly in parallel against the elastic biasing force, so as to further obliquely translate the front bars F1, F11, F3, F13, thereby L-like arms L1, L2, L3, L4 are substantially linearly stretched and folded.

(115) . . . To unwind the protruded corner canvases G1, G2 wound around the take-up shafts J1 to J4, firstly, a pair of front links 712 described in (111), (112) biased by a relatively strong spring elastic force is rotated in parallel by the biasing force in a forward stretching direction to reach a predetermined extended angle so as to push the front bars F1, F11, F3, F13, E1 while translating them obliquely forward. Secondly, a pair of rear links 711 biased by a relatively weak spring elastic force is rotated in parallel to reach a predetermined stretching angle, so as to push the front bars F1, F11, F3, F13 to be translated further obliquely forward.

In these drawings, canvases are usually opaque. However, in order to show a structure at a back side hidden and invisible, the canvases are shown in a transparent state in accordance with necessity. Similarly, canvas-take up shafts and take-up rollers incorporated in casings are also shown by seeing through the casings in accordance with necessity.

In many drawings, the composite device is shown three-dimensionally as if it is attached to a frame body in the shape of the letter L, strip plate, crank, reversed letter C and the like at substantially horizontal posture or forwardly tilted posture. However, this illustration is based on convenience for illustrating the drawings.

Figure 1A:
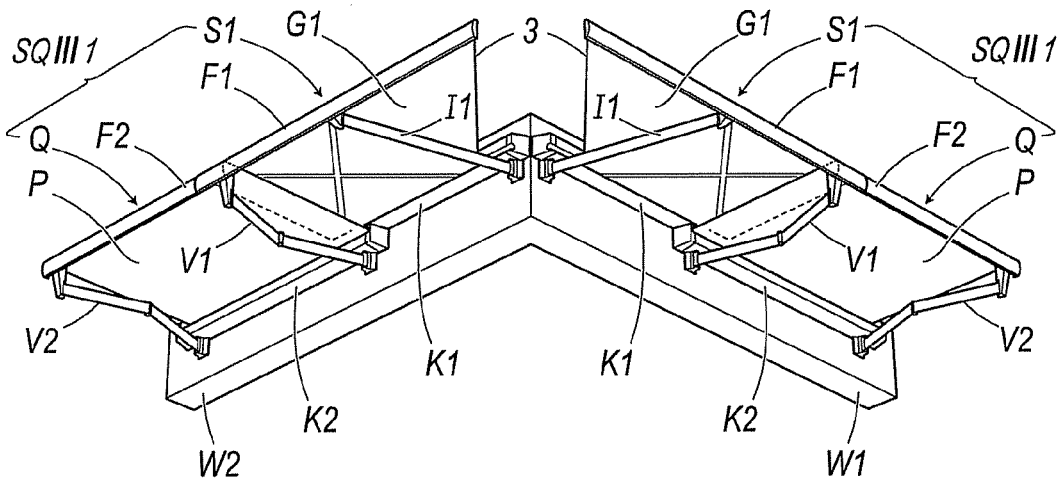
FIGS. 1 to 11 are diagrams respectively showing a composite device SQIII1 of a first type comprised of a protruded corner awning device and a rectangular awning device, and showing a first embodiment where a front bar of a rectangular canvas and a front bar of a protruded corner canvas fitted and inserted into the front bar of the rectangular canvas is supported by three swinging arms, and their constituent members.
Figure 1B:
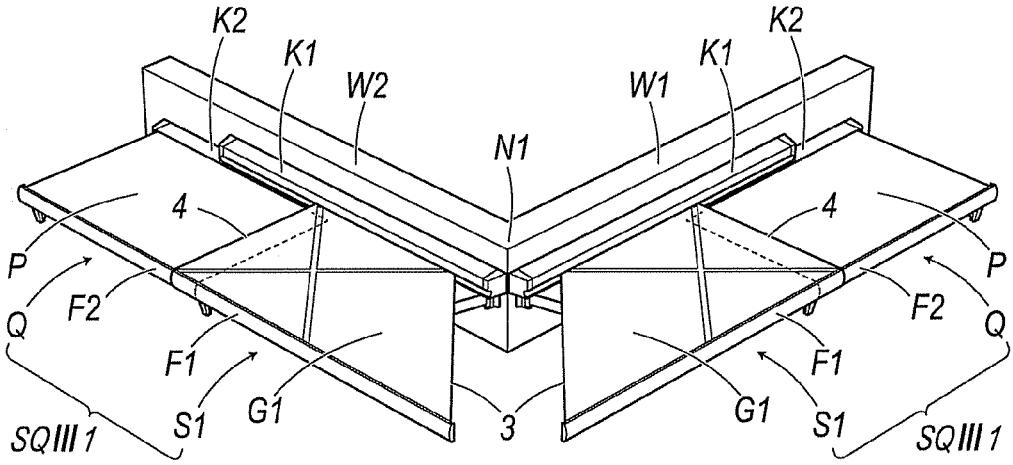

FIGS. 1A and 1B are perspective views showing two extended composite devices SQIII1 faced to each other at one side and the other side of a protruded corner portion. Among them, FIG. 1A shows a state where the composite device SQIII1 is looked up from obliquely downward, and FIG. 1B shows a state the composite device SQIII1 is looked down from obliquely upward.

Figure 2:
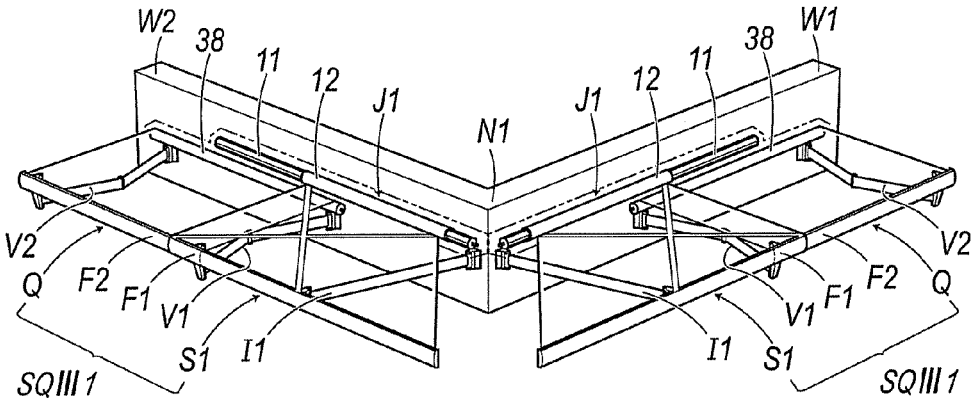

FIG. 2 is a see-through view of FIG. 1B.

Figure 3:
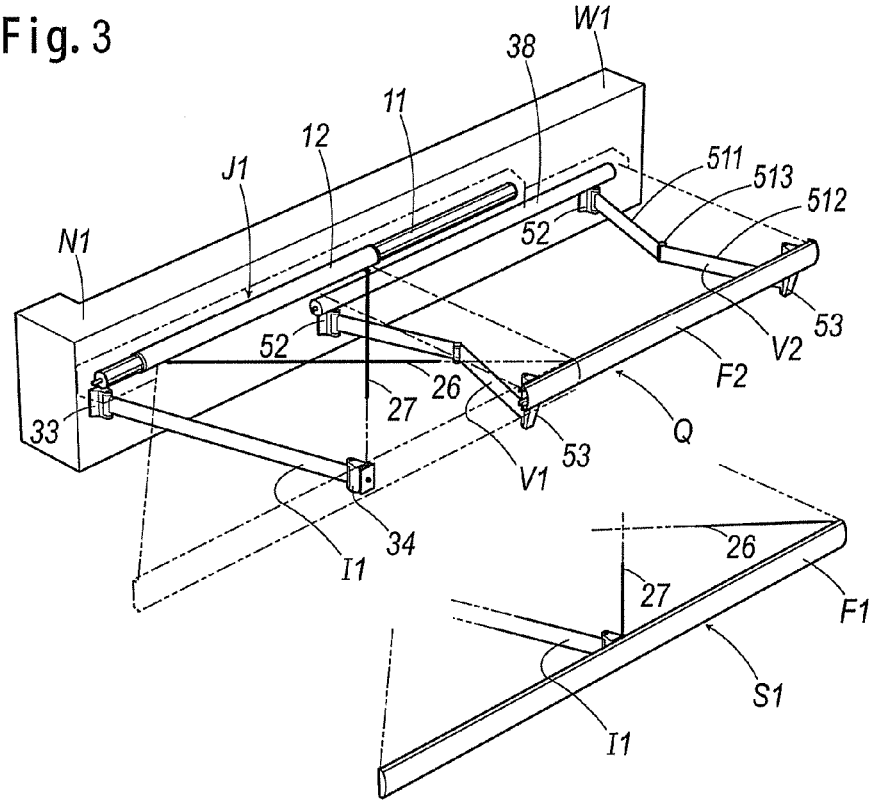

FIG. 3 is a see-through view showing a state where a protruded corner canvas and its front bar is separated from each other.

Figure 4A:
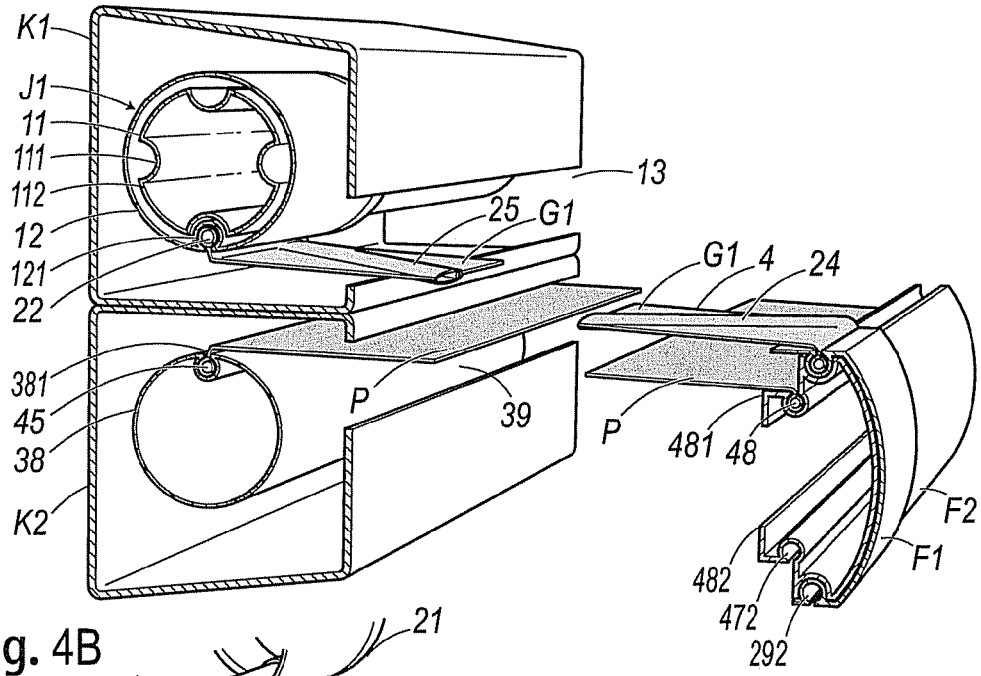
Figure 4B:
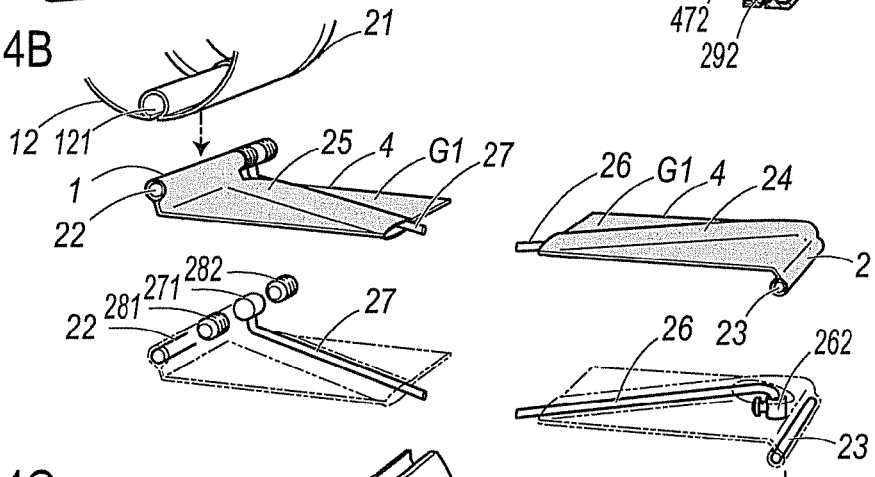
Figure 4C:
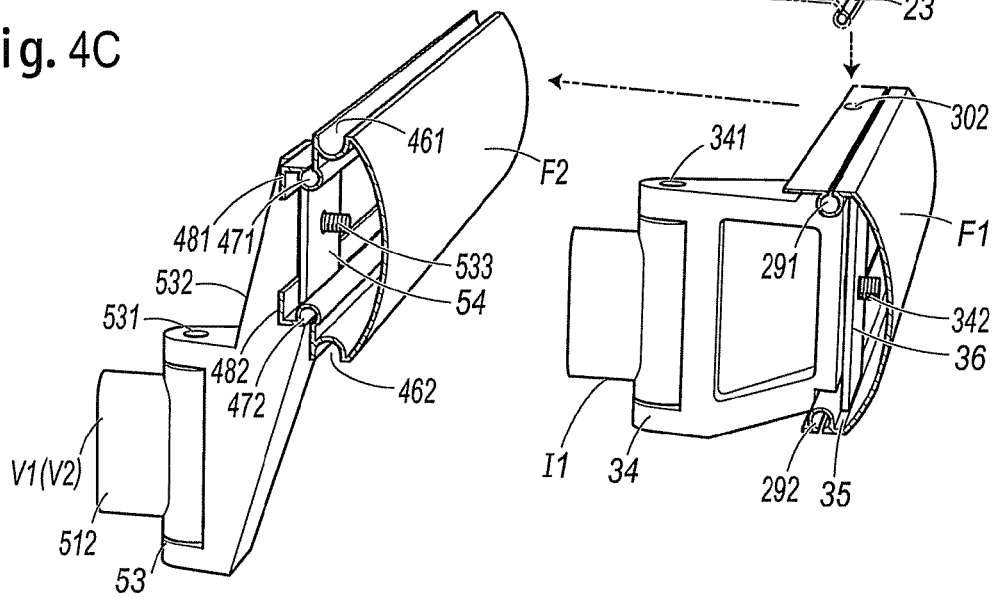

FIGS. 4A to 4C are longitudinal perspective view showing a location in the vicinity where the protruded corner canvas and the rectangular canvas are overlapped with each other. Among them, at upper, middle, and lower positions in FIG. 4B, a rear portion of a partially enlarged outer roller, a rear portion of a protruded corner canvas, a base end portion and an end portion of a connection wire passed through said canvas are seen through. At a right position in FIG. 4C, a front bar of a protruded corner canvas and its bracket is shown, whereas at a left position in FIG. 4C, a front bar of a rectangular canvas and its bracket is shown, respectively.

Figure 5A:
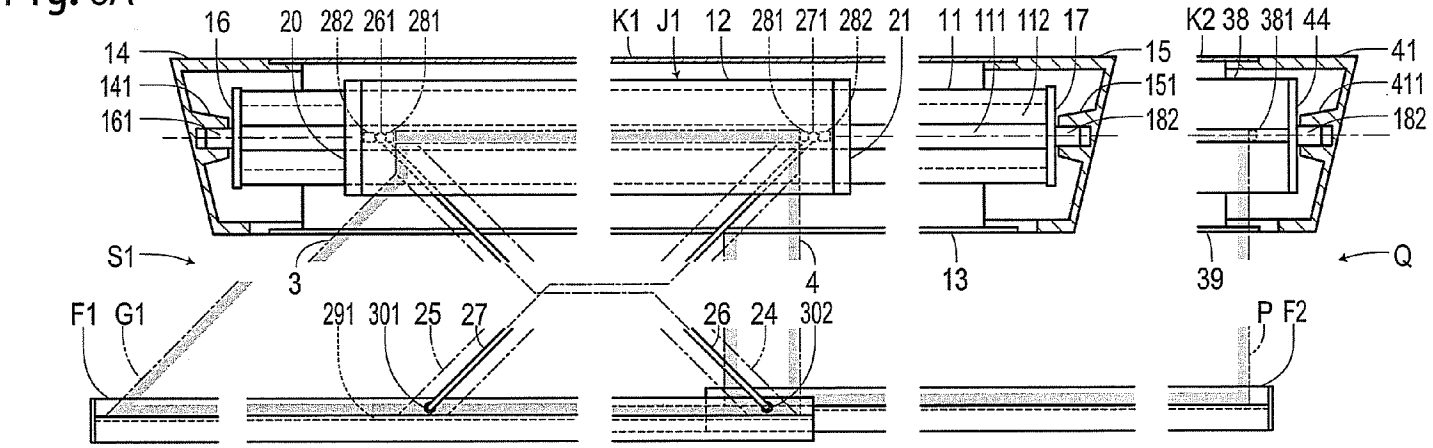
Figure 5B:
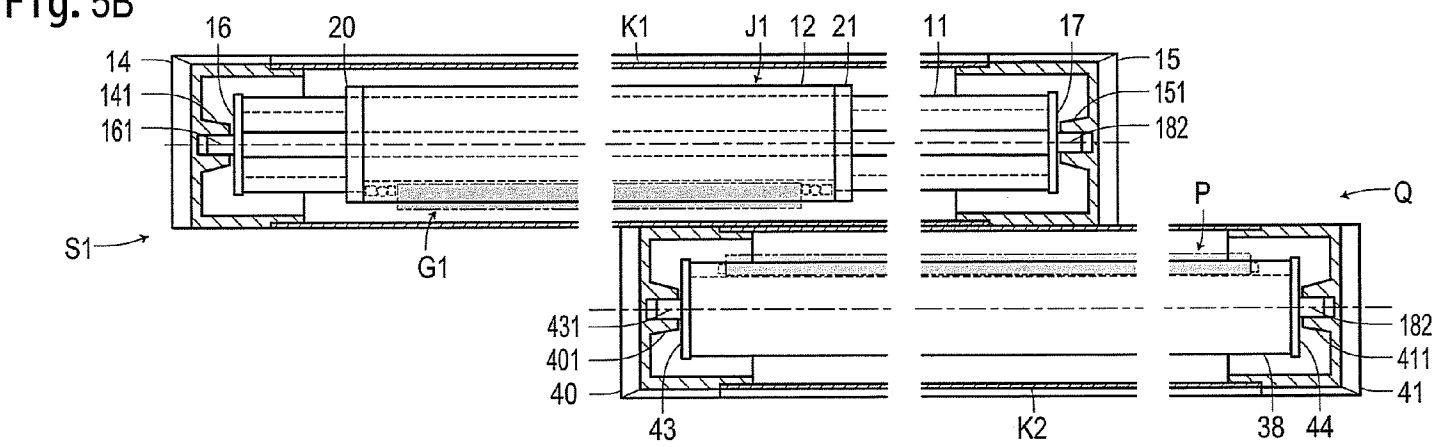

FIGS. 5A and 5B are horizontal plan view and longitudinal front view of the composite device SQIII1, respectively.

Figure 6:
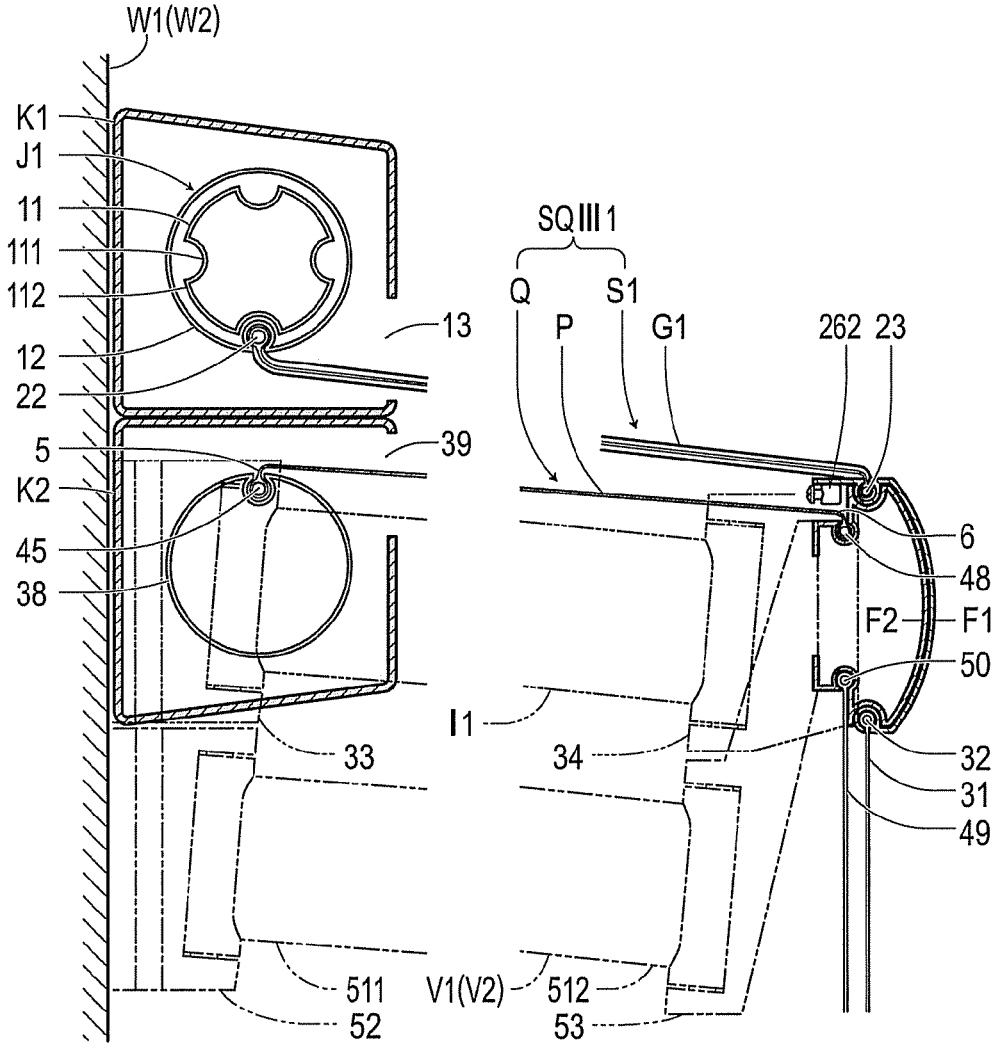

FIG. 6 is a longitudinal side view of the composite device SQIII1, where a swing arm for supporting a front bar and bracket at its opposite front and rear end portions are shown by an imagined line.

Figures 7A, 7B, 7C:
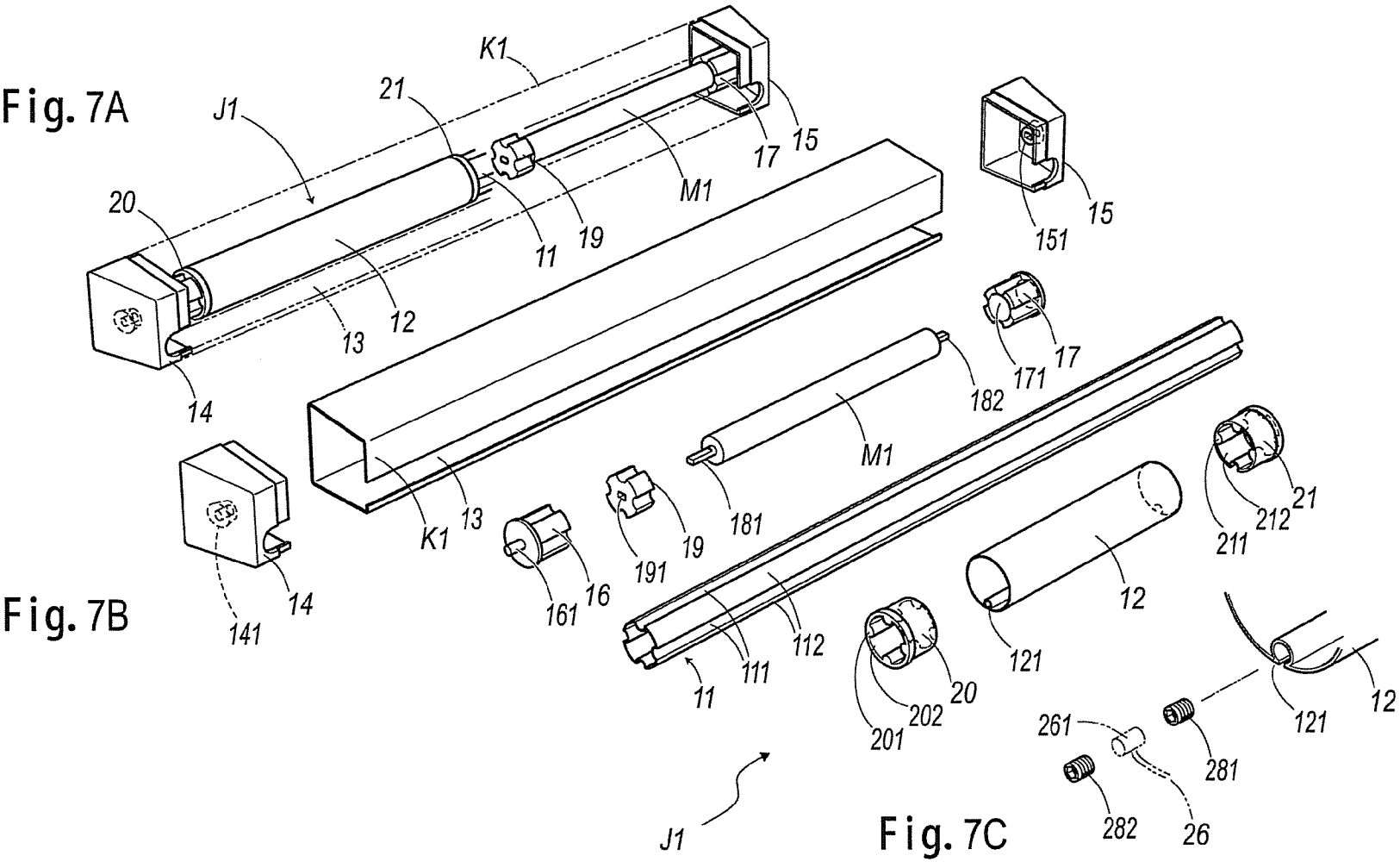

FIGS. 7A to 7C are perspective views showing a take-up device of a protruded corner canvas incorporating an electric motor. Among them, FIG. 7A shows a state where the latter half portions of the casing and inner rotation shaft are seen through, and FIG. 7B shows constituent elements such as a casing, an electric motor, an inner rotation shaft, an outer roller, and the like. FIG. 7C shows an enlarged end portion of an outer roller, and also shows a screw for positioning and fixing a base end portion of a connection wire.

Figure 8A:
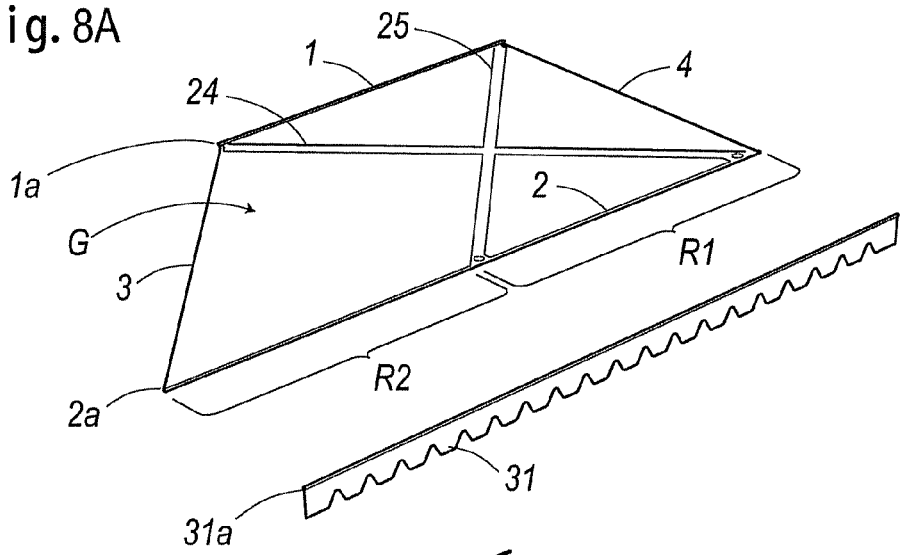
Figure 8B:
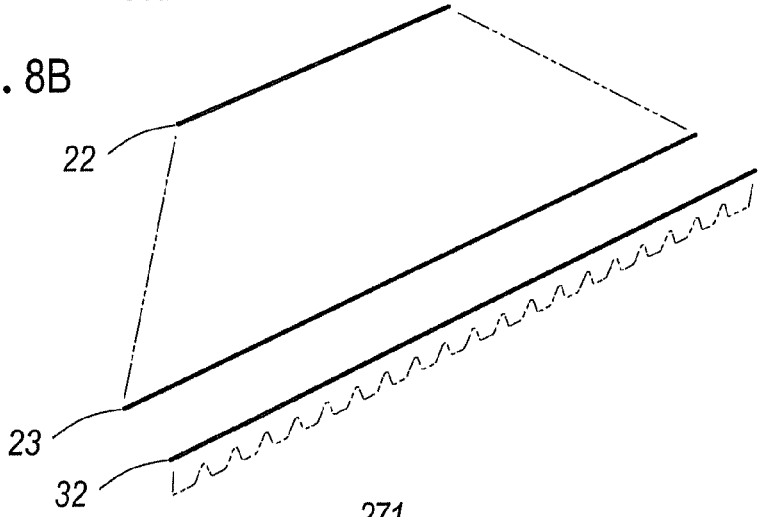
Figure 8C:
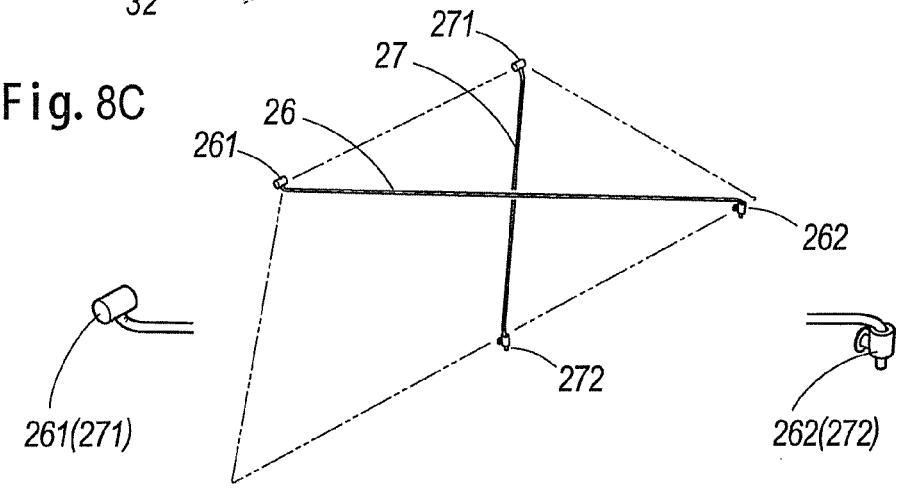

FIGS. 8A to 8C are perspective views of a protruded corner canvas and a front skirt, and show their attachment wire and connection wire. Among them, at left and right position in FIG. 8C, opposite end portions of the connection wire passed through the canvas main body are shown in partially enlarged states.

Figures 9A, 9B:
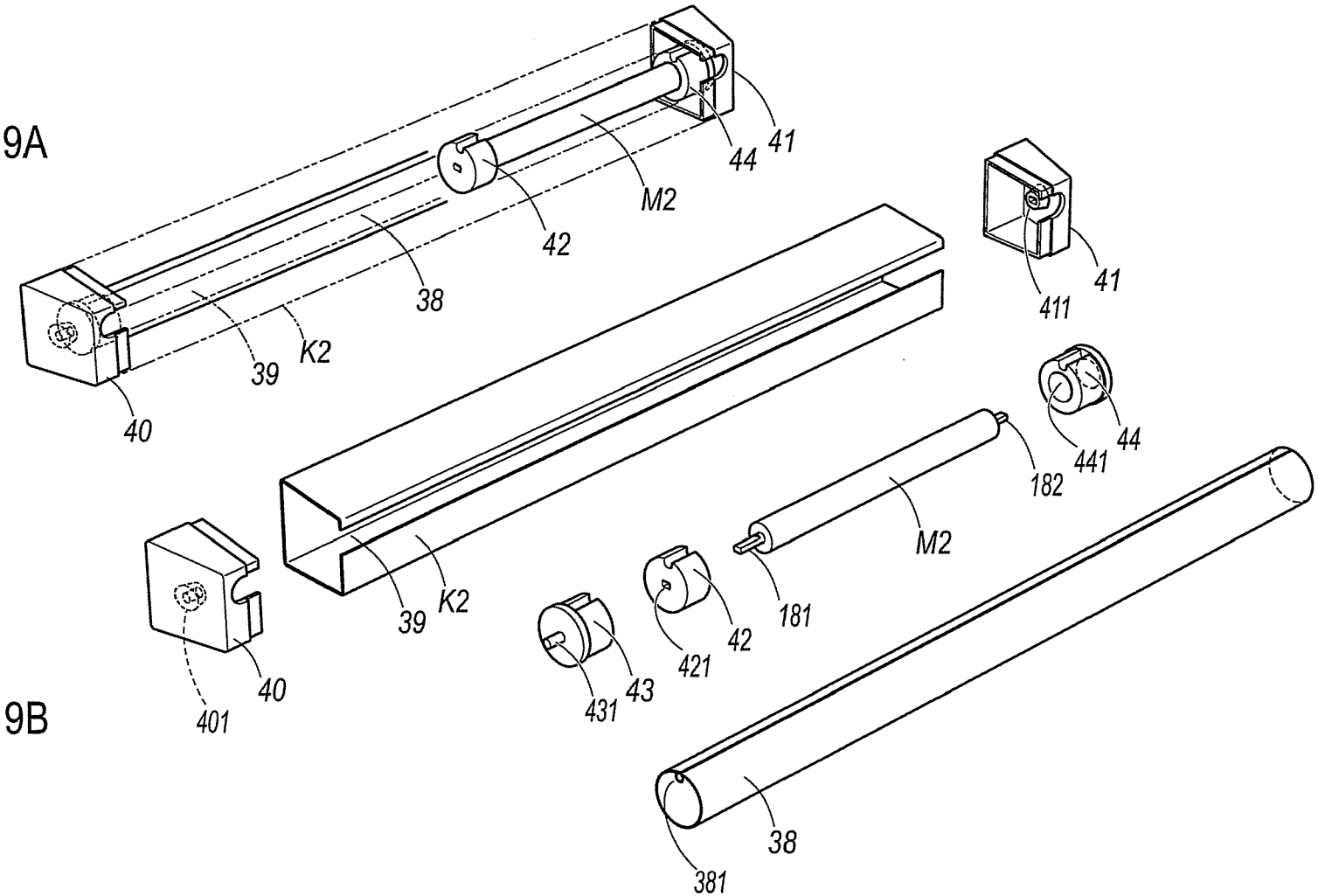
Figure 10A:
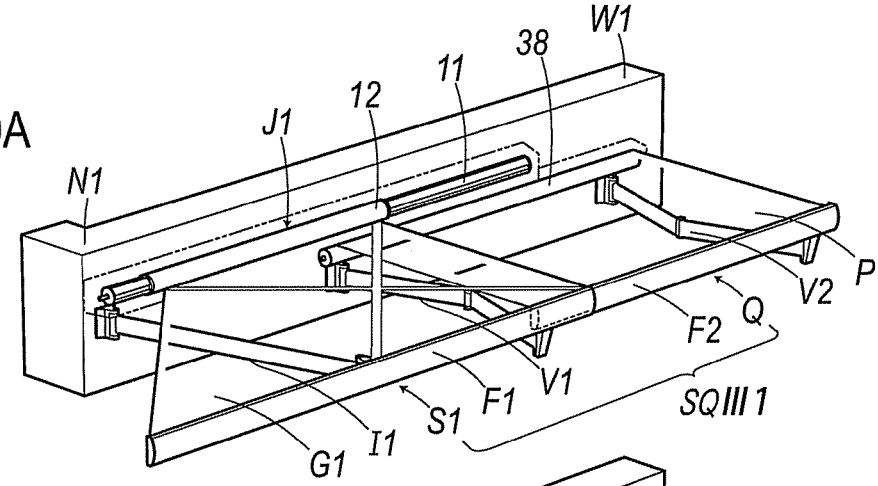
Figure 10B:
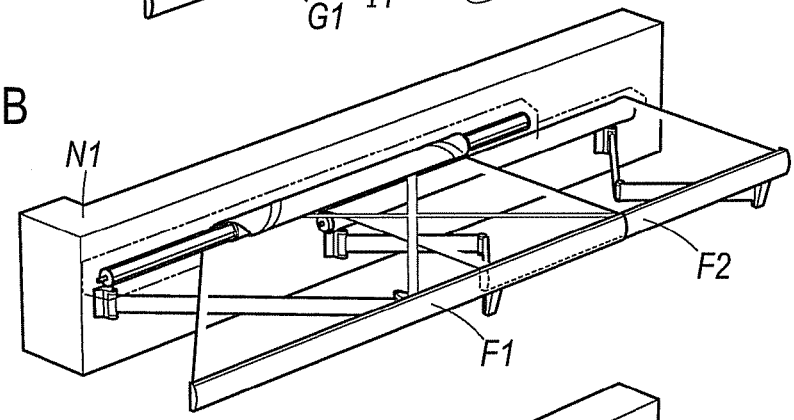
Figure 10C:
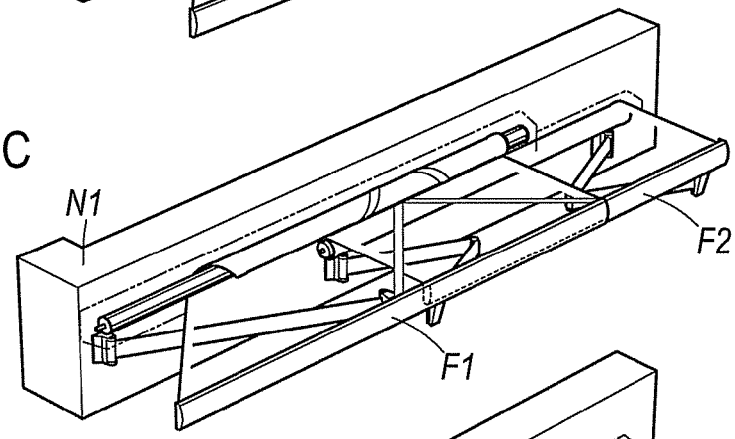
Figure 10D:
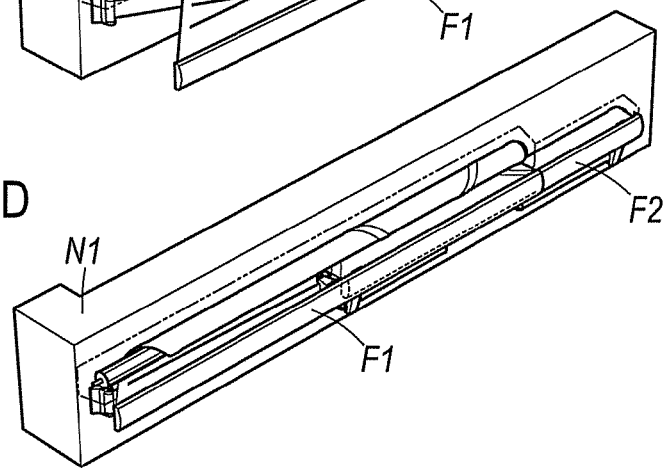
Figure 11A:
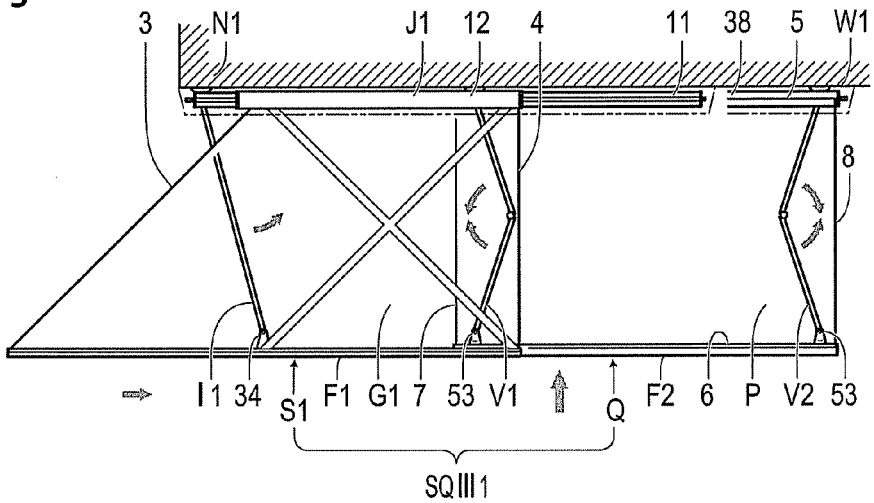
Figure 11B:
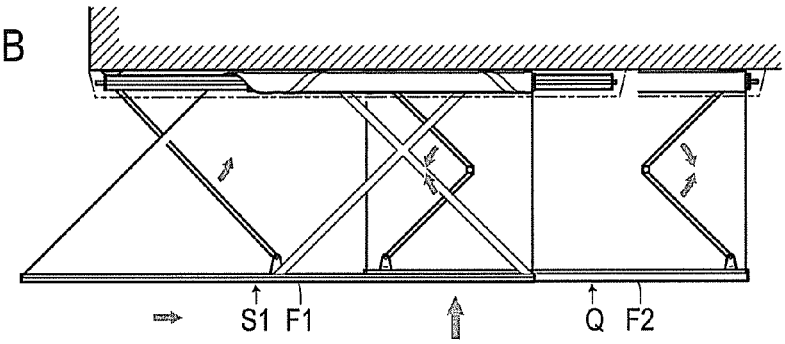
Figure 11C:
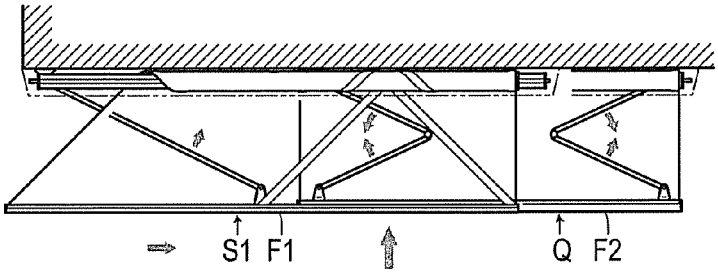
Figure 11D:
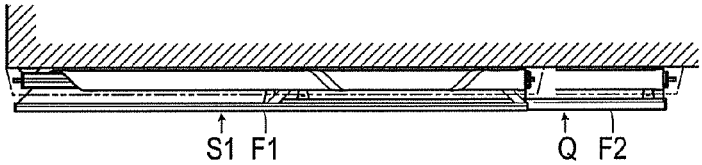

FIGS. 9A and 9B are perspective views showing a take-up device of a rectangular canvas incorporating an electric motor. Among them, FIG. 9A shows a state there the latter half portions of a casing and a take-up roller are seen through, and FIG. 9B shows constituent elements such as a casing, an electric motor, a take-up roller, and the like.

FIGS. 10A to 10D and 11A to 11D are perspective views and plan views, and the process reversal to that shown in these drawings are canvas extending process.

Figures 12A, 12B:
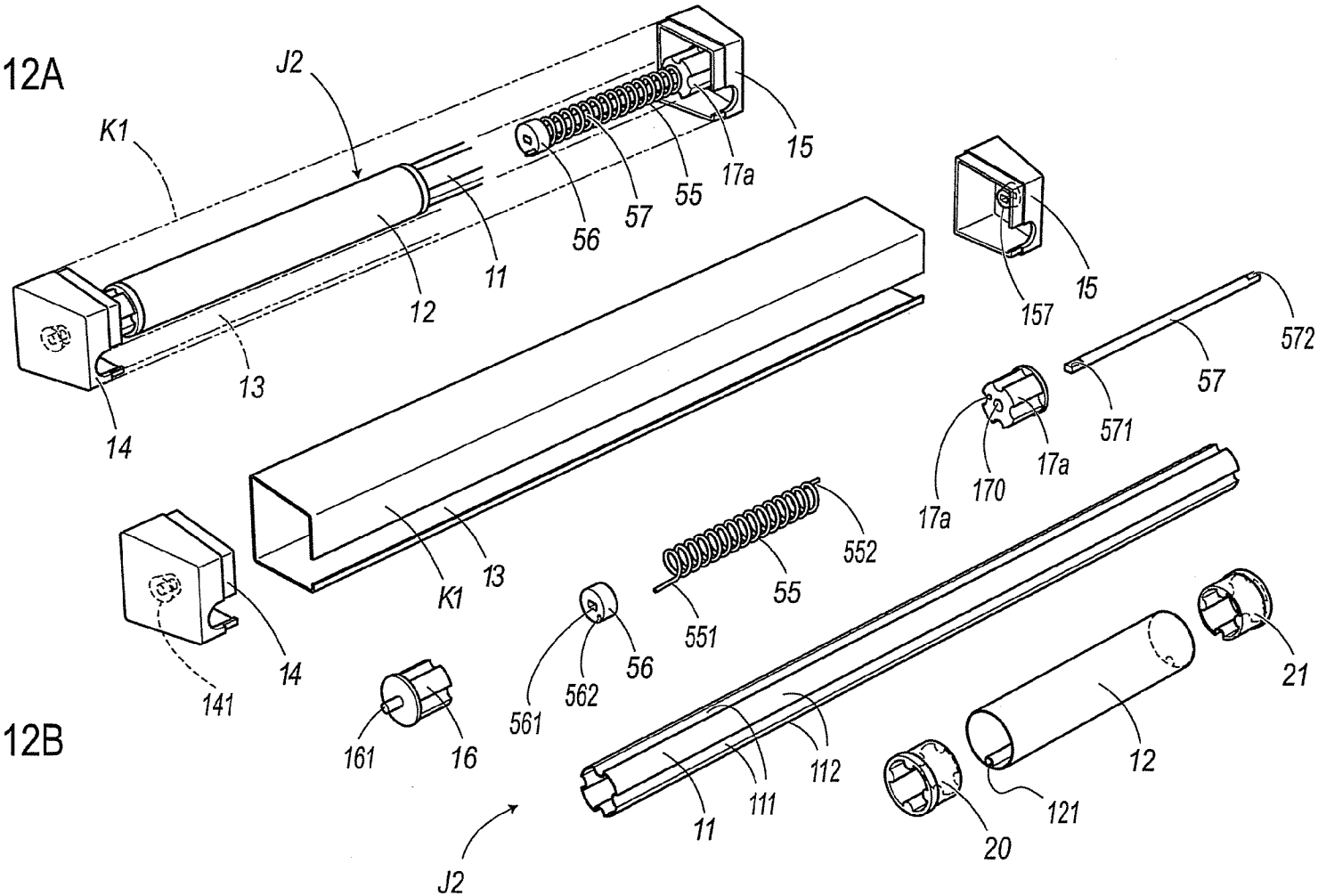

FIGS. 12A and 12B are perspective view showing a second embodiment of a take-up device of a protruded corner canvas incorporating a coil spring, and an exploded perspective view showing its constituent elements.

Figures 13A, 13B:
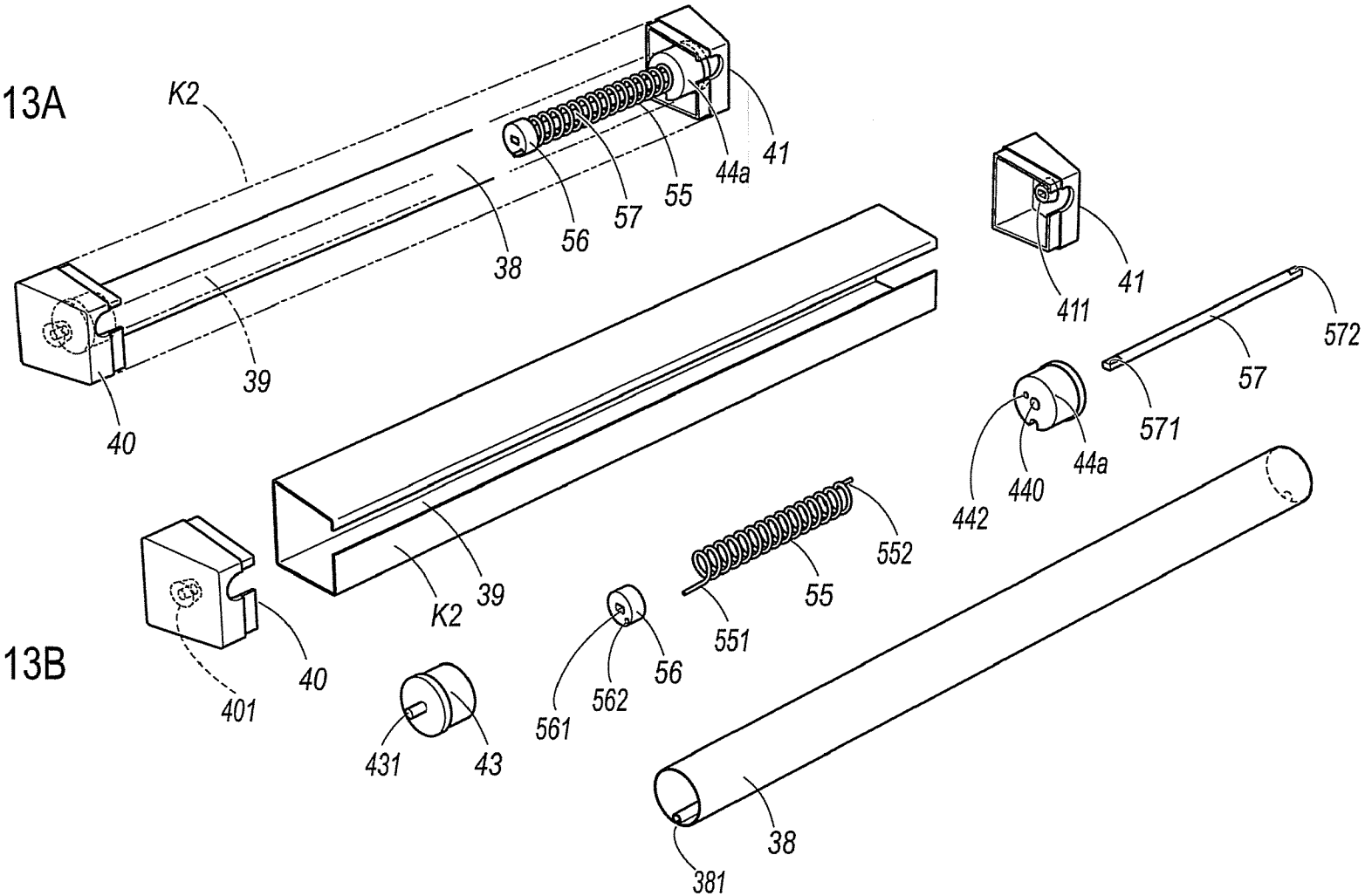

FIGS. 13A and 13B are perspective view showing a second embodiment of a take-up device of a rectangular canvas incorporating a coil spring, and an exploded perspective view showing its constituent elements.

Figure 14:
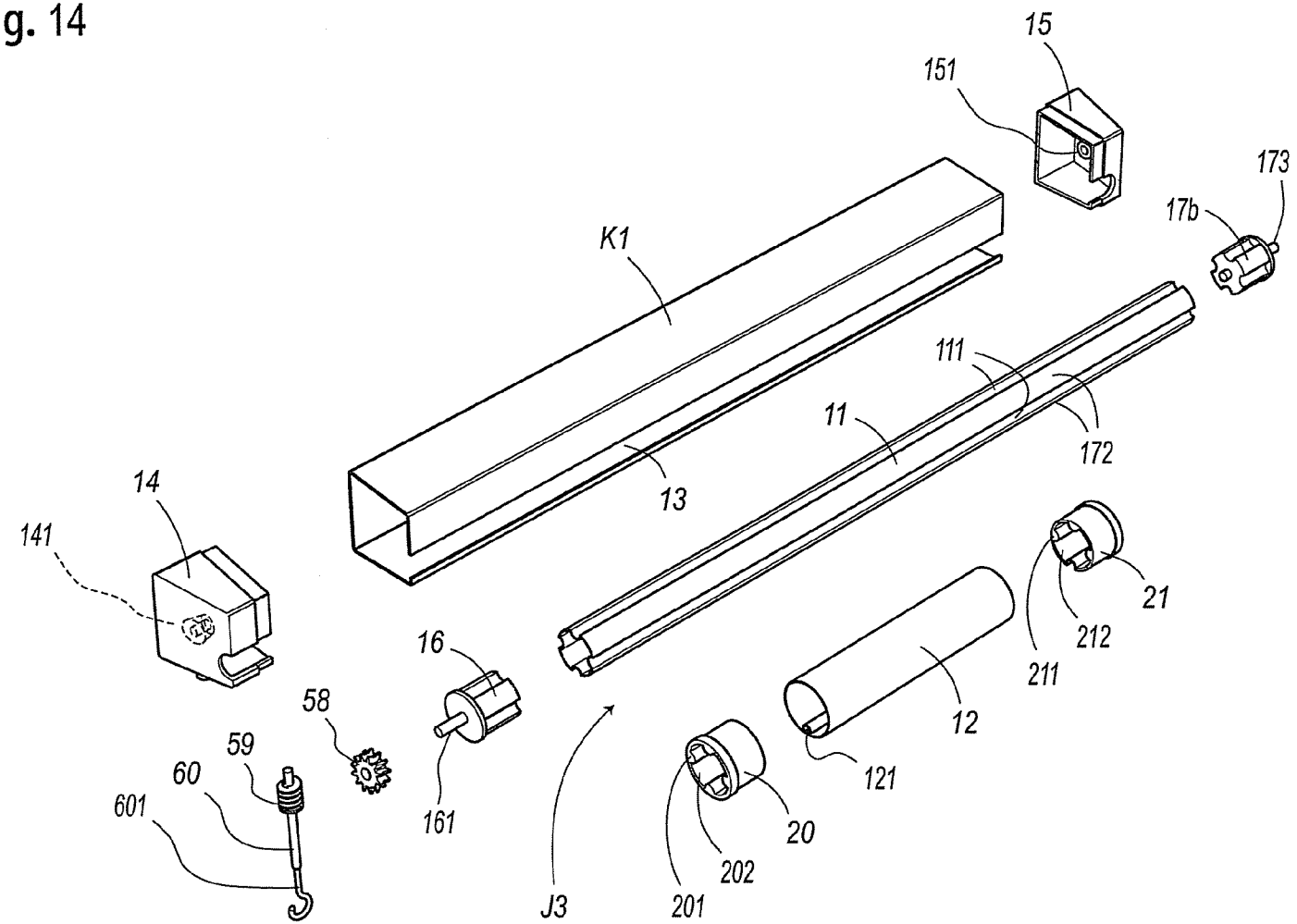

FIG. 14 is an exploded perspective view showing a third embodiment of a take-up device of a protruded corner canvas incorporating a manually driven device.

FIGS. 15A and 15B are perspective view of an embodiment in which the casing of the canvas take-up device is in an integral structure, and a see-through view thereof.

FIGS. 16A to 16C are see-through views showing the vicinities of the top end and the rear end portion of a casing. Among them, FIG. 16B shows a manually driven device, and FIG. 16C shows a gear meshing structure between an inner rotation shaft and a take-up roller.

FIGS. 17A and 17B are diagrams showing an interlocking structure between two composite devices located at the protruded corner portion to be faced to each other. Among them, FIG. 17A shows a meshing structure by means of an oblique tooth gear or a bevel gear, and FIG. 17B shows a manually interlocked device.

Figure 18A:
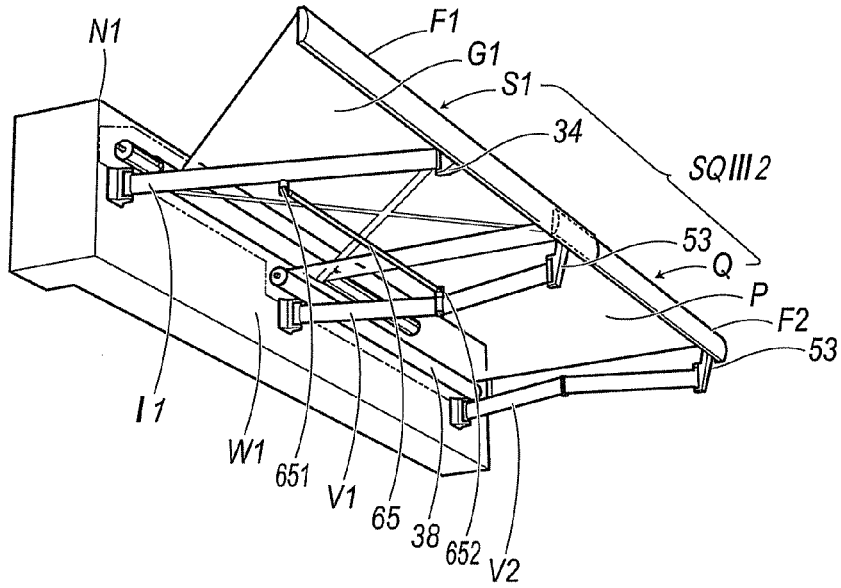
Figure 18B:
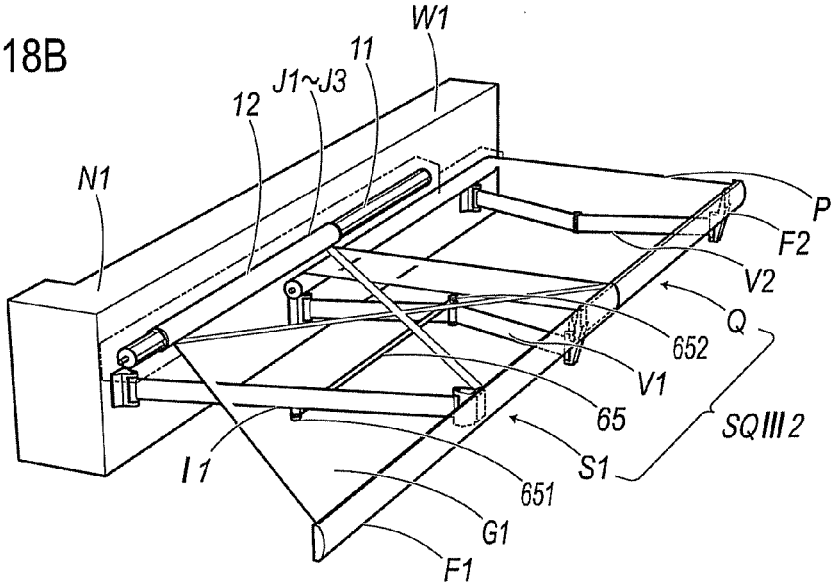
Figure 19A:
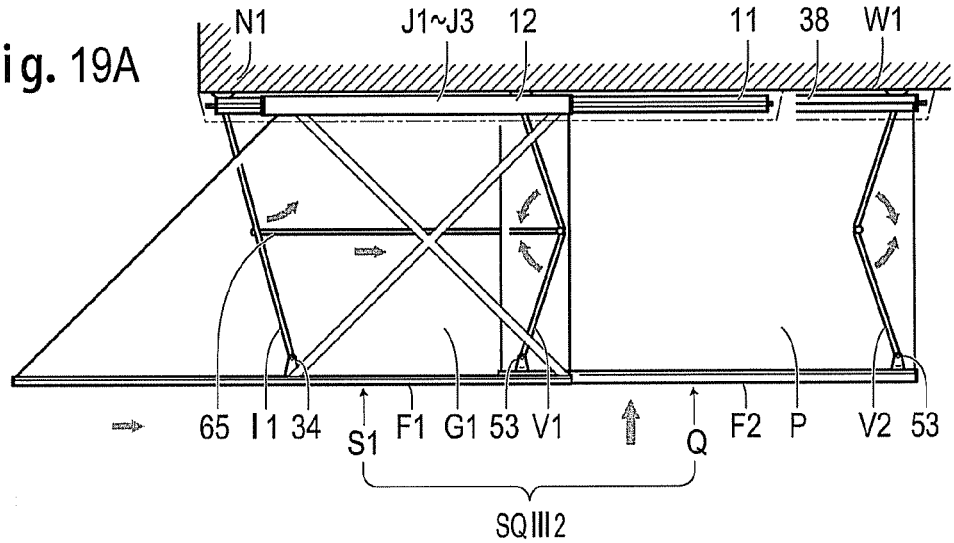
Figure 19B:
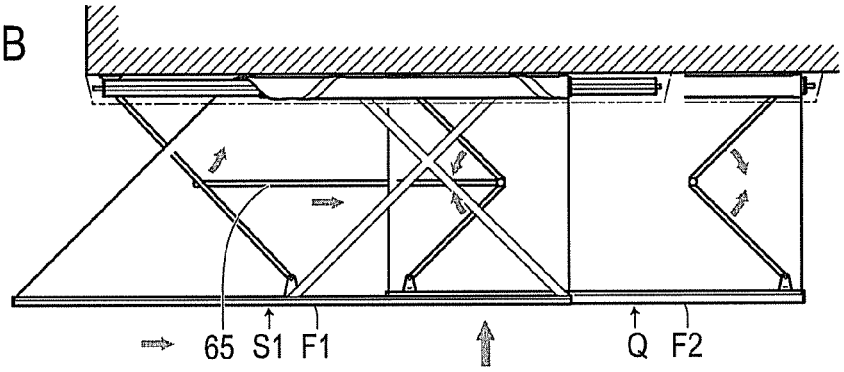
Figure 19C:
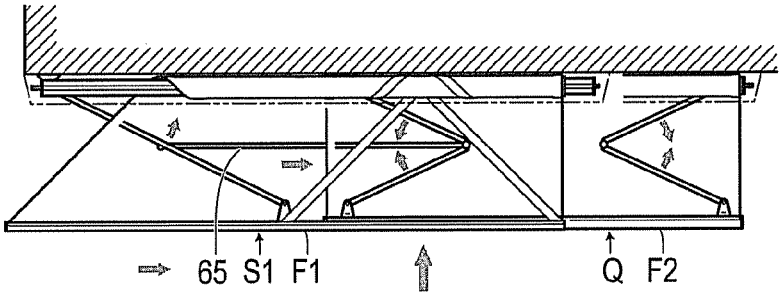
Figure 19D:
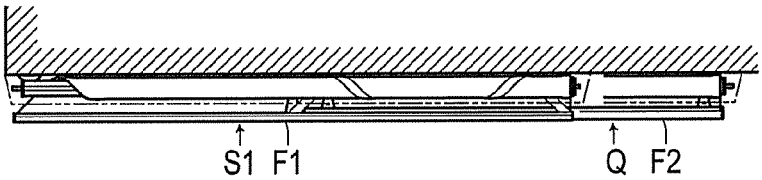

FIGS. 18A to 18B are perspective views showing a composite device SQIII2 of a second embodiment incorporating a connection rod. Among them, FIG. 18A shows a state where the composite device SQIII2 is seen from obliquely downside, and FIG. 18B shows a state where the composite device SQIII2 is seen from obliquely upside.

FIGS. 19A to 19D are plan views showing a canvas winding process of the composite device SQIII2, and a process reversal to this is a canvas extending process.

Figure 20:
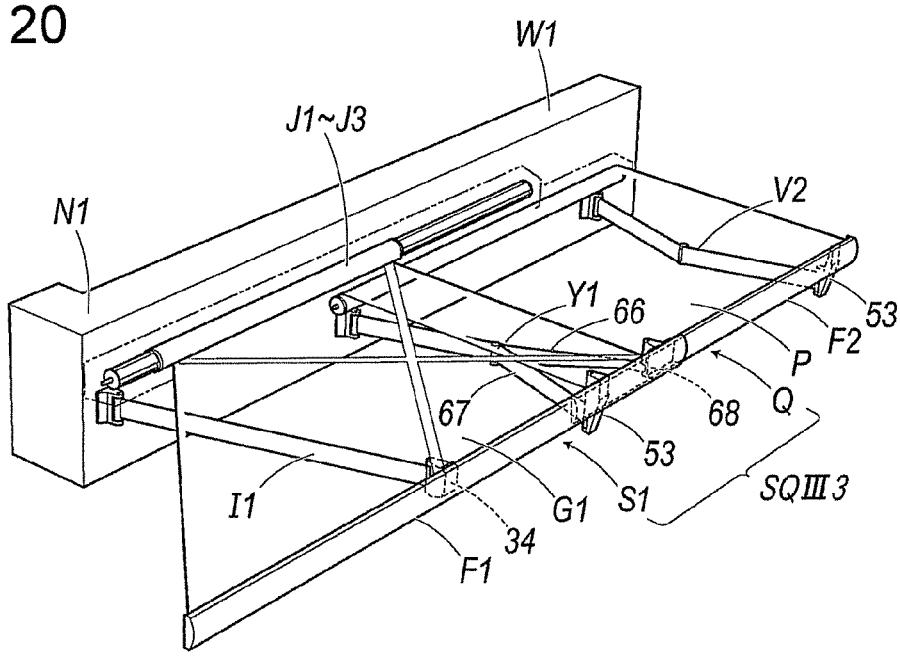

FIG. 20 is a perspective view showing a composite device SQIII3 of a third embodiment, including a Y-like arm in the shape of an upside-down letter y in the vicinity of the midpoint of the device.

Figure 21A:
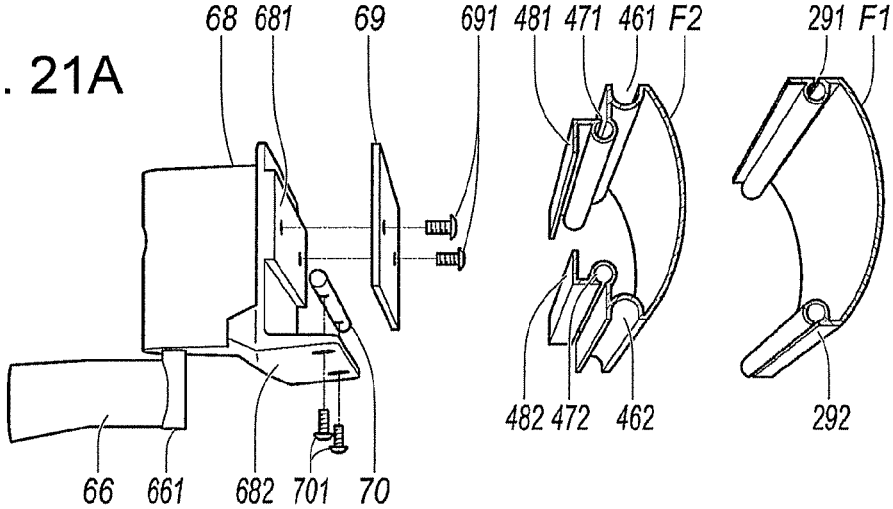
Figure 21B:
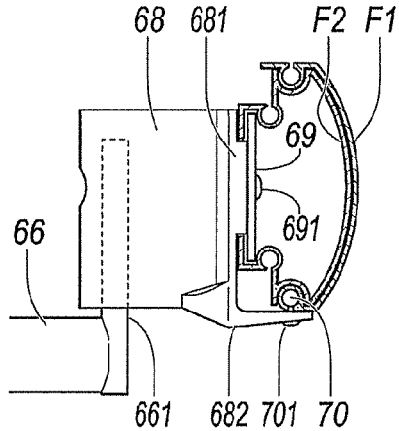
Figure 22A:
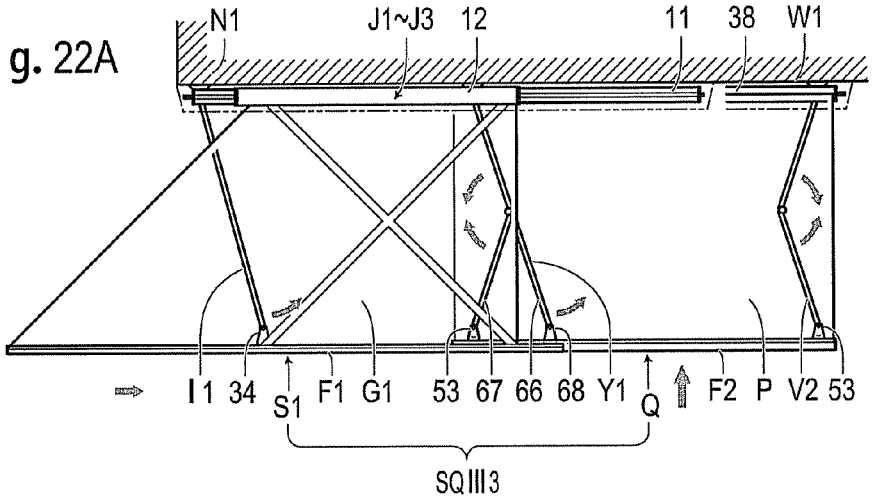
Figure 22B:
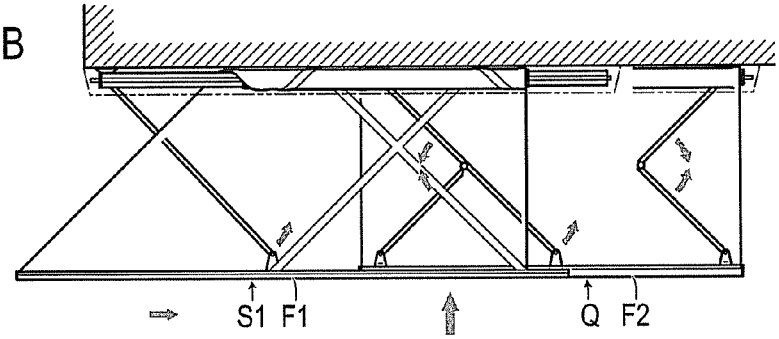
Figure 22C:
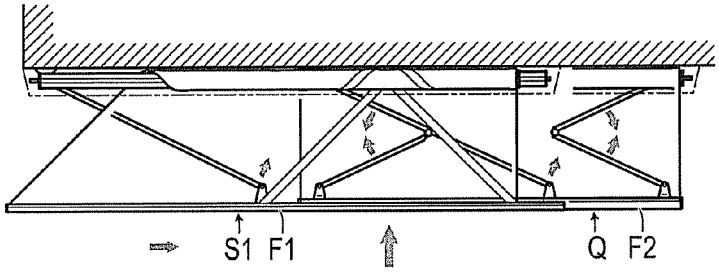
Figure 22D:
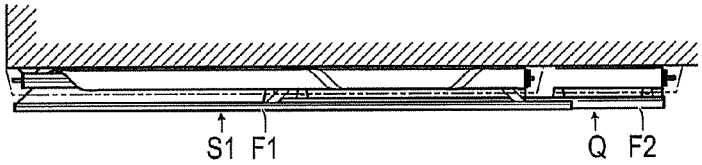

FIGS. 21A and 21B are perspective views showing a structure of attaching a front end portion of a main link to a front bar. Among them, FIG. 21A shows an exploded state thereof, and FIG. 21B shows a longitudinal cross section of an assembled state thereof, respectively.

FIGS. 22A to 22D are plan views showing a canvas winding process of the composite device SQIII3, and a process reversal to this is a canvas extending process.

FIGS. 23A to 23C and 24A to 24F are plan views showing composite devices SQIII4 to SQIII9 of fourth to ninth embodiments, where a front bar of a rectangular canvas and a front bar of a protruded corner canvas fitted and inserted thereto are supported by either three swinging arms of an I-like arm, a V-like arm, a Y-like arm, and L-like arm.

Figure 25A:
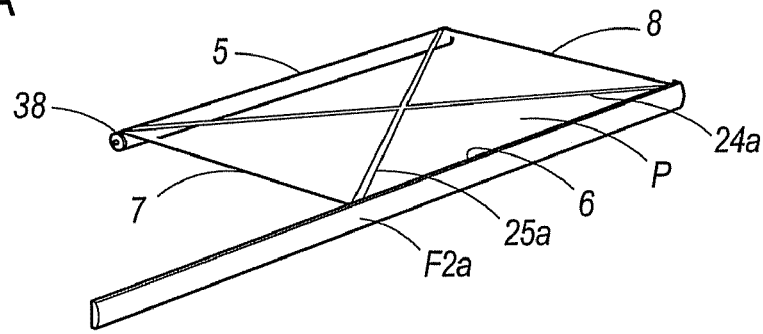
Figure 25B:
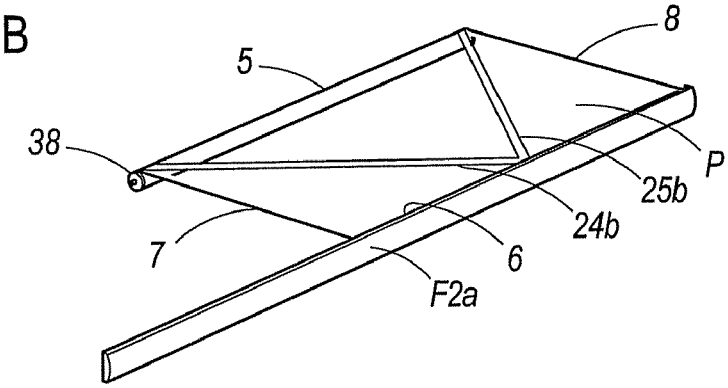

FIGS. 25A and 25B are perspective views showing a case where a bottom side of a rectangular canvas is attached to a front bar extended toward a top end portion of a device. Among them, FIG. 25A shows a case where a connection wire is passed through an X-like cross passage formed in the main body of the rectangular canvas, and FIG. 25B shows a case where a connection wire is passed through a pouched passage formed into the shape of the letter V.

Figure 26A:
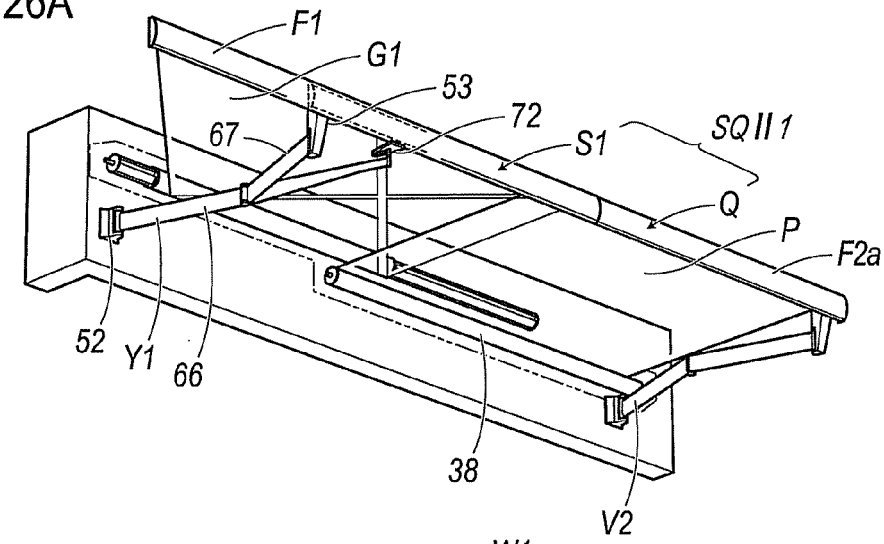
Figure 26B:
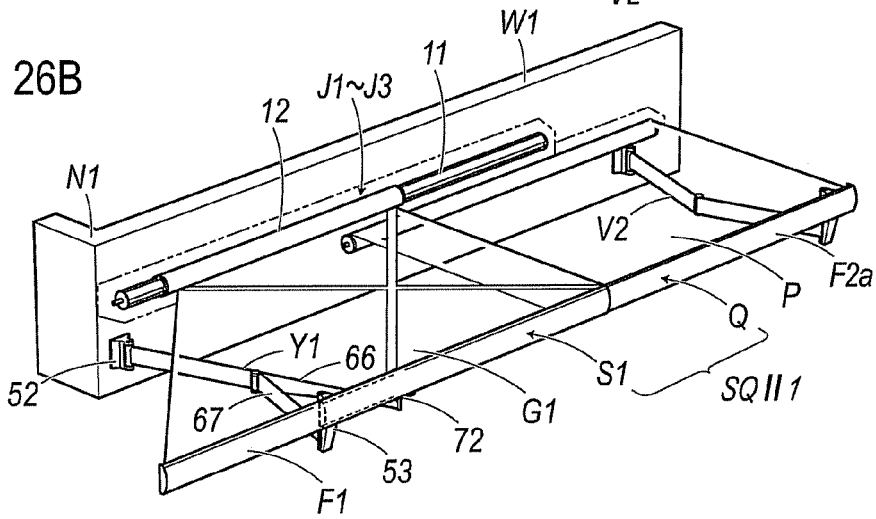

FIGS. 26A and 26B are perspective views showing a composite device SQII1 of tenth embodiment supported by two swinging arms. Among them, FIG. 26A shows a state where the composite device SQII1 is looked up from obliquely downside, and FIG. 26B shows a state where the composite device SQII1 is looked down from obliquely upside.

Figure 27A:
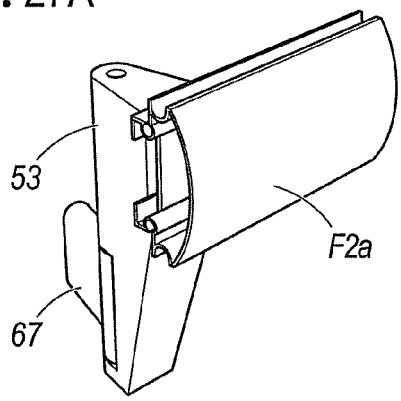
Figure 27B:
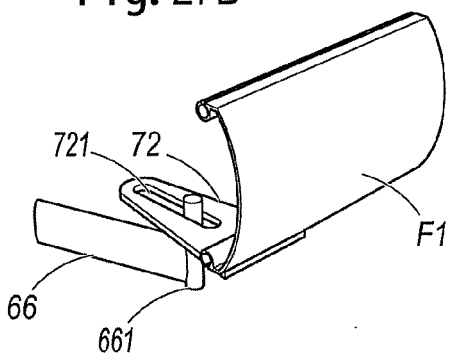
Figure 28A:
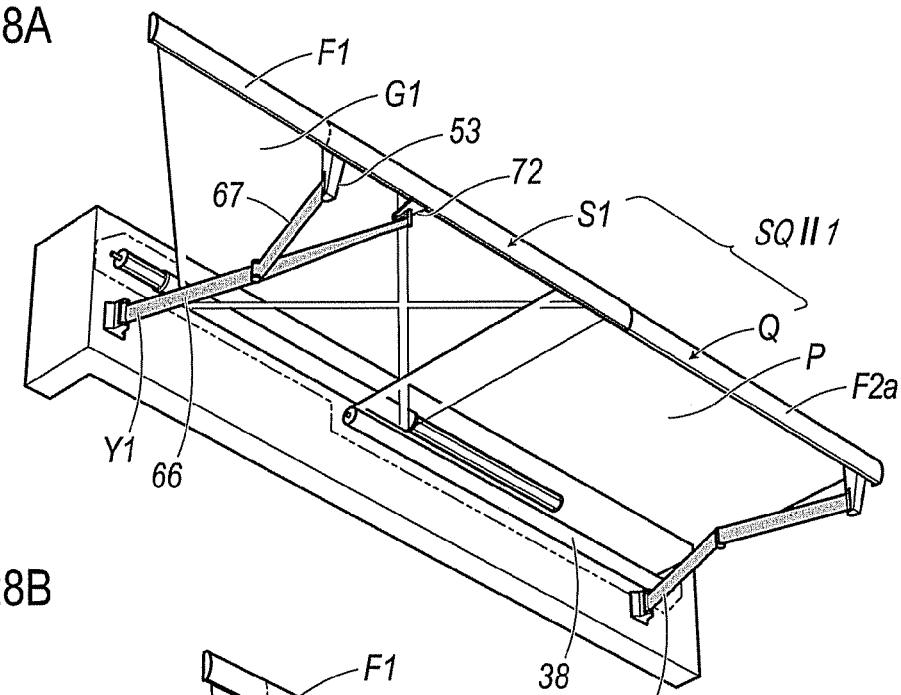
Figure 28B:
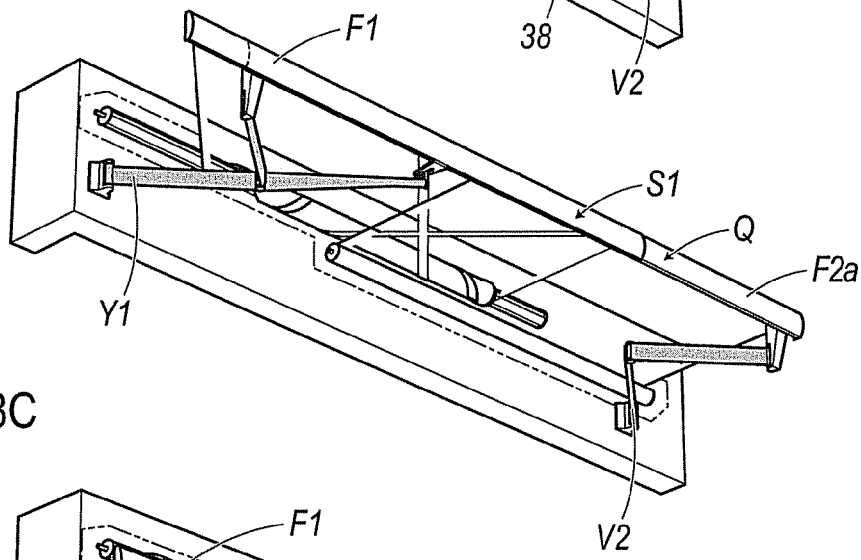
Figure 28C:
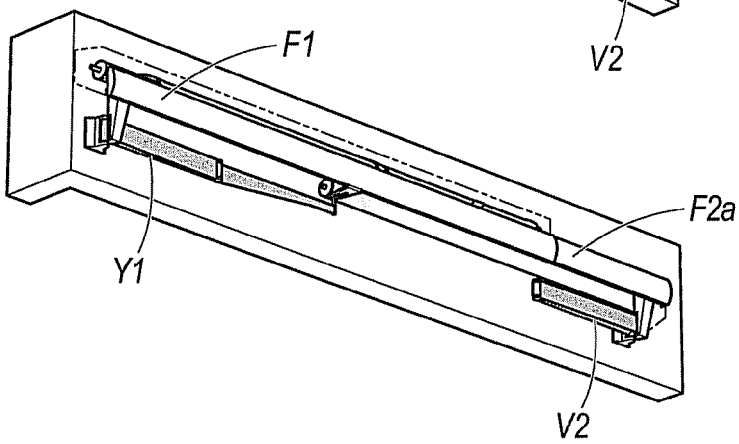
Figure 29A:
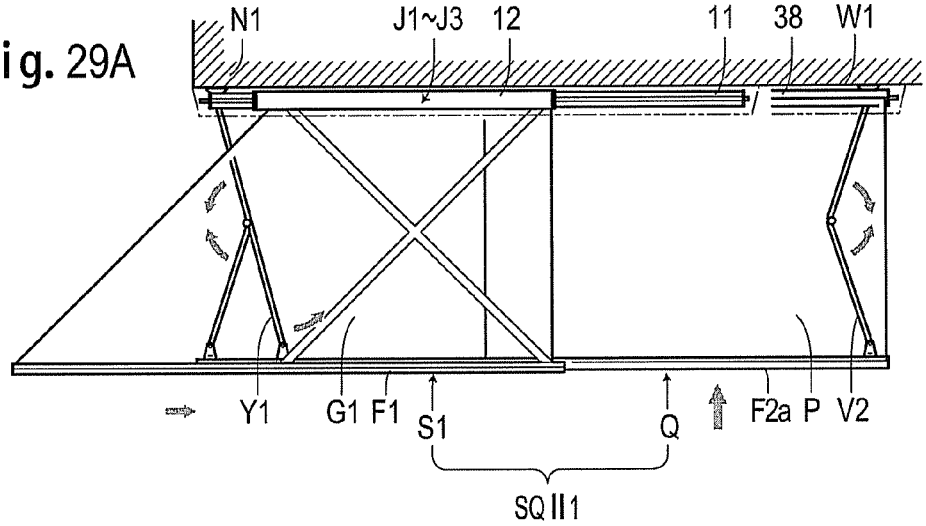
Figure 29B:
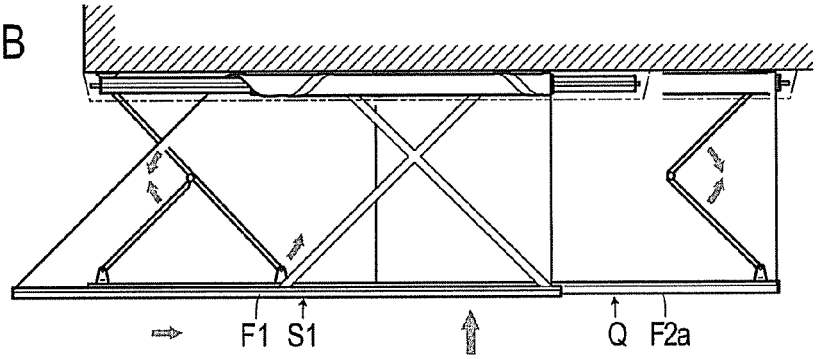
Figure 29C:
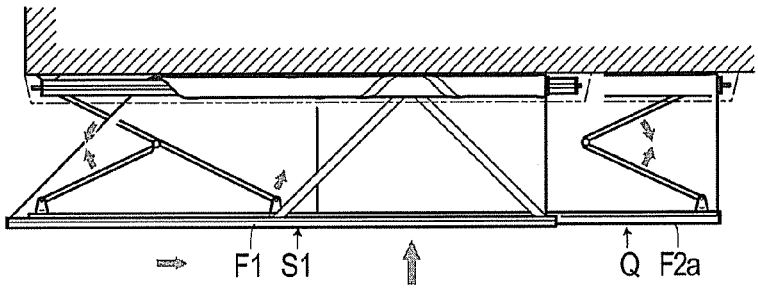
Figure 29D:
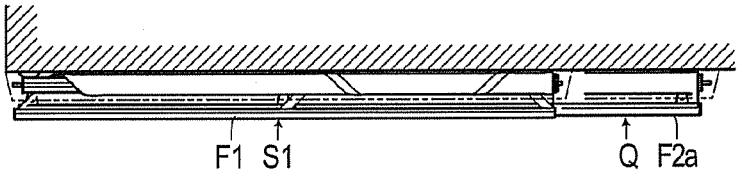

FIGS. 27A and 27B are perspective views showing the front end portions of a main link and a sub-link of a Y-like arm, respectively, and a state where they are attached to the front bar.

FIGS. 28A to 28C and 29A to 29D are perspective views and plant views showing a canvas winding process of the composite device SQII1, and a process reversal to this is a canvas extending process.

Figure 30A:
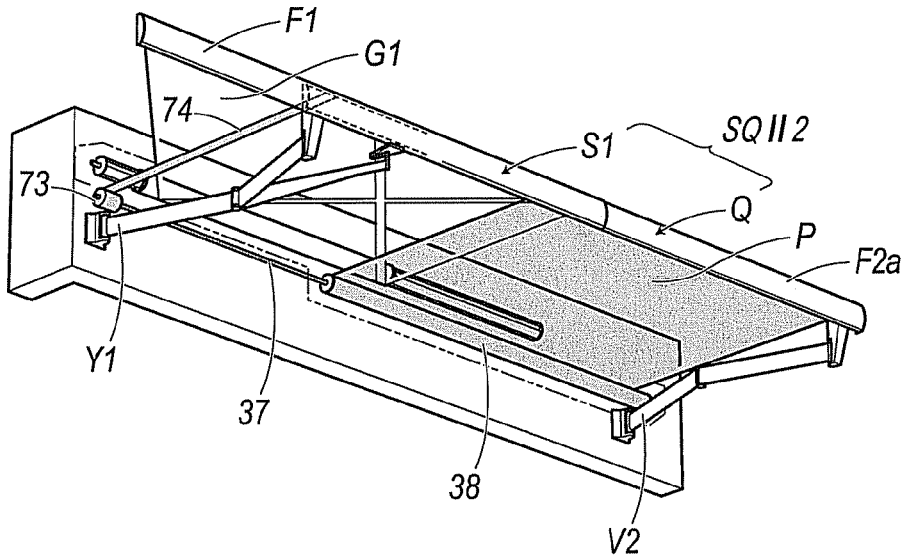
Figure 30B:
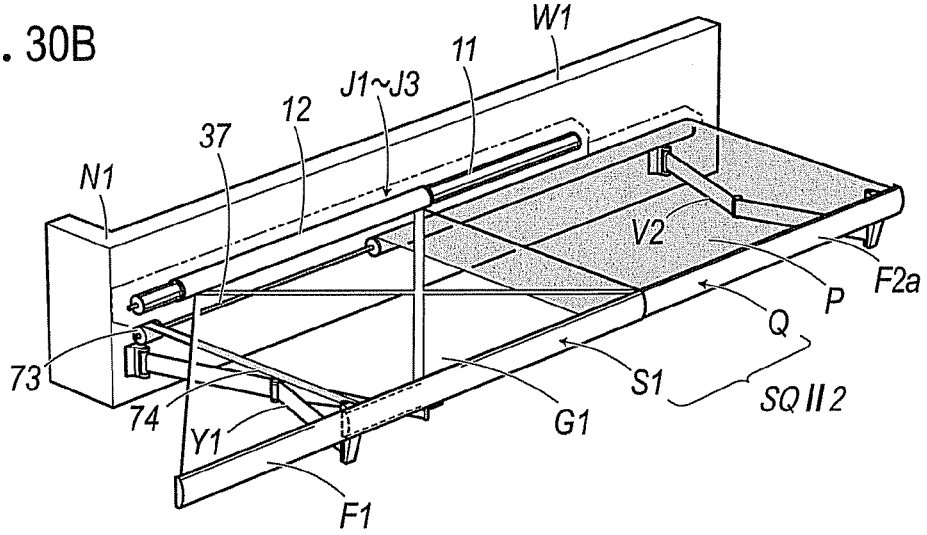

FIGS. 30A and 30B are perspective views showing a composite device SQII2 of eleventh embodiment additionally including a belt winding device at the front end portion of the device. Among them, FIG. 30A shows a state where the composite device SQII2 is looked up from obliquely downside, and FIG. 30B shows a state where the composite device SQII2 is looked down from obliquely upside.

FIGS. 31A to 31D are plan views showing composite devices SQIV1 to SQIV4 of twelfth to fifteenth embodiments in which a front bar is supported by four swing arms.

FIGS. 32A to 32E are plan views showing a composite device SQIV5 of sixteenth embodiment in which a front bar of a protruded corner canvas is supported by a pair of two swing arms that operate in two phases, and its canvas winding process, and a process reversal to this is a canvas extending process.

Figure 33A:
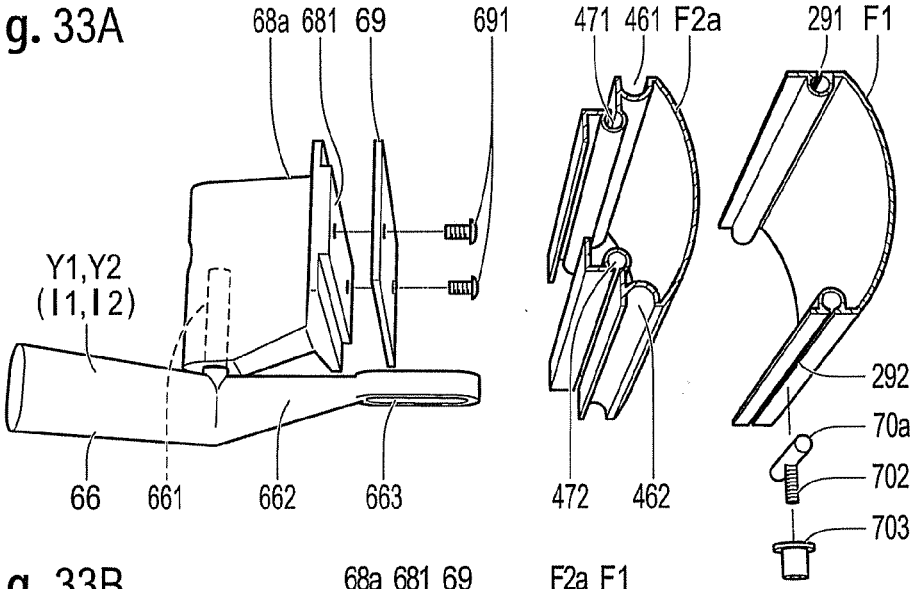
Figure 33B:
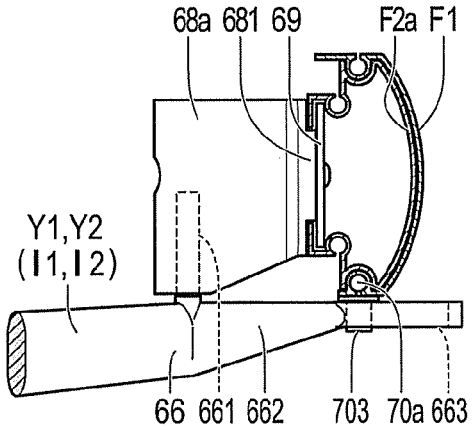

FIGS. 33A and 33B are diagrams showing a mechanism for increasing a movement stroke of a protruded corner canvas toward a top end portion of a front bar. Among them, FIG. 33A is an exploded perspective view showing the constituent elements in the vicinity of the front end portion of the main link of the Y-like arm, and FIG. 33B is a side view showing its assembled state.

Figure 34A:
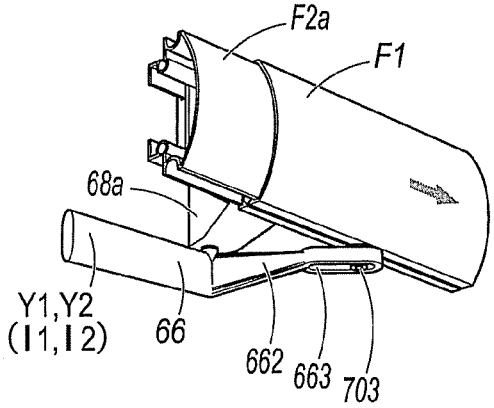
Figure 34B:
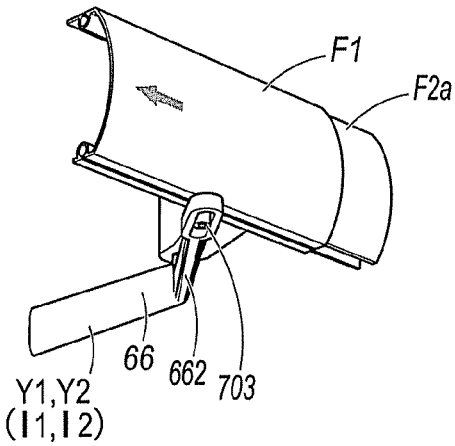

FIGS. 34A and 34B are perspective views showing a state the stroke increasing mechanism looked up from downside before and after its operation, respectively.

FIGS. 35A to 35D are plan views showing a first embodiment of a composite device SUIII of a second type comprised of a protruded corner awning device and a recessed corner awning device, and a process reversal to this is a canvas extending process.

Figure 36:
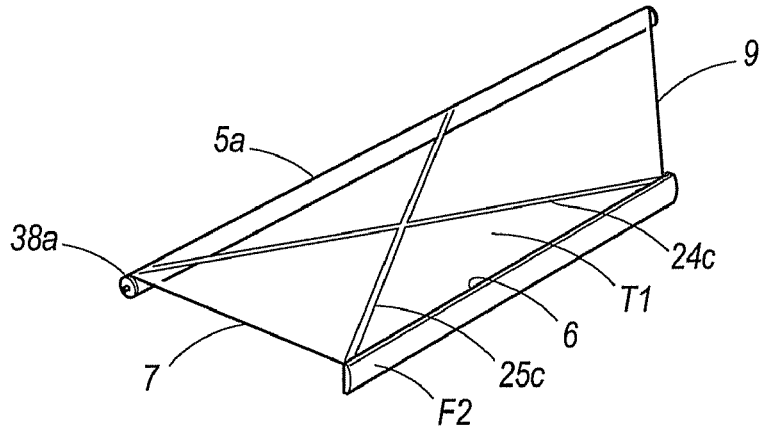

FIG. 36 is a perspective view showing a recessed corner canvas in a right-angled reversal trapezoidal shape, where its canvas top side is attached to a take-up roller and its canvas bottom side is attached to a front bar, respectively.

Figure 37A:
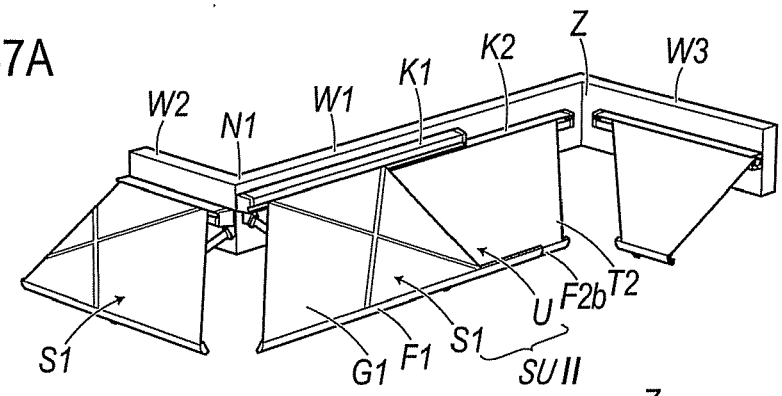
Figure 37B:
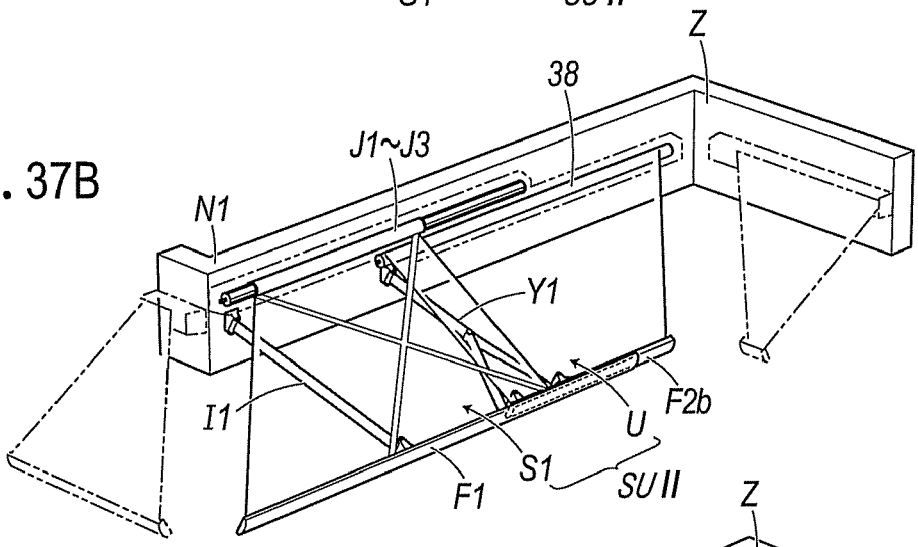
Figure 37C:
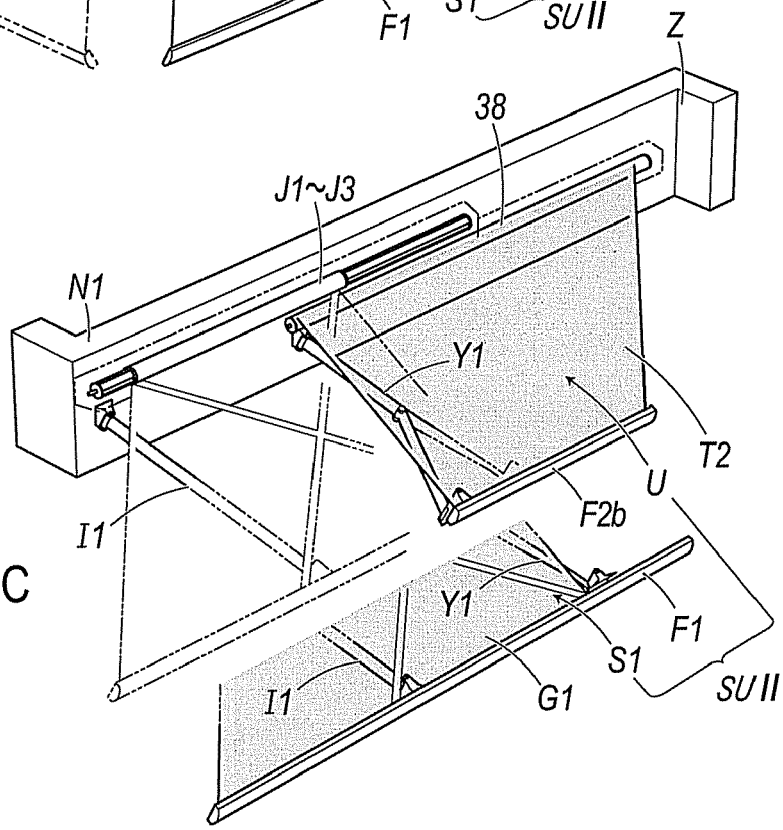
Figure 38A:
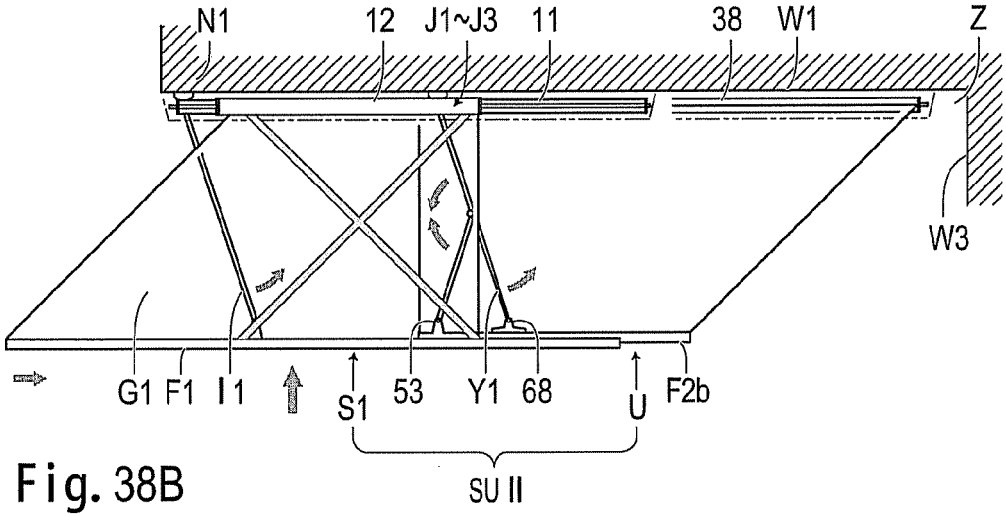
Figure 38B:
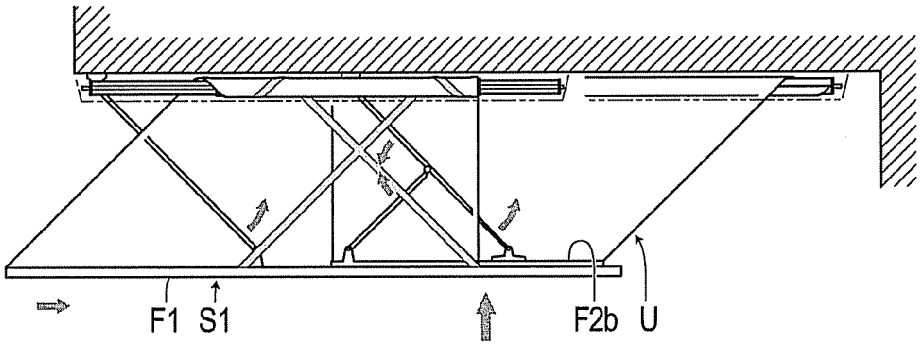
Figure 38C:
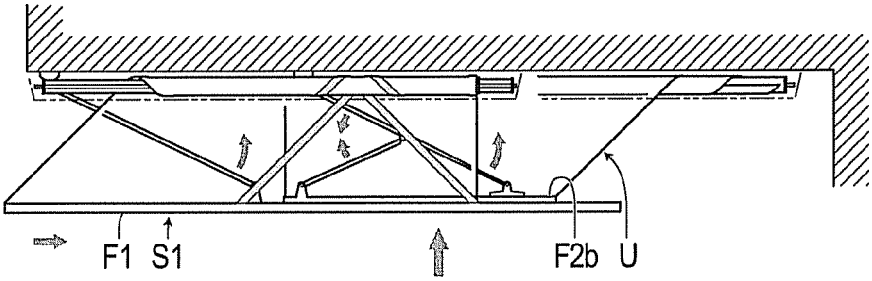
Figure 38D:
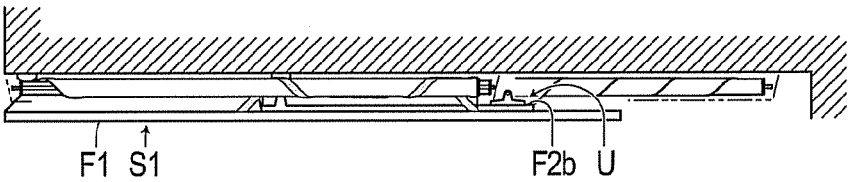

FIGS. 37A to 37C are perspective views of a composite device SUII of second embodiment on the assumption that the distance between the protruded corner portion and the recessed corner portion is relatively short. Among them, FIG. 37C shows a state where a front position of the protruded corner awning device is separated to be transported forward.

FIGS. 38A to 38D are plan views showing a canvas winding process of the composite device SUII, and a process reversal to this is a canvas extending process.

Figures 39A, 39B:
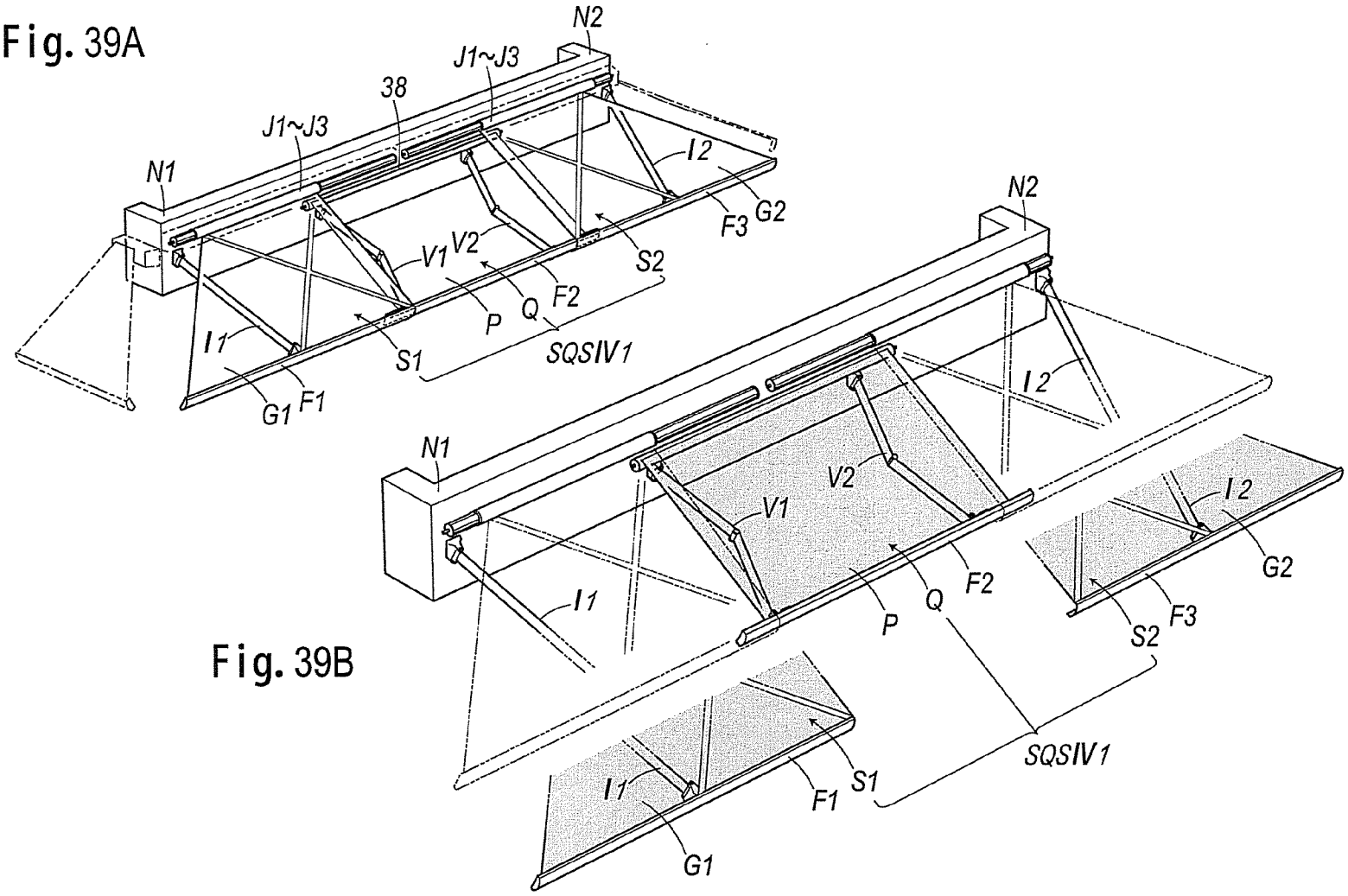

FIGS. 39A and 39B are perspective views showing a first embodiment of a composite device SQSIV1 of a third type. Among them, FIG. 39B shows a state where the front positions of the protruded corner awning devices located at front and rear positions of the intermediate rectangular awning device are separated to be transported forward.

FIGS. 40A to 40D are plan views showing a canvas winding process of the composite device SQSIV1, and a process reversal to this is a canvas extending process.

FIGS. 41A to 41D are plan views showing a composite device SQSIV2 of second embodiment and its canvas winding process, and a process reversal to this is a canvas extending process.

Figures 42A, 42B, 42C:
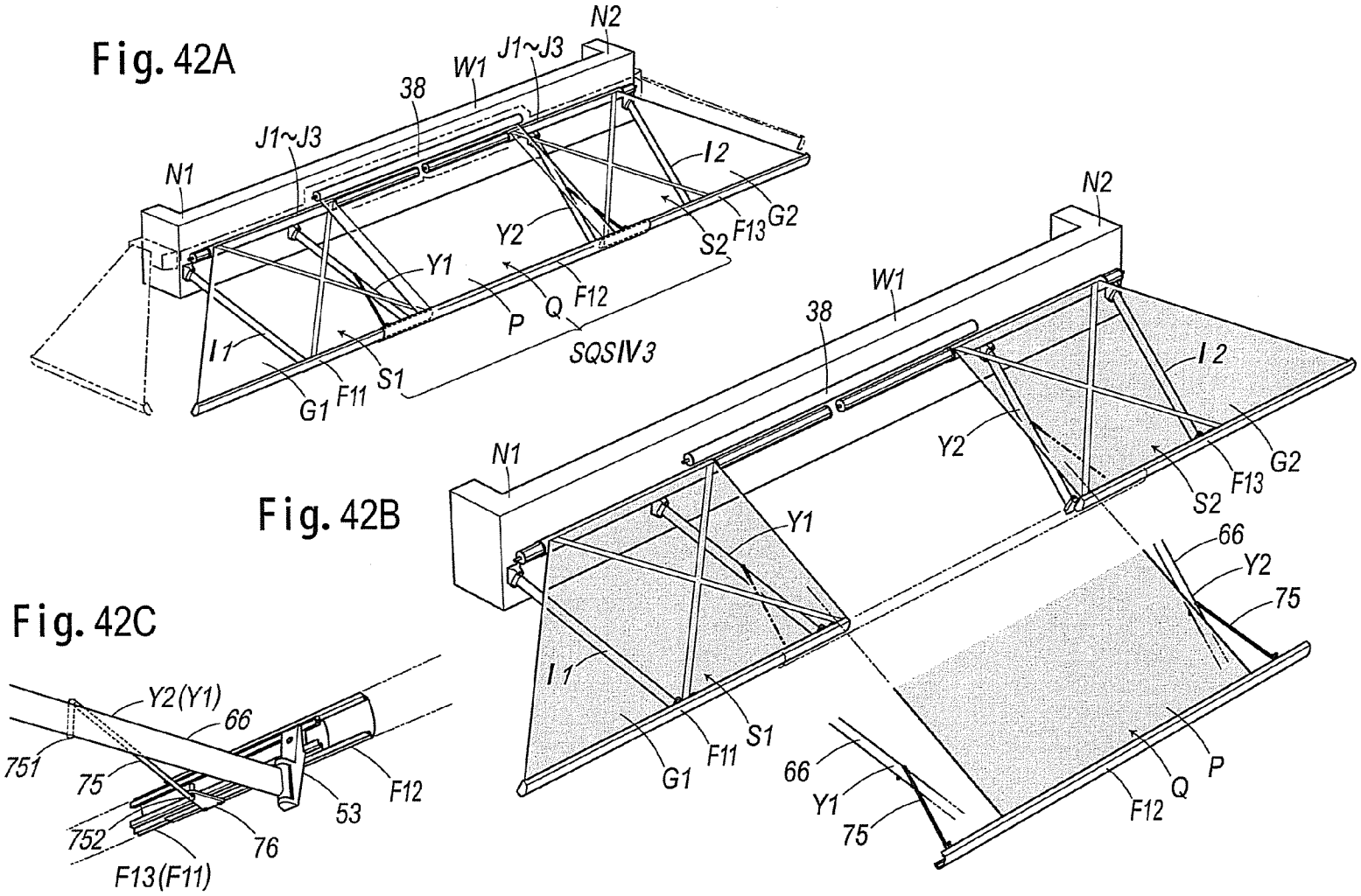
Figure 43A:
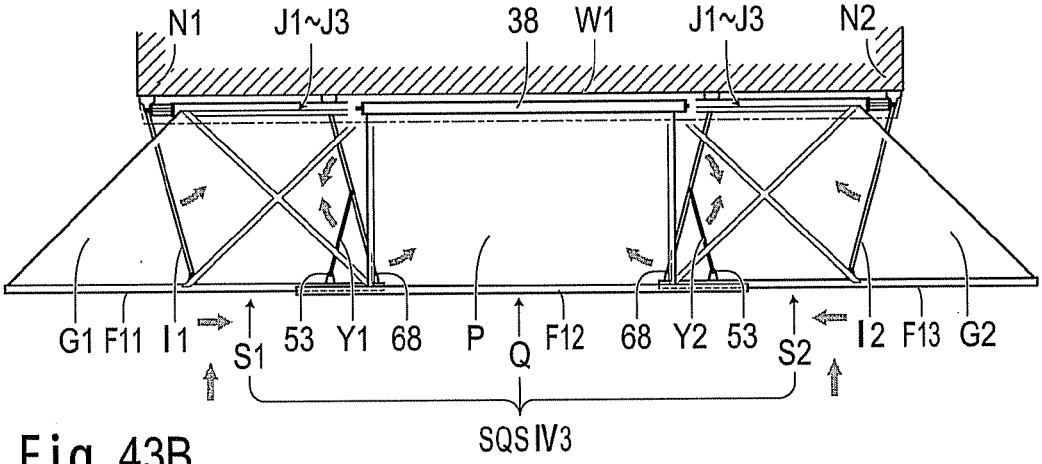
Figure 43B:
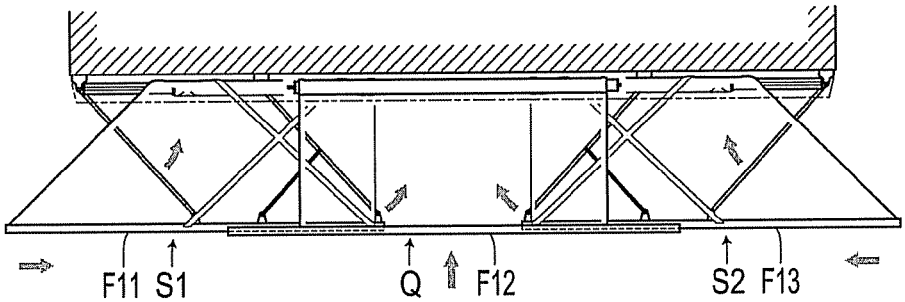
Figure 43C:
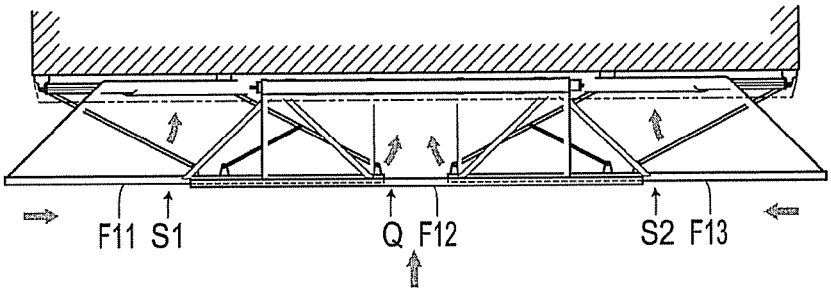
Figure 43D:
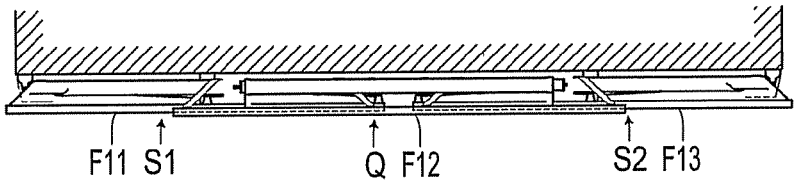
Figure 44A:
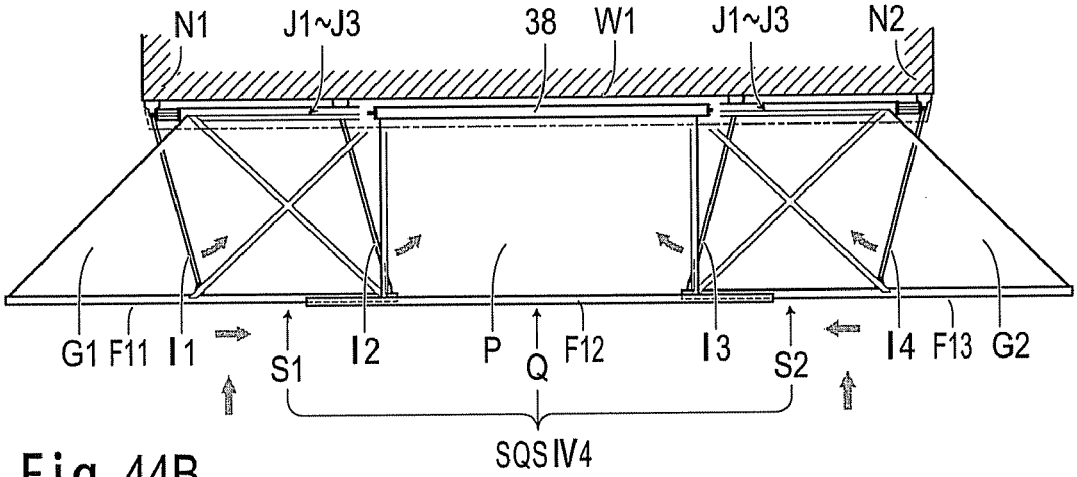
Figure 44B:
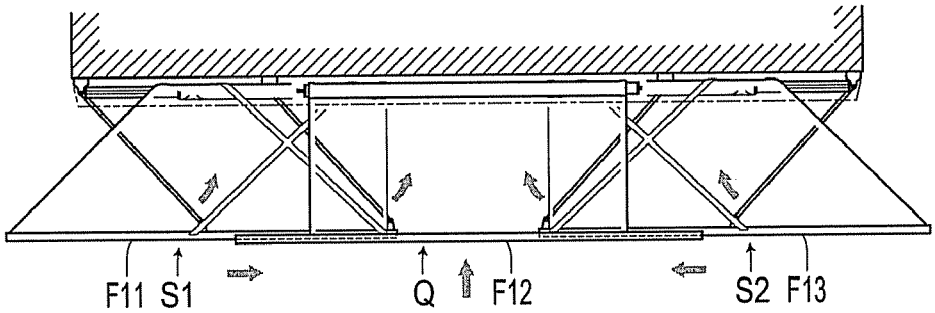
Figure 44C:
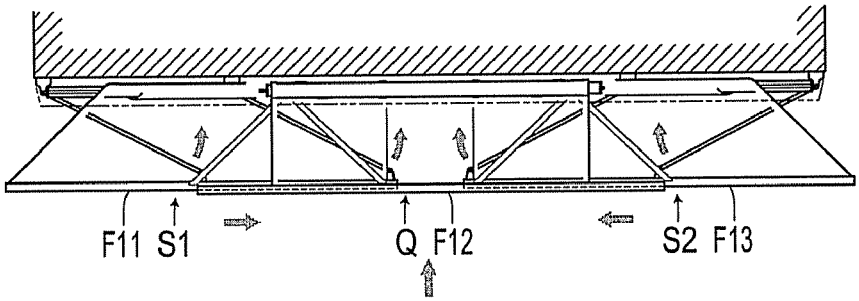
Figure 44D:
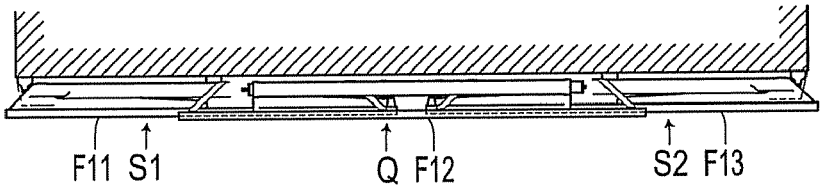

FIGS. 42A to 42C are perspective views showing a composite device SQSIV3 of third embodiment in which a rectangular awning device is incorporated into the upper position between two protruded awning devices distanced at symmetrically fore and rear positions from each other. Among them, FIG. 42B shows a state where a front position of the rectangular awning device is separated to be transported forward, and FIG. 42C shows the front end portions of the Y-like arms assembled to their respective front bars seen from backside.

FIGS. 43A to 43D are plan views showing a canvas winding process of a composite device SQSIV3, and a process reversal to this is a canvas extending process.

FIGS. 44A to 44D are plan views showing composite device SQSIV4 of fourth embodiment in which two protruded awning devices located symmetrically at fore and rear positions include their respective two parallel I-like arms incorporated therein, and a canvas take-up process thereof, and a process reversal to this is a canvas extending process.

FIGS. 45A to 45E are plan views of a composite device SQSVI of fifth embodiment, in which two L-like arms that operate in two-phase are symmetrically incorporated into protruded corner awning devices located at fore and rear positions, whereas two bi-foldable V-like arms are symmetrically incorporated into an intermediate rectangular awning device, so that six swing arms in total are included in the composite devise SQSVI.

Figure 46A:
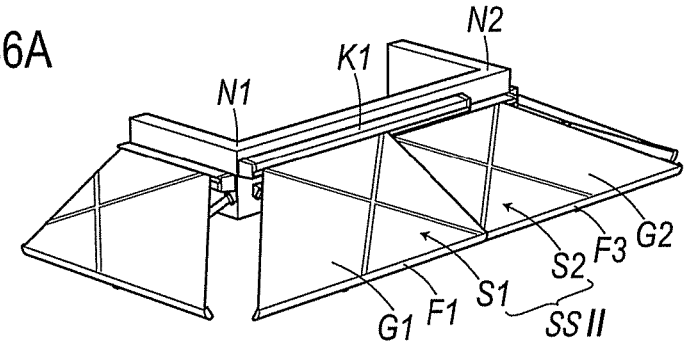
Figure 46B:
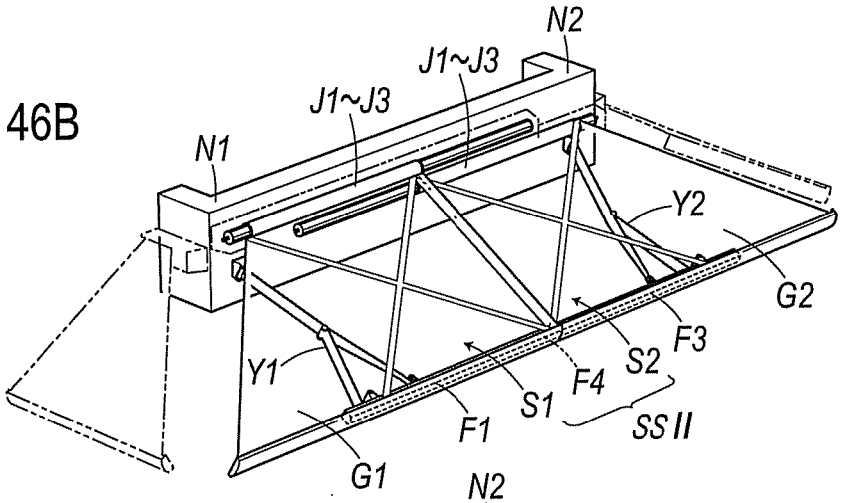
Figure 46C:
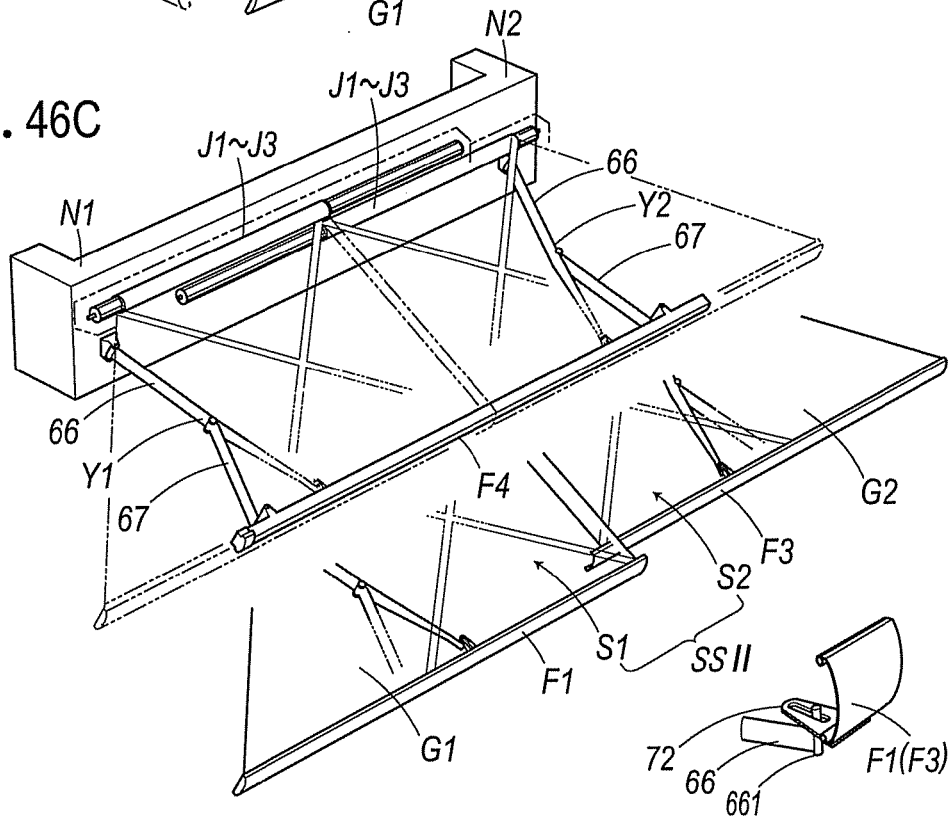
Figure 47A:
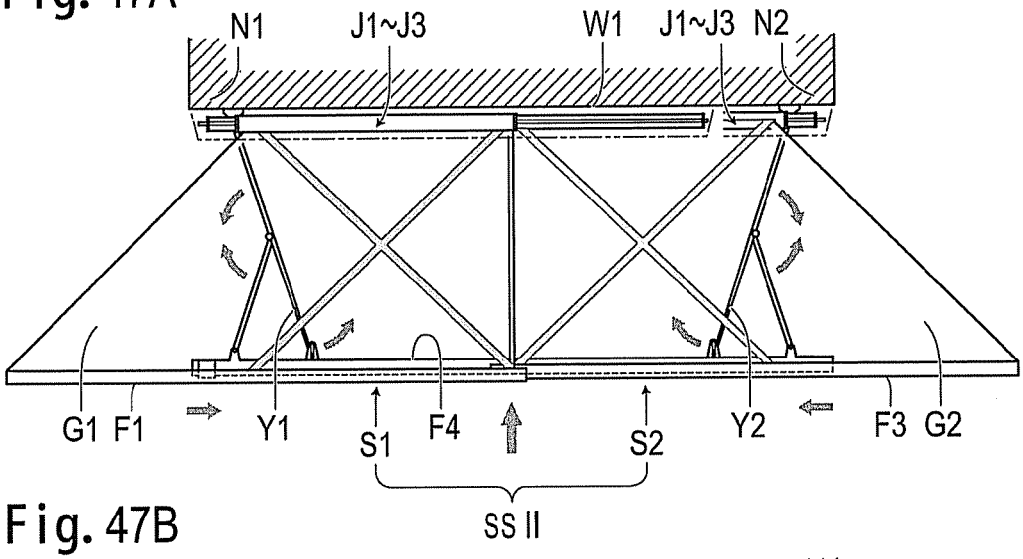
Figure 47B:
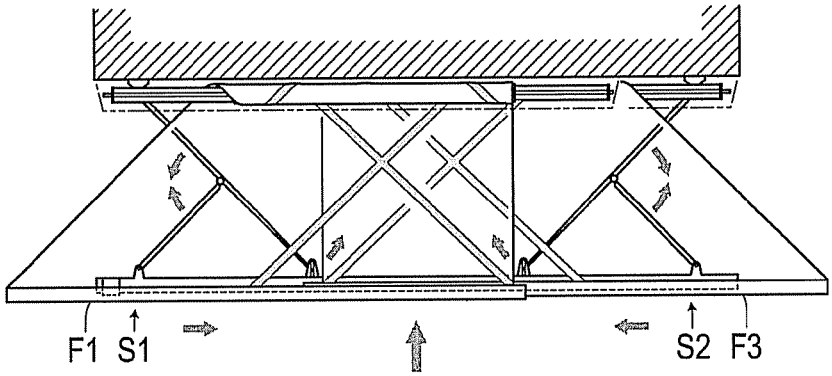
Figure 47C:
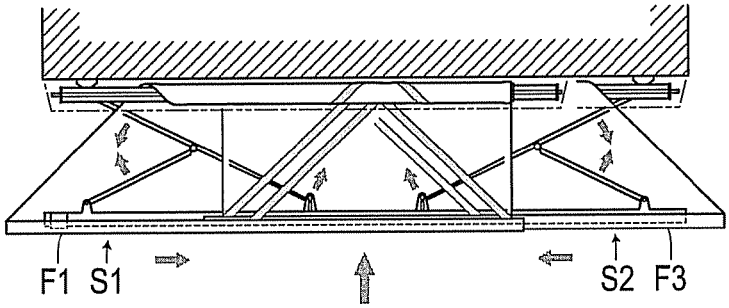
Figure 47D:
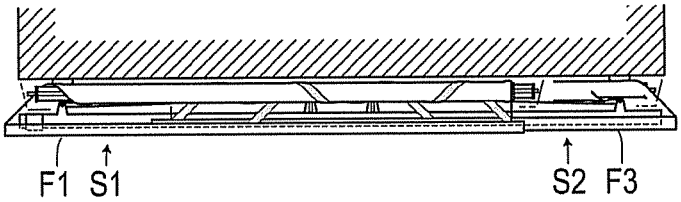

FIGS. 46A to 46C are perspective views of a first embodiment of a composite device SSII of fourth type in which two protruded corner awning devices are located symmetrically at fore and rear positions while being shifted upward and downward each other. Among them, FIG. 46C shows a state where the former half portions of the protruded corner awning devices located at fore and rear positions are separated by being transported forward to be shifted from each other. At the right lower side thereof, an engaged state of a front end portion of a main link of a Y-like arm is shown.

FIGS. 47A to 47D are plan views showing a canvas winding process of a composite device SSII, and a process reversal to this is a canvas extending process.

FIGS. 48A to 48E are plan views showing a composite device SSIV of second embodiment in which a pair of two L-like arms foldable in two phases is incorporated into a protruded corner awning device and its canvas winding process, and a process reversal to this is a canvas extending process.

Figures 49A, 49B, 49C:
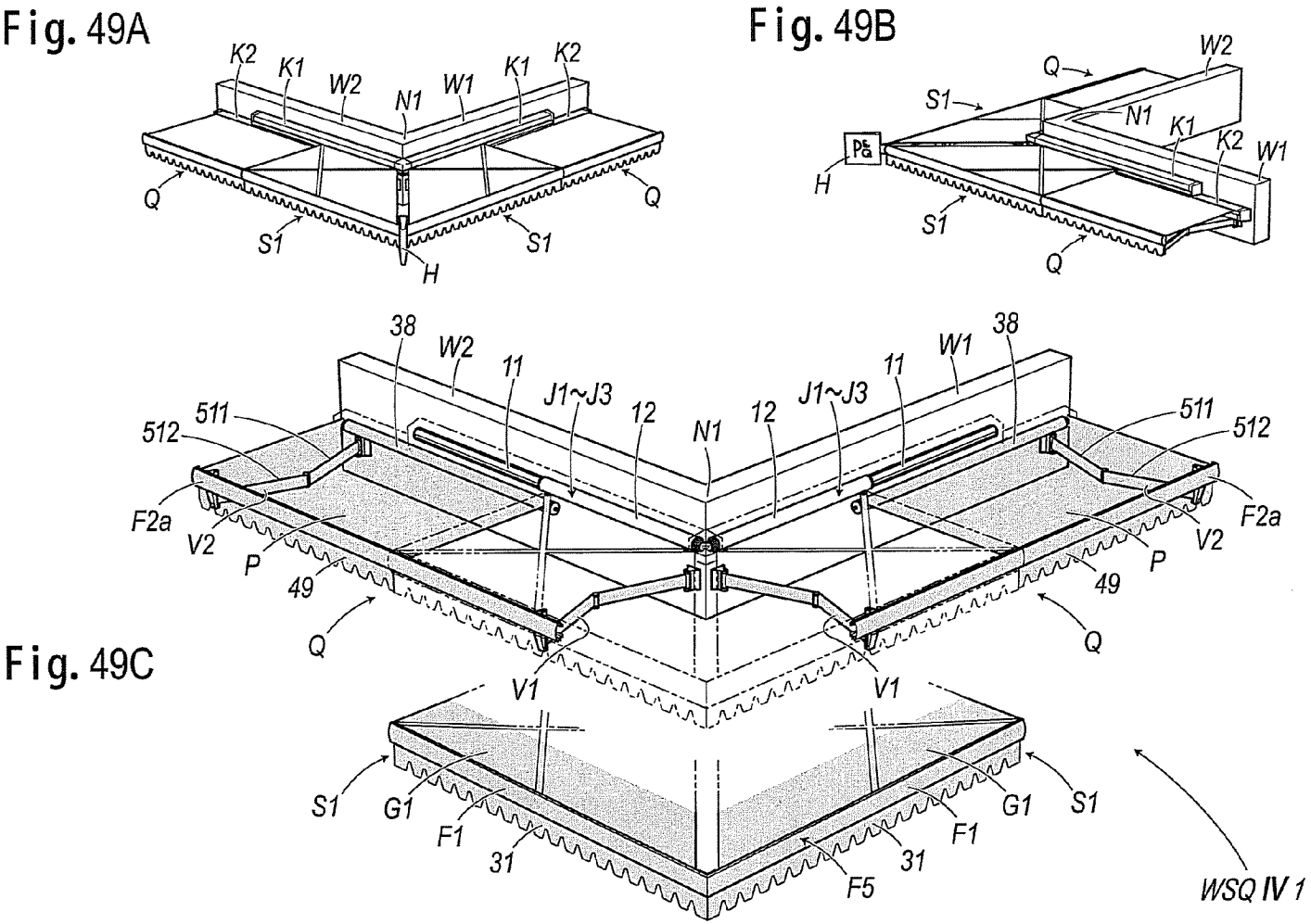
Figure 50A:
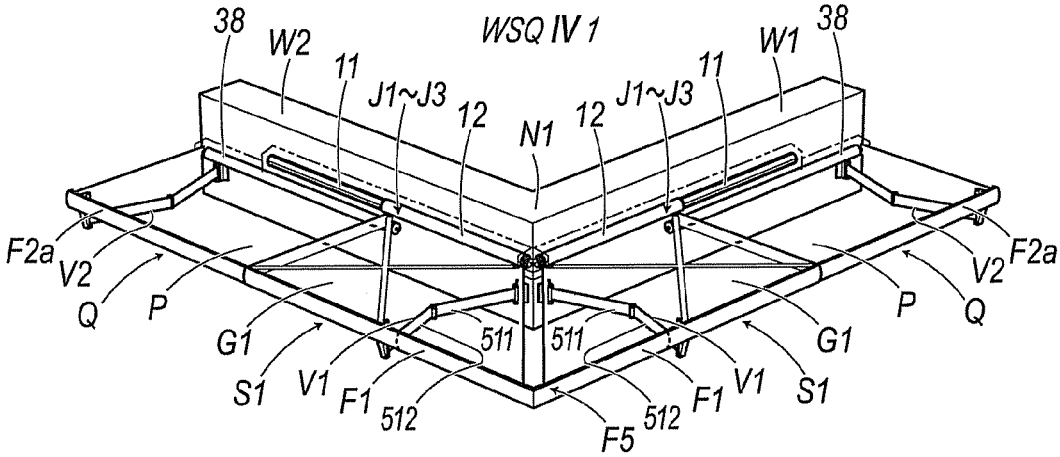
Figure 50B:
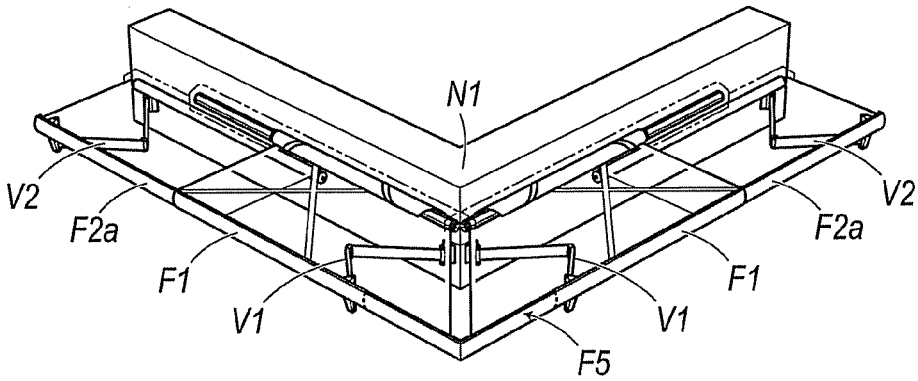
Figure 50C:
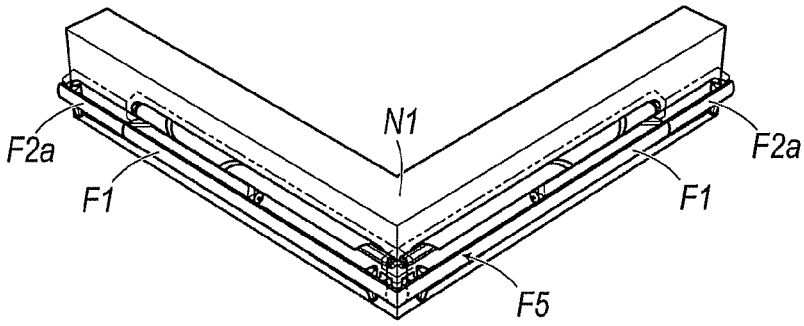
Figure 51A:
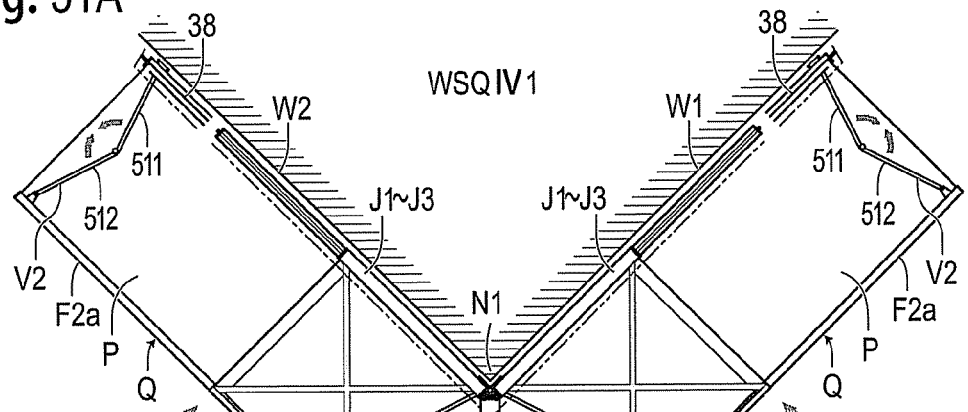
Figure 51B:
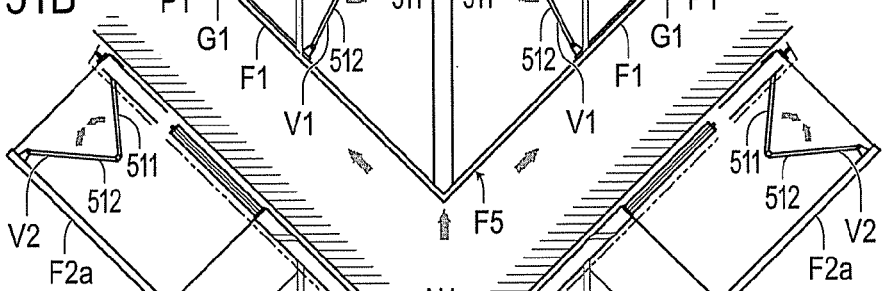
Figure 51C:
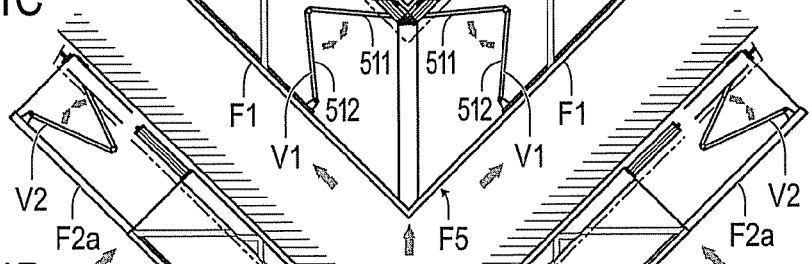
Figure 51D:
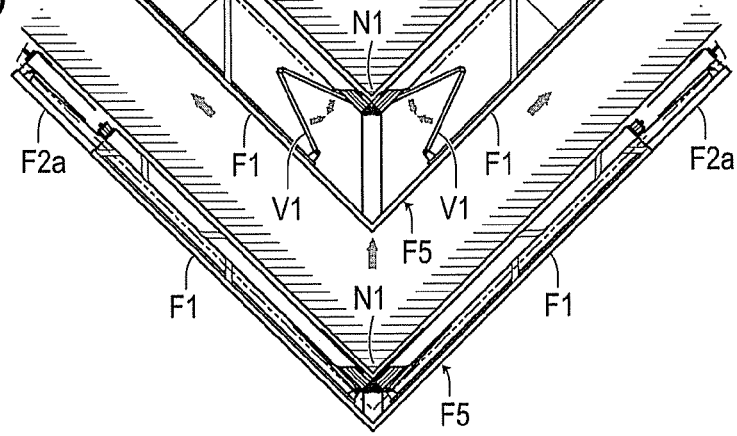

FIGS. 49A to 49C are perspective views showing a first embodiment of a composite device WSQIV1 of the fifth type incorporated into a protruded corner portion into an integral structure. Among them, FIG. 49C shows a state where the former half portion of the integrated protruded corner awning device is separated by being transported into a corner space at a forward side.

FIGS. 50A to 50C and 51A to 51D are perspective views and plan views showing a canvas winding process of the composite device WSQIV1, and a process reversal to this is a canvas extending process.

Figures 52A, 52B:
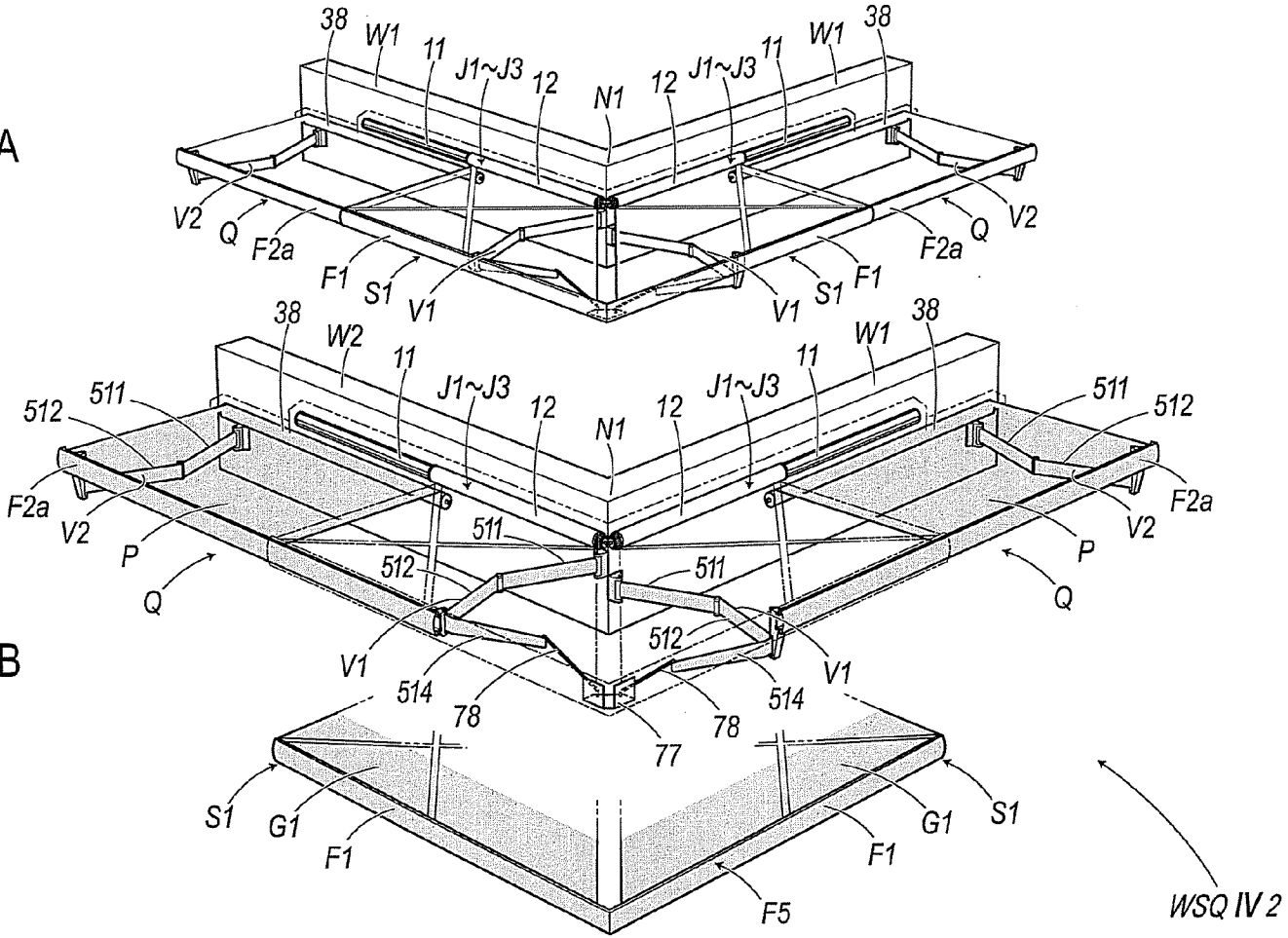
Figure 53A:
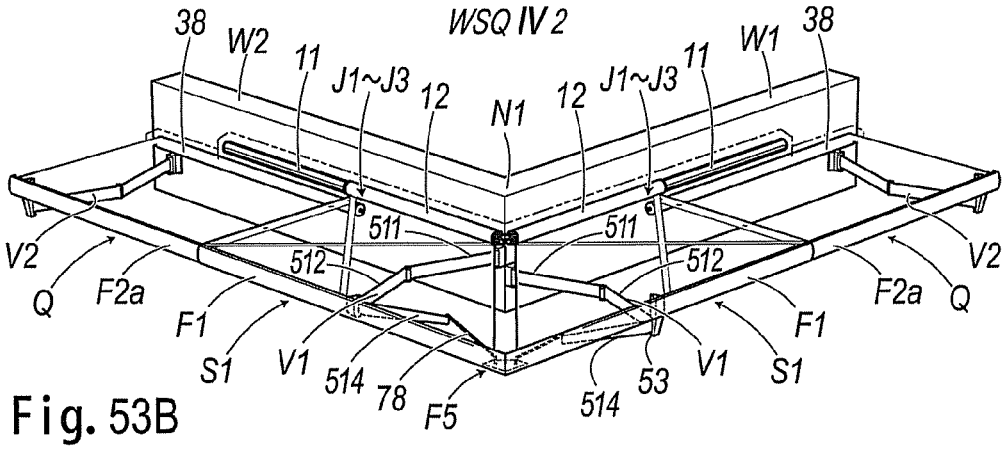
Figure 53B:
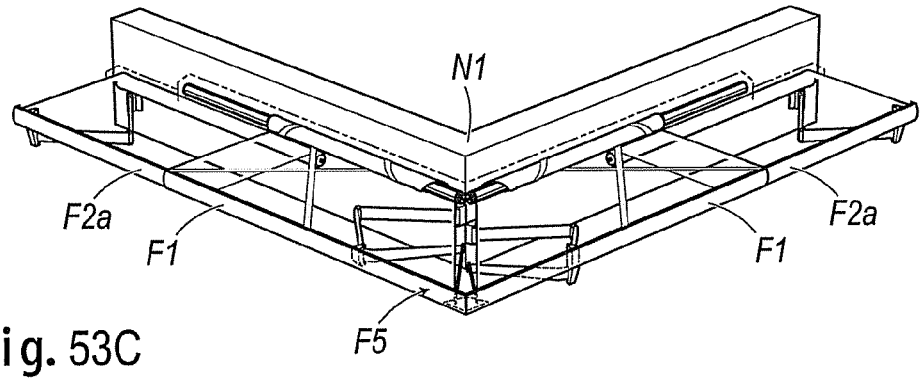
Figure 53C:
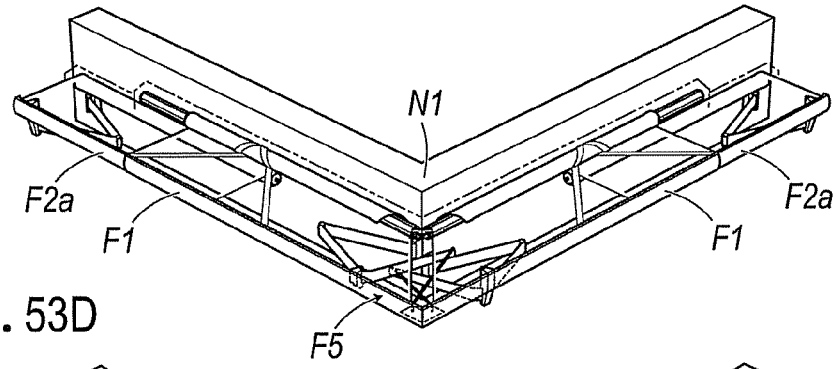
Figure 53D:
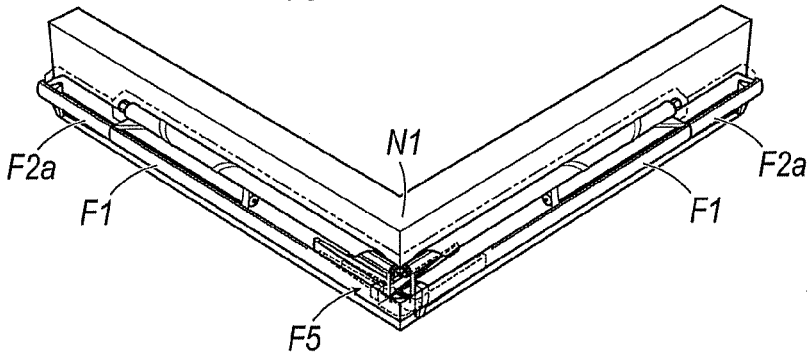
Figure 54A:
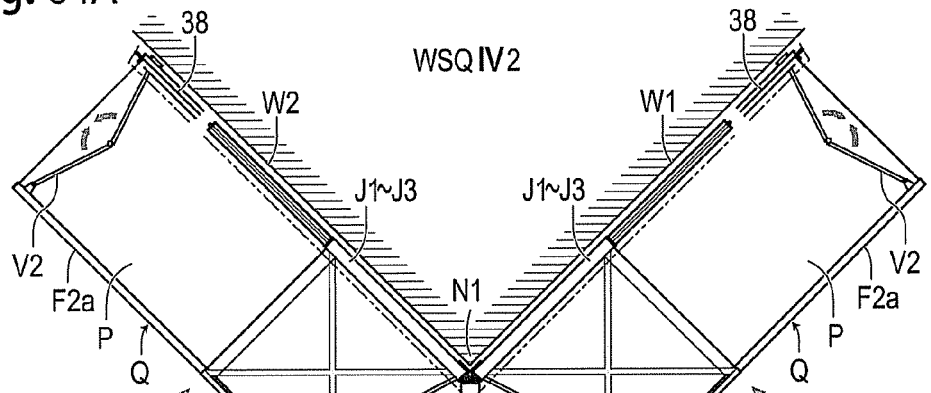
Figure 54B:
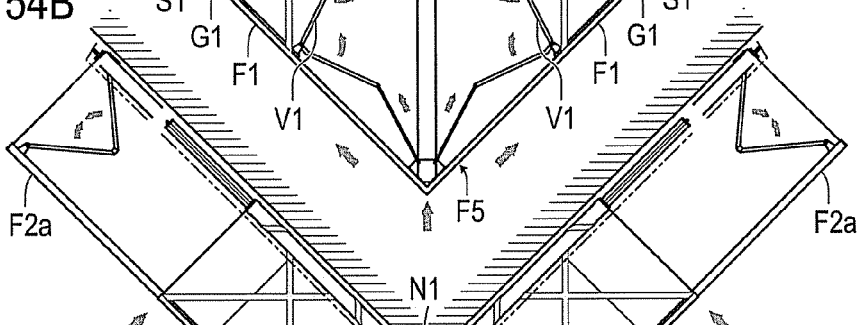
Figure 54C:
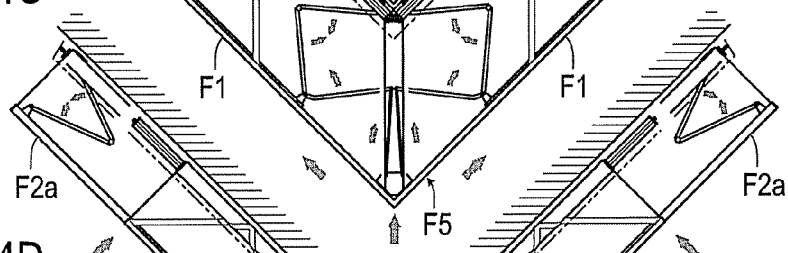
Figure 54D:
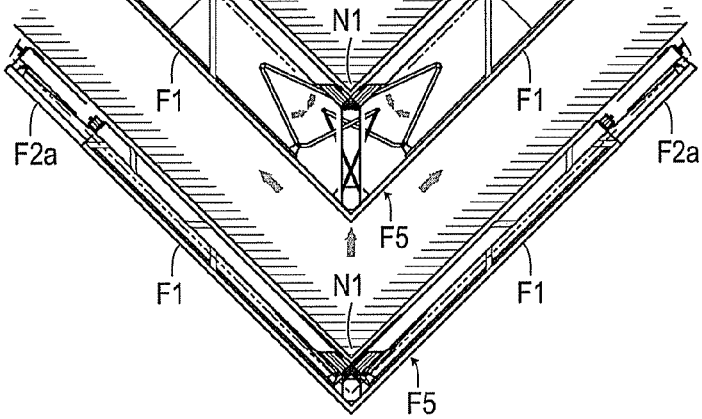

FIGS. 52A and 52B are perspective views showing a composite device WSQIV2 of second embodiment incorporating a movement link mechanism of a corner frame. Among them, FIG. 52B shows a state where the corner frame and the protruded corner canvas are separated by being transported into a corner space at a forward side.

FIGS. 53A to 53D and 54A to 54D are perspective views and plan views showing a canvas winding process of a composite device WSQIV2, and a process reversal to this is a canvas extending process.

Figure 55A:
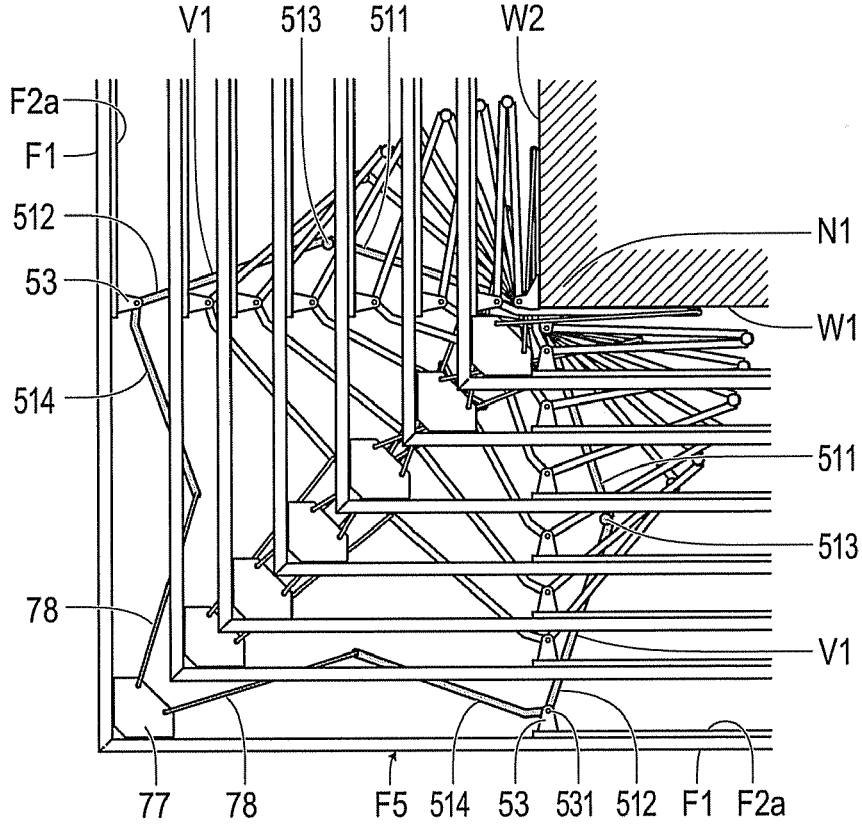
Figure 55B:
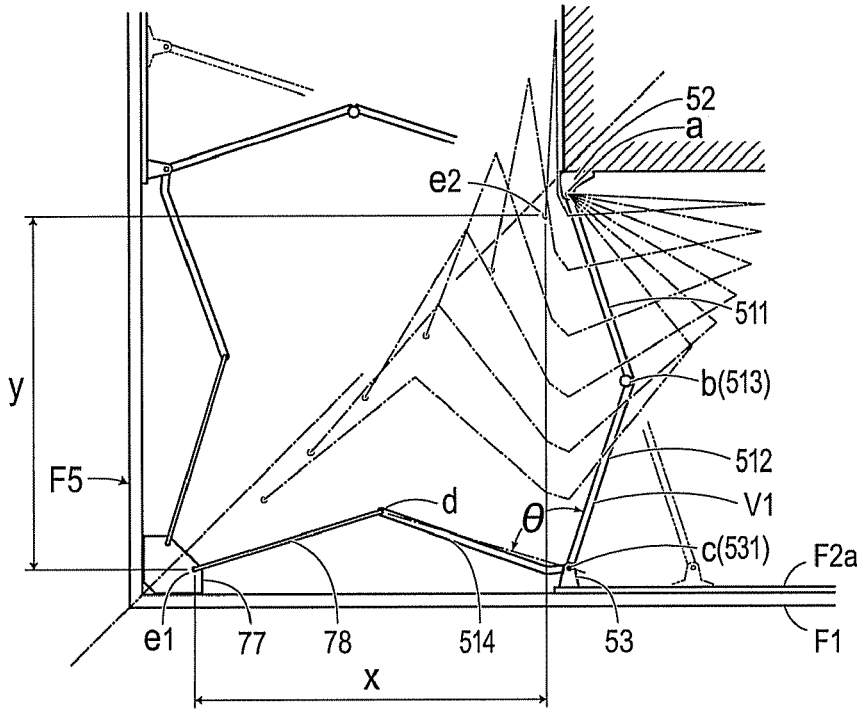

FIGS. 55A and 55B are an essential part plan view showing a operation process of a movement link mechanism, and a diagram illustrating a trail of its movement.

Figure 56A:
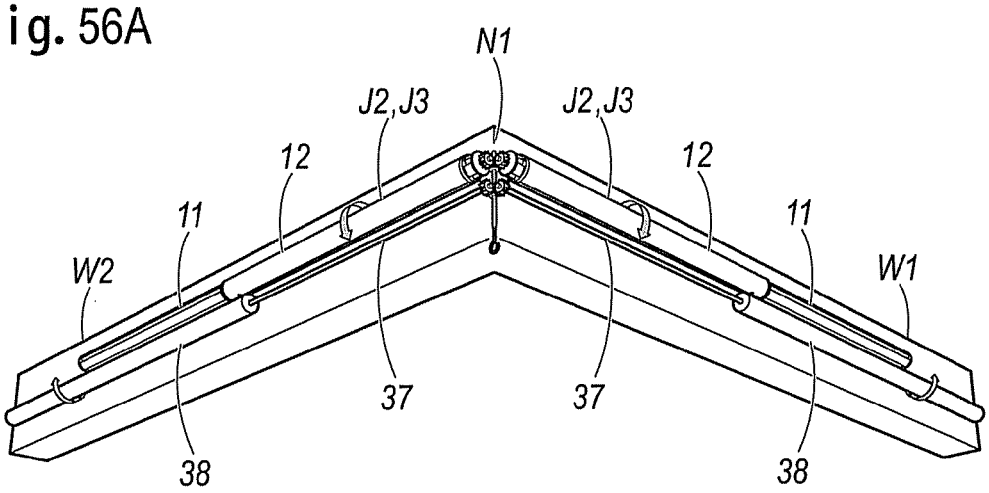
Figure 56B:
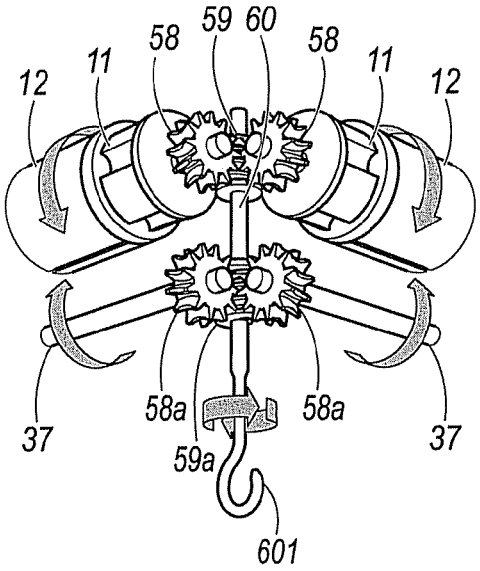

FIGS. 56A and 56B are perspective views showing a double manually interlocked structure for two pairs of composite devices attached at one the other sides of a protruded corner portion. Among them, FIG. 56A shows a state where the composite devices are looked up, and FIG. 56B shows an essential part of the interlocked structure.

Figure 57A:
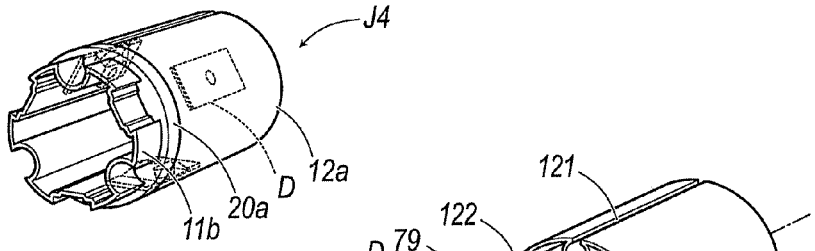
Figure 57B:
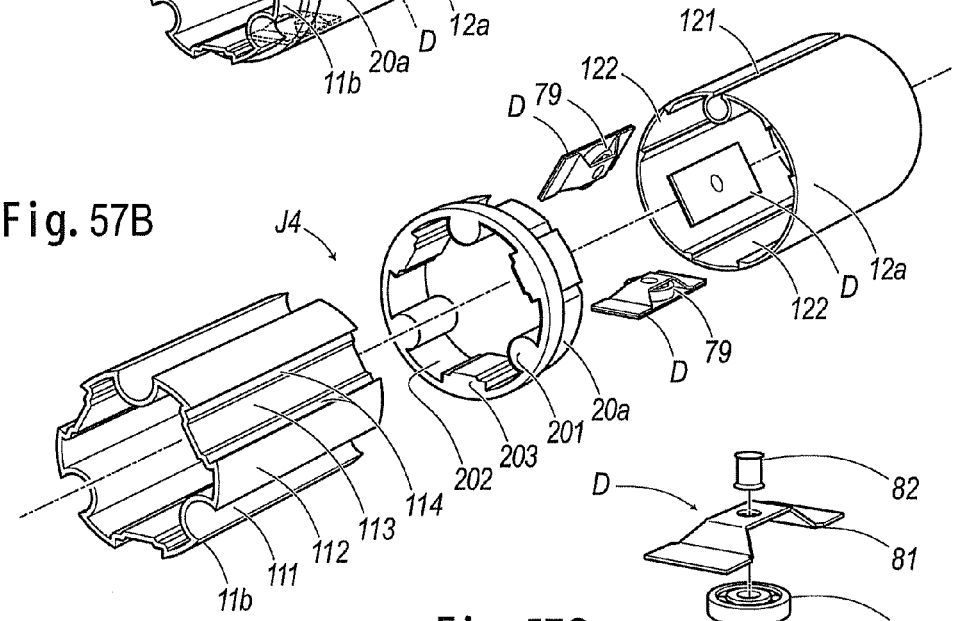
Figure 57C:
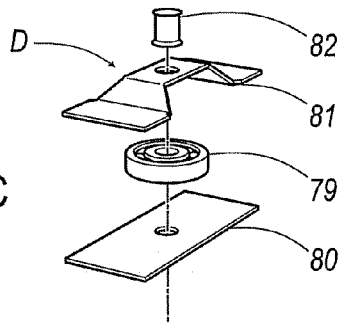

FIGS. 57A to 57C are perspective views showing a take-up shaft of fourth embodiment, for rotatably driving an outer roller. Among them, FIG. 57A is a perspective view showing an essential part of the take-up shaft, FIG. 57B is an exploded view of the essential part, and FIG. 57C is an exploded view of a roller attachment structure.

Figure 58:
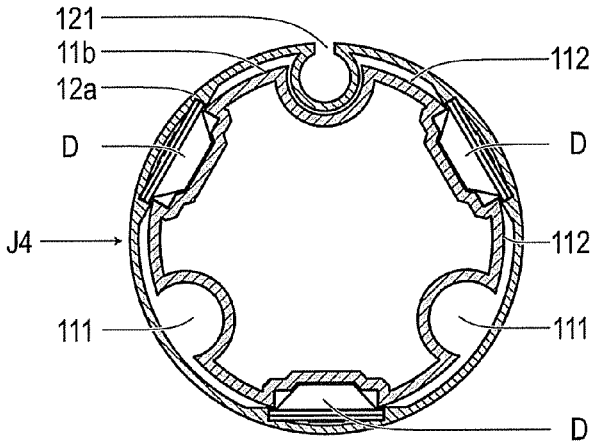

FIG. 58 is a longitudinal side view of the essential part of the take-up shaft.

Figure 59A:
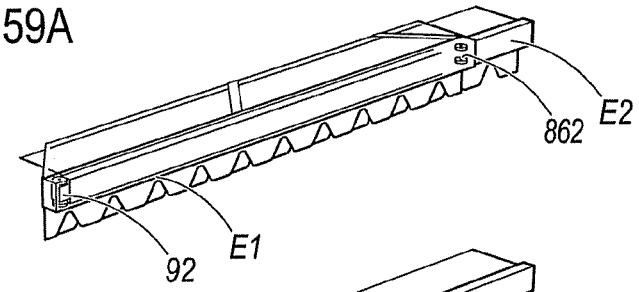
Figure 59B:
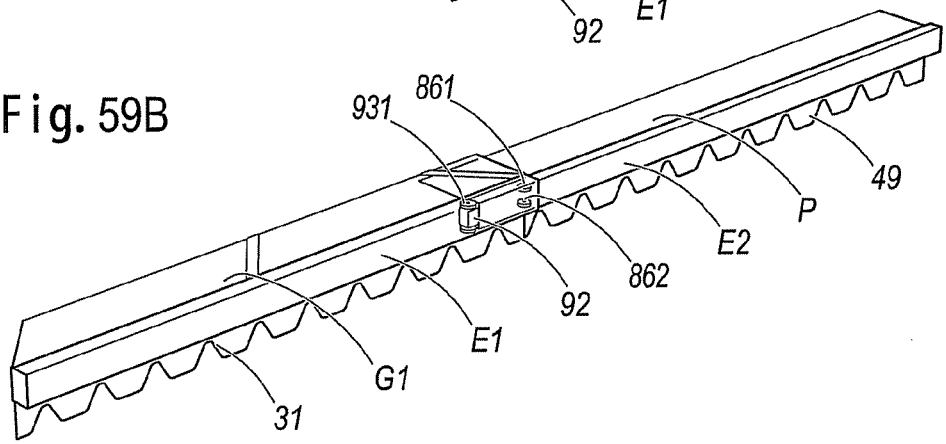

FIGS. 59A and 59B are perspective views showing a front portion of a composite device including a front bar replaced into a rolling structure. Among them, FIG. 59A shows a state where the outer is retracted and stored, and FIG. 59B shows a state where the outer is pushed and moved forward.

Figure 60:
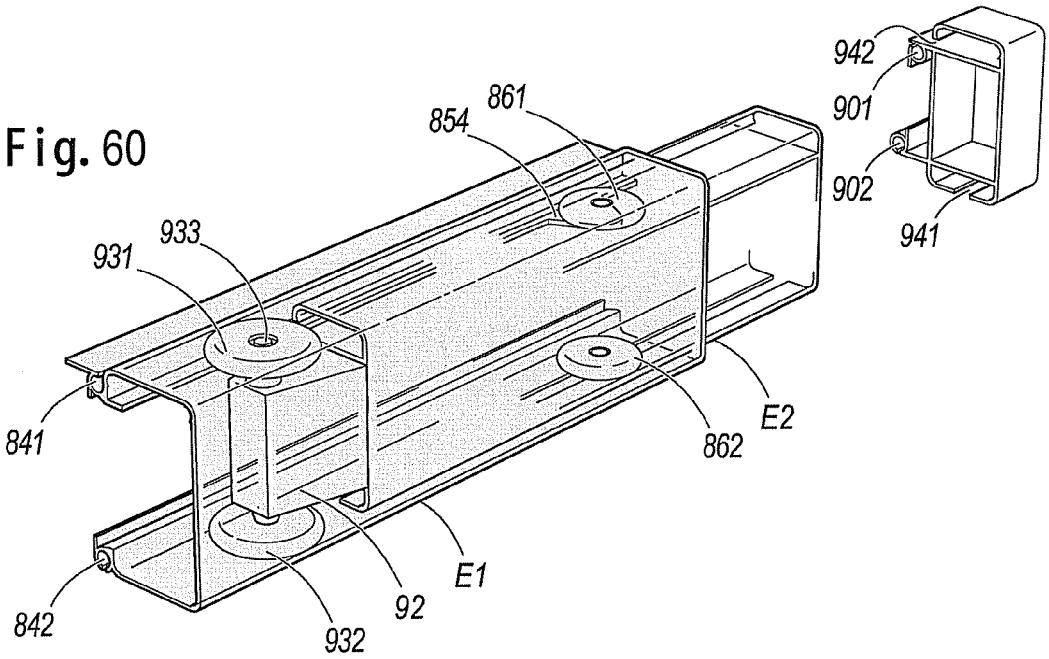

FIG. 60 is a perspective view of an essential part showing a state where the front bar shown in FIG. 59B is fitted and inserted.

Figure 61A:
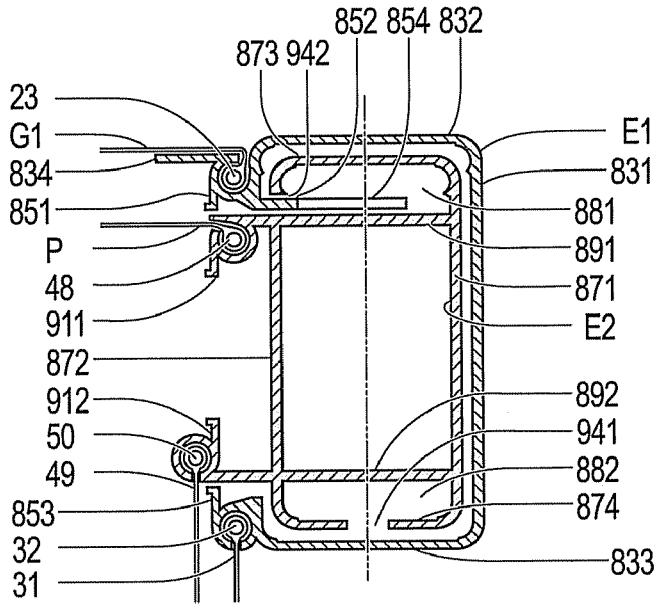
Figure 61B:
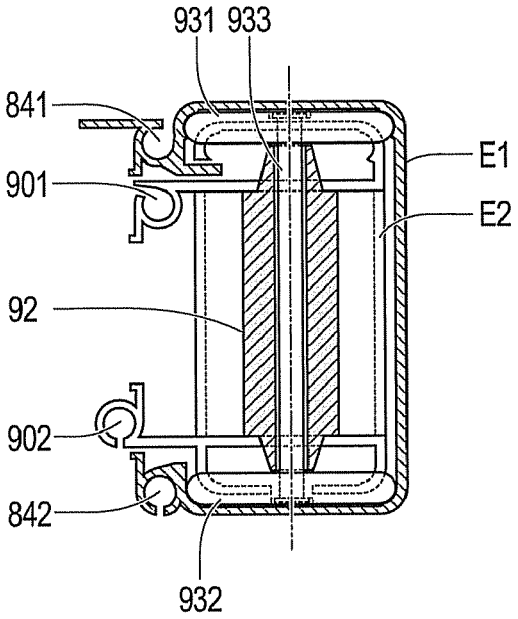
Figure 61C:
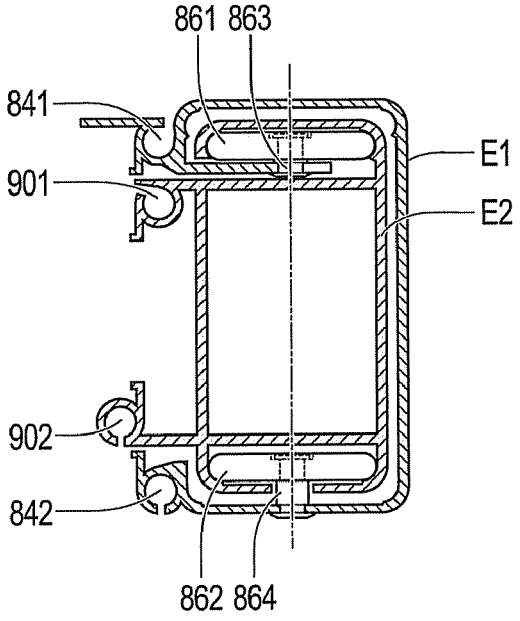

FIGS. 61A to 61C are longitudinal side views of each part shown in FIG. 60. Among them, FIG. 61B shows a cross section taken along a line connecting the upper and lower guide wheels incorporated in an inner top end portion. FIG. 61C shows a cross section taken along a line connecting the upper and lower guide wheels incorporated in a rear end portion of an outer top end portion.

Figure 62A:
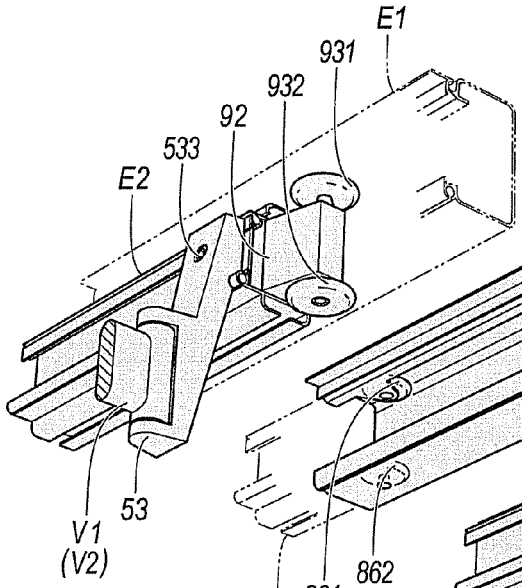
Figure 62B:
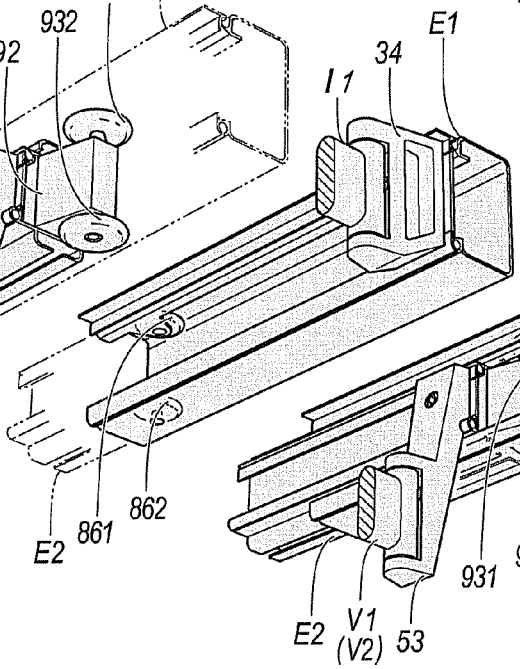
Figure 62C:
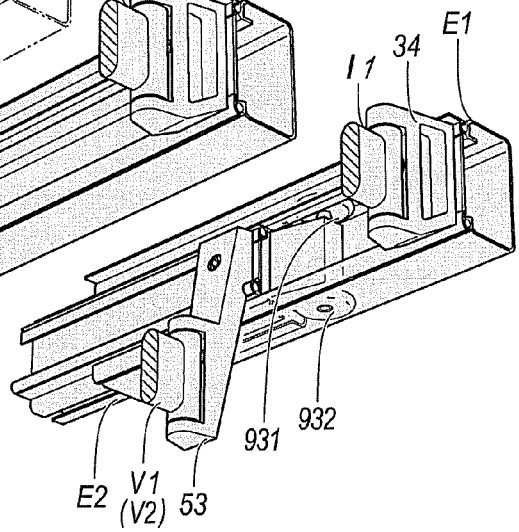

FIGS. 62A to 62C are perspective views showing a combination between a bracket and a front bar in the case where the front bar of a rolling structure is employed in the composite device SQIII1 of the first type. Among them, FIG. 62A and FIG. 62B are an exploded view when the separated inner is looked up from the backside and an exploded view when the separated outer is looked up from the backside, respectively. FIG. 62C shows a state where the inner and the outer are assembled with each other.

Figure 63A:
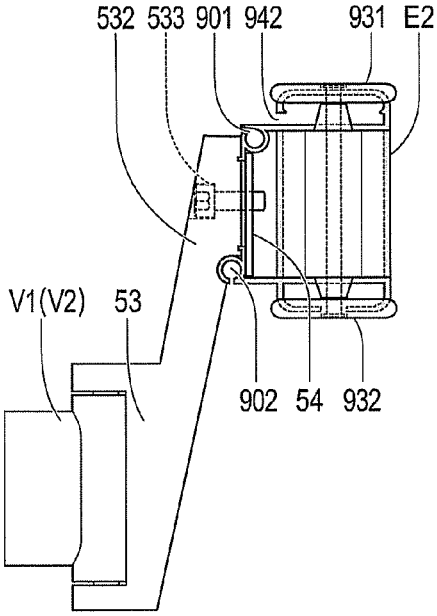
Figure 63B:
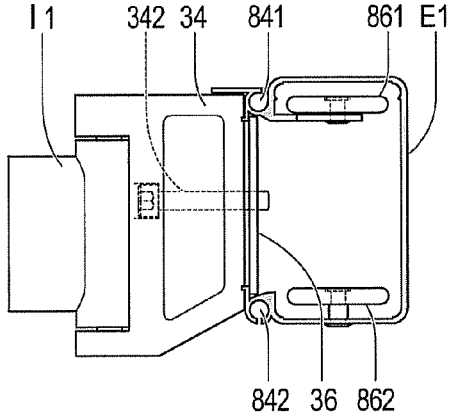

FIGS. 63A and 63B are longitudinal side views of the respective illustrations shown in FIGS. 62A and 62B. Mainly, FIG. 63A shows a front bar of a rectangular canvas and its bracket, and FIG. 63B shows a front bar of protruded corner canvas and its bracket, respectively.

Figures 64A, 64B, 64C:
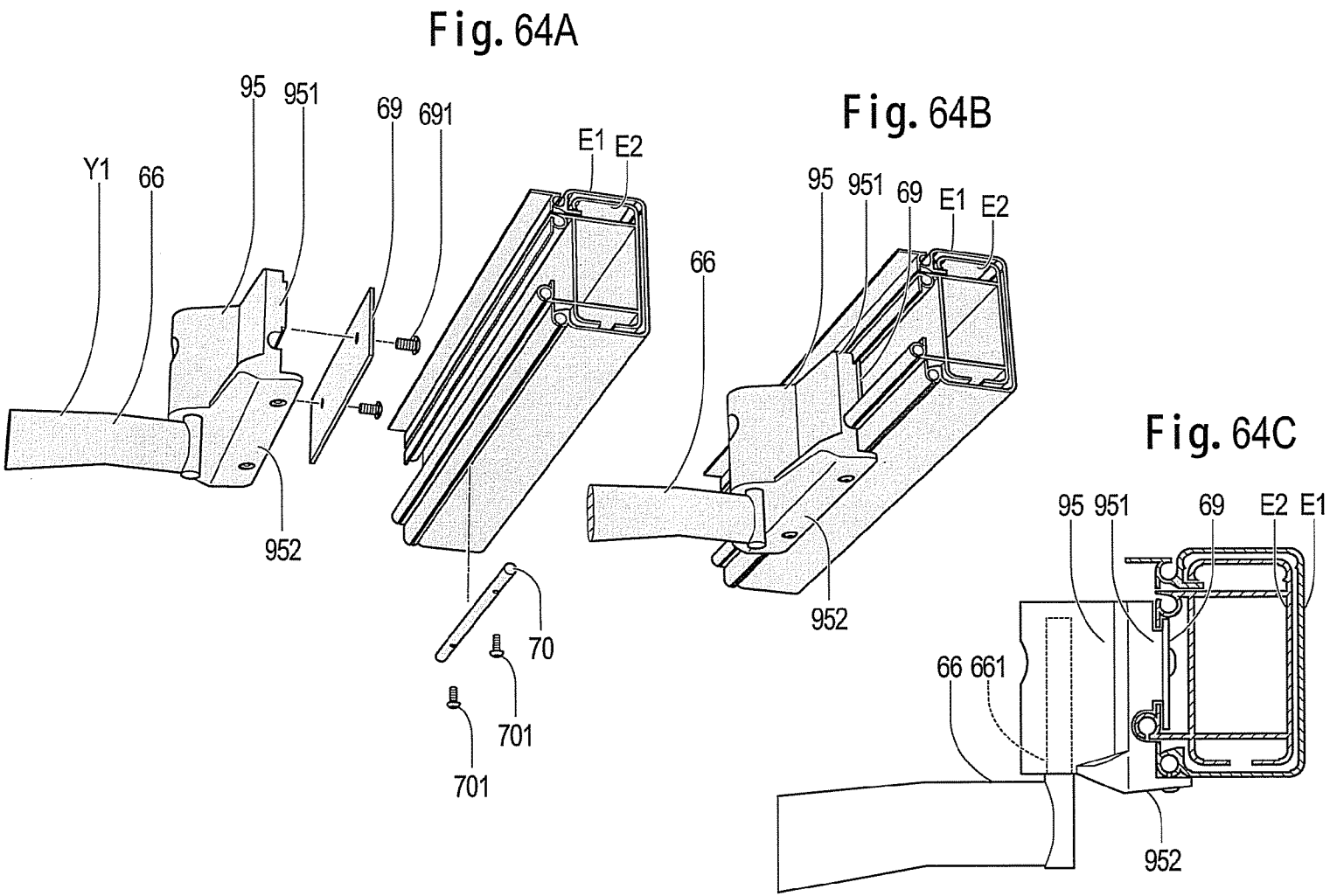

FIGS. 64A to 64C are perspective views and longitudinal side views showing a combination between a bracket and a front bar in the case where the front bar of a rolling structure is employed in the composite device SQIII3 of the first type. Among them, FIG. 64A shows an exploded state between a front end portion of a main link and a front bar, and FIG. 64B shows their assembled state seen from the backside, and FIG. 64C shows a longitudinal cross section thereof.

Figures 65A, 65B, 65C:
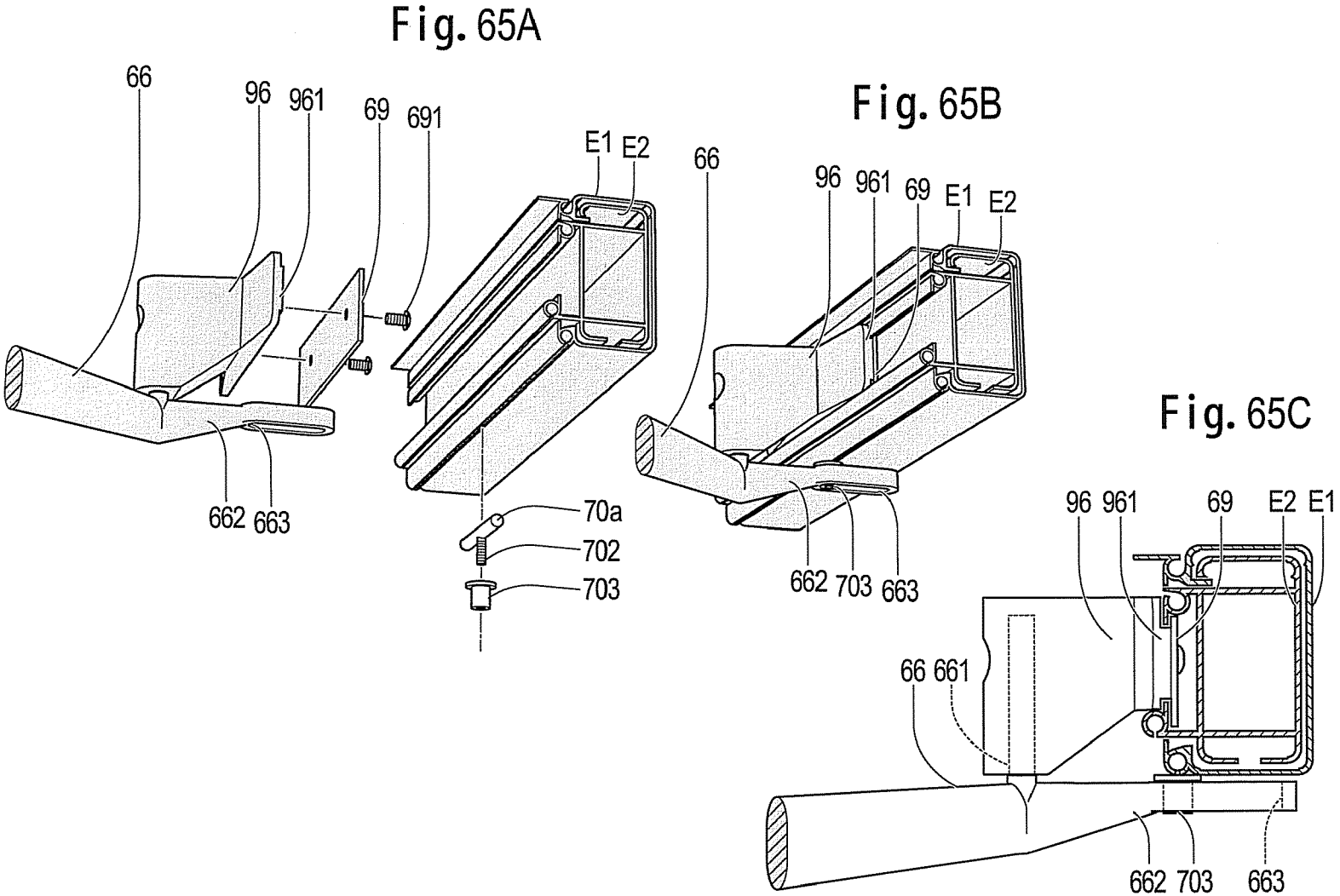

FIGS. 65A to 65C are perspective views and longitudinal side views showing a device of increasing a lateral movement stroke in the case where a front bar of a rolling structure is employed. Among them, FIG. 65A shows an exploded state between a front end portion of a main link of Y-like arm and a front bar, and FIG. 65B shows their assembled state seen from the backside, and FIG. 65C shows a longitudinal cross section thereof.

Figure 66:
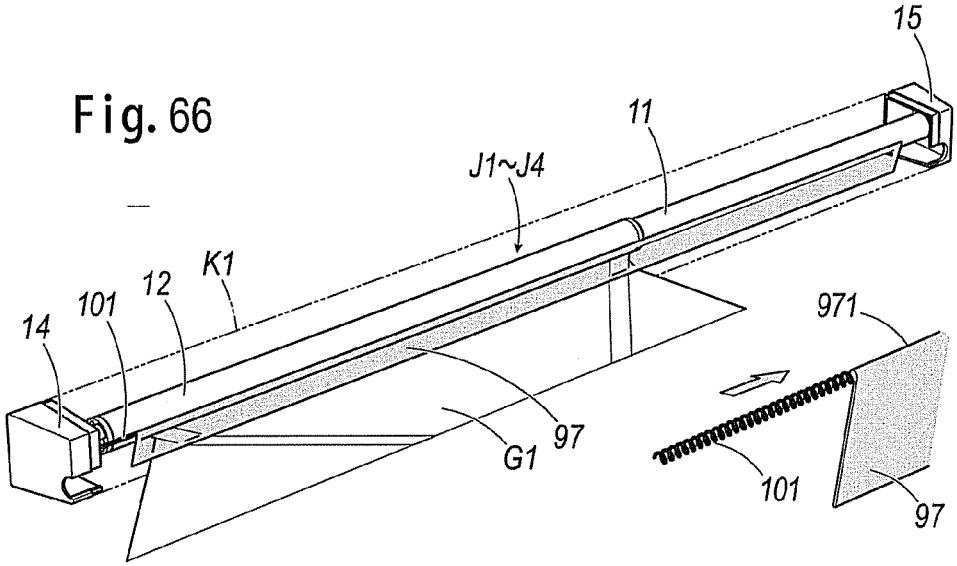

FIG. 66 is a perspective view showing a swinging flap attached in the vicinity of an outlet of a casing of a protruded corner canvas. At a position adjacent to the right side thereof, a coil spring for biasing a shaft end portion of said flap is shown.

Figure 67A:
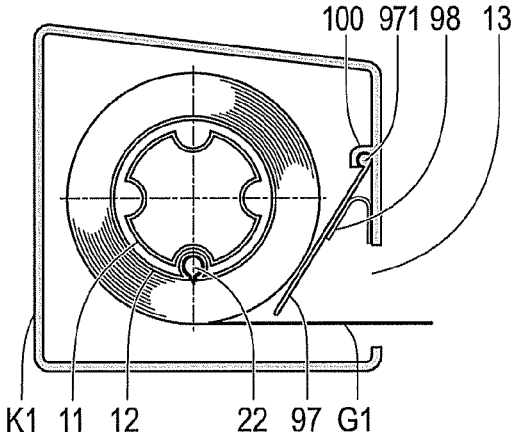
Figure 67E:
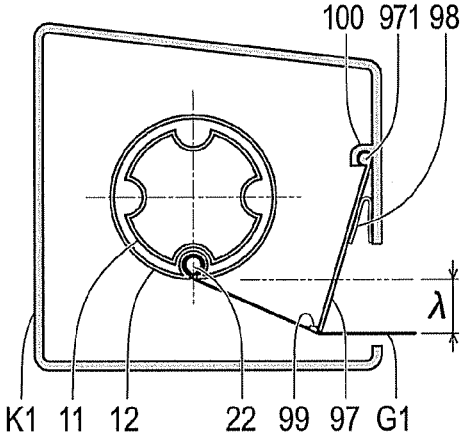
Figure 67B:
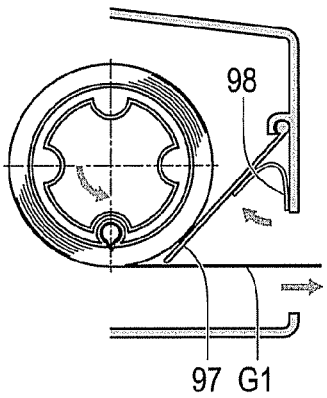
Figure 67C:
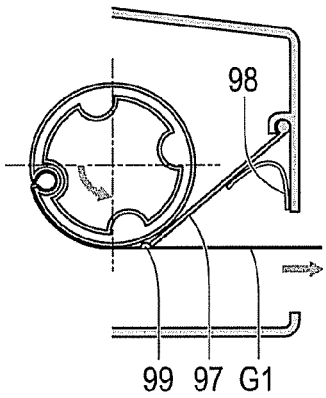
Figure 67D:
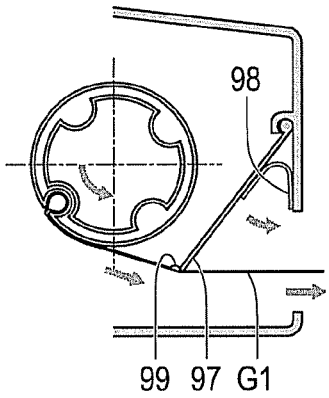

FIGS. 67A to 67E are diagrams showing a process of drawing a protruded corner canvas and operating a swinging flap. Among them, FIGS. 67C to 67E show a state where the flap is locked with a protrusion of the protruded corner canvas and is depressed downward.

Figure 68:
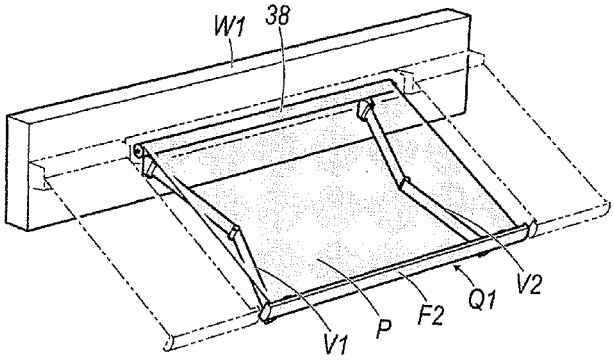

FIG. 68 is a perspective view showing a movable awning device of a rectangular canvas.

Figure 69:
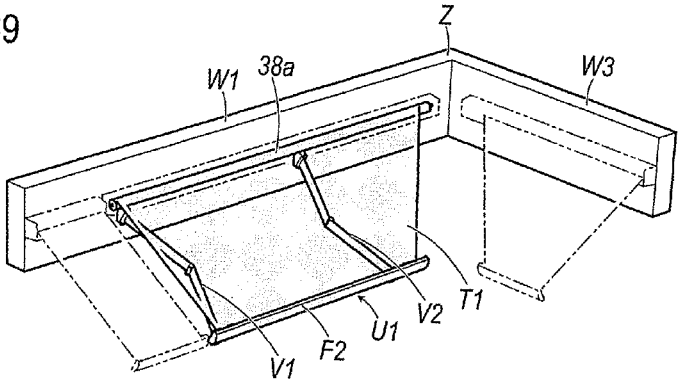

FIG. 69 is a perspective view of a movable awning device of a recessed corner canvas in a right-angled reversed trapezoidal shape.

Figure 70:
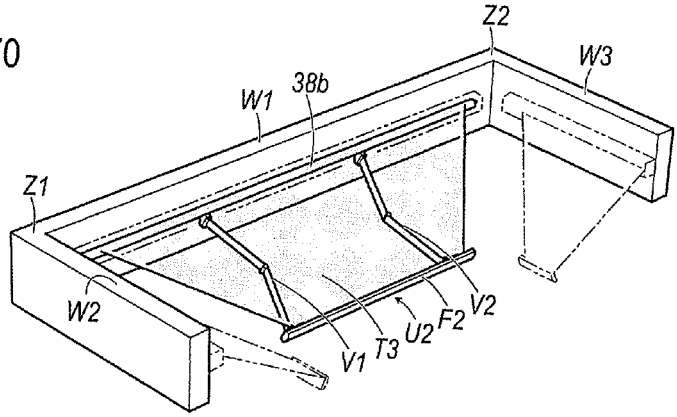

FIG. 70 is a perspective view showing a movable awning device of a recessed corner canvas in a reversed trapezoidal shape.

DESCRIPTION OF REFERENCE NUMERALS

SQIII1 to 9, SQII1 to 2, SQIV1 to 5: Composite device of a first type
SUIII, SUII: Composite device of second type
SQSIV1 to 4, SQSVI: Composite device of third type
SSII, SSIV: Composite device of fourth type
WSQIV1 to 2: Composite device of fifth type
K1 to K3: Casing
S1, S2: Protruded corner awning device
Q: Rectangular awning device
U: Recessed corner awning device
M1, M2: Electric motor
J1 to J4: Canvas take-up shaft
W1: Front wall
W2: Side wall
G1, G2: Protruded corner canvas
R1: Canvas main body
R2: Canvas extension
P: Rectangular canvas
T1, T2: Recessed corner canvas
F1 to F3, F2*a*, F2*b*, F2*c*, F11 to F13: Front bar (of sliding type)
F4: Guide rail
F5: Corner frame
E1, E2: Front bar (of rolling type)
I1, I2: I-like arm
V1, V2: V-like arm
Y1, Y12: Y-like arm
L1, L2: L-like arm
N1, N2: Protruded corner
Z: Recessed corner
H: Signboard
1, 5: Canvas top side
2, 6: Canvas bottom side
3, 9: Canvas oblique side
4, 7, 8: Canvas perpendicular side
1*a*, 2*a*: Pouched passage
11, 11*a*, 11*b*: Inner rotation shaft (inner shaft)
111: Guide groove
112: Guide projection
113: Wheel guide groove
12, 12*a*: Outer roller
121: Fitting groove
122: Roller attachment groove
13, 13*a*: Canvas outlet
14, 15, 14*a*, 15*a*: End cap
141, 151: Bearing
16, 17, 17*a*: End cap
161: Support shaft
170: Center hole
172: Hole
181: Motor output shaft
182: Shaft
19: Bearing socket
191: Axial bore
20, 21, 21*a*: End cap
201, 211: Guide projection
202, 212: Guide groove
22, 23, 32: Attachment wire
24, 25: Cross passage
26, 27: Connection wire
261, 271: Engagement piece
262, 272: Clamp
281, 282: Screw
291: Upward fitting groove
292: Downward fitting groove

301, 302: Engagement hole
31, 49: Front skirt
31*a*: Pouched passage
33, 34: Bracket
341: Pin
342: Screw
35: Groove
36: Attachment plate
37: Rotation shaft
38, 39: Take-up roller
381: Fitting groove
39: Canvas outlet
40, 41: End cap
40*a*: Intermediate bearing
42: Bearing socket
421: Axial bore
43, 44, 44*a*: End cap
431: Shaft
441: Round hole
45, 48, 50: Attachment wire
461, 462: Guide groove
471: Upper fitting groove
472: Lower fitting groove
481, 482: Flanged edge
511: Rear link
512: Front link
513: Bi-foldable connecting portion
52, 53: bracket
531: Pin
532: Rising portion
533: Screw
54: Attachment plate
55: Coil spring
551: Top end portion
552: Rear end portion
56: Spring stopping socket
561: Center hole
562: Hole
57: Rigid shaft
571: Shaft fore end portion
572: Shaft rear end portion
58: Worm gear
59: Worm
60: Worm rotation shaft
601: Hook
61, 62: Spur gear
63: Corner cap
64: oblique gear (or bevel gear)
65: Connection rod
651: Top end portion
652: Rear end portion
66: Main link
661: Engagement pin
662: Protrusion arm
663: Long hole
67: Sub-link
68, 68*a*: Bracket
681: Rising portion
682: Receiving stand portion
69: Attachment plate
691: Screw
70: Rod
701: Screw
702: Screw portion
703: Cylindrical nut
711: Rear link
712: Front link
72: Engagement plate
721: Long hole
73: Roller
74: Belt
75: Sub-rod
76: Protruding piece
77: Recessed corner plate
78: Connection rod
79: Wheel
80: Seat plate
81: Cover plate
82: Shaft pin
831: Front plate portion
832: Upper plate portion
833: lower plate portion
834: Scratched plate portion
841, 842: Fitting groove
851, 852, 853: Flanged edge
854: Attachment portion
861, 862: Guide wheel
863: Shaft pin
871: Front plate portion
872: Rear plate portion
873, 873: Upper plate portion
874: Lower plate portion
881, 882: Wheel room
891, 892: Partition
901, 902: Fitting groove
911, 912: Flanged edge
92: Wheel holder
931, 932: Guide wheel
933: Wheel shaft
941, 942: Guide slit
95: Bracket
951: Rising portion
952: Receiving stand portion
96: Bracket
961: Rising portion
97: Swinging flap
971: Shaft portion
98: Plate spring
99: Protruding portion
100: Bearing
101: Coil spring

BEST MODE FOR CARRYING OUT THE INVENTION

As to Awning Devices of First Type

As shown in FIGS. 1 to 11 and 18 to 32, awning devices of the first type SQIII1-9, SQII1-2, and SQIV1-5 are used in the case where the top end portion of the respective devices is located at one side of a building, for example, at an protruded corner portion N1, and the devices extend therefrom rearward along a front wall W1 and a side wall W2 which are linear zones (or mildly curved zones).

The entire structures thereof are configured by organically combining: an awning device S1 (hereinafter, referred to as an protruded corner awning device) for a corner canvas G1 (hereinafter referred to as a protruded corner canvas) mounted at a position in proximity to the corner of the protruded corner portion N1 and assuming a substantially right-angled trapezoidal shape stretching toward a corner space portion of the protruded corner portion N1 when exploded; and an awning device Q (hereinafter, referred as a rectangular awning device) for a rectangular canvas P assuming a substantially rectangular shape when exploded and covering linear peripheries of the building following the canvas G1 rearward. Further, a front bar F1 for the protruded corner canvas G1 is fitted on and supported by the front bar F2 for the rectangular canvas P to be movably guided in the axial direction. At the same time, these front bars F1, F2 are structured to be movable in parallel with each other by means of about two to four foldable swing arms selected from linear I-like arms I1, I2, double-foldable V-like arms V1, V2, Y-like arms Y1, Y2 in the shape of reversed letter y, L-like arms L1, L2 that operate in two phases.

Hereinafter, embodiments of composite devices SQIII 1-9, SQII 1-2, and SQIV 1-5 will be described as to the cases where the swinging arms are three (SQIII), the swinging arms are two (SQII), and the swinging arms are four (SQIV).

First Embodiment

As a first embodiment, a structure of the respective portions of the protruded awning device S1 and the rectangular awning device Q in the composite device SQIII1 including three swinging arms shown in FIGS. 1 to 11, and the relationship of their organic connection will be described.

As to Protruded Corner Awning Device

As to Canvas Take-Up Device

First of all, a first example of a canvas take-up device for winding and unwinding the protruded corner canvas G1 will be described based on FIGS. 4 to 7.

A reference numeral K1 refers to a rectangular cylindrical casing for storing a wound protruded corner canvas G1, and a take-up shaft J1 for the protruded corner canvas G1 is incorporated therein. The casing K1 is directly attached to the outer walls W1 (front wall), W2 (side wall) at a substantially horizontal posture in the vicinity of the corner of the protruded corner portion N1. Alternatively, the casing K1 may be fixed indirectly on the outer walls W1, W2 through an appropriate supporting bracket (not shown) so that its frontward inclination angle is variably adjustable, if necessary. The canvas take-up shaft J1 is comprised of a hollow inner rotation shaft 11 made of steel, and a cylindrical outer roller 12 made of steel and supportedly inserted into the rotation shaft 11 to be slidable in the axial direction of the rotation shaft 11.

Reference numeral 13 refers to a canvas outlet formed open at the lower portion of the front surface of the casing K1, and reference numerals 14 and 15 refer to end caps fitted onto both the fore and rear end portions of the casing K1, the end caps having bearings 141, 151 projected from the inner surface thereof, respectively. Reference numerals 111, 112 indicate guide grooves and guide projections respectively, both formed along the axial direction on each one-fourth of the outer circumference of the inner rotation shaft 11 in parallel with other grooves and projections. Reference numerals 16, 17 refer to end caps fitted onto both the fore and rear end portions of the inner rotation shaft 11. The cap main body is formed in substantially the same shape as the inner peripheral surface of the inner rotation shaft 11. A spindle 161 protruded from the end cap 16 is fitted into the bearing 141 rotatably.

In FIGS. 7A and 7B, reference numeral M1 indicates a columnar electric motor inserted into the rear portion of the inner rotation shaft 11 and rotatable forwardly and reversely. A motor output shaft 181 is protruded from the top end portion of the electric motor, whereas a fixing shank 182 is protruded from the rear end portion thereof, respectively. Reference numeral 19 denotes a gear socket having a rough surface to be fittedly inserted into the inner rotation shaft 11, and the motor output shaft 181 is fitted to an axial bore 191 of the gear socket 19. Reference numeral 171 refers to a cylindrical hole formed at the center of the main body of the end cap 17. The rear portion of the main body of the electric motor M1 is inserted into the cylindrical hole 171 to support the electric motor M1.

With the gear socket 19 fitted and fixed to the motor output shaft 181, the electric motor M1 is inserted into the rear position of the inner rotation shaft 11. On the other hand, with the end cap 17 inserted into the rear position of the main body of the electric motor M1, the cap 17 is fitted to the rear end portion of the inner rotation shaft 11, and the shank 182 of the electric motor M1 is fitted and fixed to the bearing 151.

Thereby, when the electric motor M1 incorporated in the inner rotation shaft 11 starts to drive, its output shaft 181 and gear socket 19 integrally rotate with the inner rotation shaft 11.

Reference numerals 20, 21 refer to hollow end caps fitted into both the fore and rear end portions of the outer roller 12. Guide projections 201, 211 and guide grooves 202, 212 are formed in parallel with each other on the internal surface thereof. The end caps 20, 21 are slidably fitted on the guide groove 111 and guide projection 112 of the inner rotation shaft 11.

Thereby, as the inner rotation shaft 11 and the outer roller 12 integrally rotate forwardly and reversely, the outer roller 12 can move forward or rearward in its axial direction to be slidably guided by the inner rotation shaft 11. Reference numeral 121 refers to a canvas fitting groove formed on the bottom portion of the outer roller 12 along the axial direction.

In the foregoing case, the outer roller 12 is structured to be slidably guided by the inner rotation shaft 11. Alternatively, the outer roller 12 and the inner rotation shaft 11 may be in a relationship shown in FIGS. 57A to 57C and 58 in which revolving rollers 79 are incorporated into an outer roller 12*a*, and thus-structured outer roller 12*a* is inserted into an inner rotation shaft 11*b* to be guided while rolling (the details thereof will be described later).

As to Protruded Corner Canvas

Here, the configurations of an protruded corner canvas G1 shown in FIGS. 8A to 8C and wires to be incorporated therein will be described.

The protruded corner canvas G1 is made of a textile like that for tents such as fabric or synthetic resin, and formed into a substantially right-angled trapezoidal shape when extended, and comprised of a rectangular canvas main body R1 and a right-angled triangle canvas extension R2 extended from one side of said canvas main body.

As for the geometry, the top side 1 at the canvas upper edge portion (hereinafter, referred to as a canvas top side) and the bottom side 2 at the canvas lower edge portion (hereinafter, referred to as a canvas bottom side) are formed in parallel with each other. An oblique side 3 is formed to extend from the top end portion of the canvas bottom side 2 toward the top end portion of the canvas top side 1 at about a 45 degree angle of inclination (hereinafter, referred to as a canvas oblique side) to impart a wide-based shape to the protruded corner canvas G1. A vertical side 4 (hereinafter, referred to as a canvas perpendicular side) is formed to perpendicularly extend from the rear end portion of the canvas bottom side 2 toward the rear end portion of the canvas top side 1.

Reference numerals 22, 23 refer to attachment wires (or members such as tubes, rods, and the like), and are inserted into pouched passages 1*a*, 2*a* formed on the canvas top side 1 and the canvas bottom side 2, respectively. Reference numerals 24, 25 refer to X-like cross passages formed on the diagonal lines of canvas main body R1, which are lines that obliquely connect the four corners thereof. The passages have tension members such as connection wires 26, 27, ropes, and the like inserted therein. Engagement pieces 261, 271 of the top end portions of those wires are drawn obliquely upward from outlets of the top portions of the cross passages 24, 25. The end portions of the wires and their fasteners 262, 272 are drawn obliquely downward from outlets of the bottoms of the cross passages 24, 25.

Then, to attach the protruded corner canvas G1, firstly, the canvas top side 1 is faced to the fitting groove 121 of the outer roller 12, and the attachment wire 22 is inserted into the pouched passage 1*a* thereof to fix the canvas top side 1 and prevent it from slipping off. Next, screws 281 are screwed to the fitting grooves 121 at its both the fore and rear end portions of the canvas top side 1 as shown in FIGS. 4B and 5B. Then, the engagement pieces 261, 271 at the top end portions of the connection wires 26, 27 drawn from the outlets of the top portions are fitted into the fitting grooves 121, and screws 282 are screwed to the outside of the fitting grooves 121. As a result, the engagement pieces 261, 271 are positioned and fixed.

As to Front Bar

Reference numeral F1 refers to a front bar for attaching the canvas bottom side 2 of the protruded corner canvas G1. The front bar F1 is a molded steel member having a shape of reversed letter C in cross section, of which front plate is shaped into an arcuate surface (or vertical surface) and of which back surface is formed open. Reference numerals 291, 292 refer to an upper fitting groove opened upward and a lower fitting groove opened downward. The upper and lower fitting grooves 291, 292 are formed longitudinally on the upper plate and the lower plate respectively, which extend rearward from the upper and lower positions on the front surface of the front bar F1. Reference numerals 301, 302 refer to engagement holes drilled in the vicinity of the midpoint and the rear end portion on the upper surface of the front bar F1.

Subsequently, the canvas bottom side 2 is faced to the upper fitting groove 291, and the wire 23 is inserted into the pouched passage 2*a* thereof to fix the canvas bottom side 2 and prevent it from slipping off. Then, the end portions of the connection wires 26, 27 drawn from the outlet at the bottom are inserted into the engagement holes 301, 302 shown in FIGS. 4B and 5A. The drawn protruded corner canvas G1 is disposed in an appropriately tensioned condition, and in this state, the fasteners 262, 272 are fixed with screws. Reference numeral 31 refers to a front skirt hanging down from the front bar F1, the front skirt 31 being fixed to the front bar F1 by facing its upper edge portion to the lower fitting groove 292 and then inserting a wire 32 into the pouched passage 31*a* formed on the upper edge of the front skirt 31.

Thereby, the canvas take-up device for the protruded corner canvas G1 is configured.

As to Swing Arm

Reference numeral I1 refers to a linear swing arm (hereinafter, referred to as an I-like arm) slidably supported with a bias, and supports the front bar F1 with a bias so as to push the front bar F1 toward the corner space portion obliquely forward. Reference numeral 33 refers to a bracket for pivotally supporting the base end portion of the I-like arm with a pin, the bracket 33 being fixed on the outer wall W1 in the vicinity of the underside of the top end portion of the casing K1 as well as in proximity to the corner end portion of the protruded corner portion N1.

Reference numeral 34 refers to a bracket for pivotally supporting the fore end portion of the I-like arm I1 with a pin. As shown at the right side in FIG. 4C, the I-like arm I1 is fixed to the front bar F1 by fitting an attachment plate 36 of the I-like arm I1 to upper and lower grooves 35 inside the front bar F1, and screwing a screw 342 to the attachment plate 36 from the bracket 34.

A spring (not shown) with appropriate elasticity is incorporated in the pivot position of either or both of the base end portion and the top end portion of the I-like arm. By the elastic biasing force of the spring, the I-like arm I1 rotates in the spreading direction and pushes the front bar F1 toward the corner space portion obliquely forward. Contrarily, to wind the protruded corner canvas G1, the I-like link I1 rotates against the elastic force toward the direction in which it falls down to collapse, and thus translates the front bar F1 toward the wall obliquely rearward.

As to Rectangular Awning Device

As to Canvas Take-Up Device

Next, a canvas take-up device for winding and unwinding a rectangular canvas P having a rectangular shape when exploded will be described based on FIGS. 4 to 6 and 9.

Reference numeral K2 refers to a casing for storing a wound rectangular canvas P, wherein a take-up roller 38 for winding the rectangular canvas P, having an identical diameter and an identical cross section as of the outer roller 12 is bearing supported therein. As shown in FIGS. 1A, 1B, 5A, and 5B, the casing K2 is directly attached to the outer wall W1 in a linear zone covering the latter half of the bottom of the casing K1 to extend rearward with the former half of the casing K2 overlapped substantially beneath the latter half of the bottom of the casing K1. Alternatively, the casing K2 may be indirectly fixed to the outer wall W1 via an appropriate supporting bracket (not shown) so that its frontward inclination angle is variably adjustable, if necessary.

The casing K2 is in a posture achieved by turning the casing K1 upside down, and thus has a canvas outlet 39 on its upper front surface, and also has both fore and rear end caps 40, 41 that are at positions vertically reversal to the end caps 14, 15. Thereby, the casing K2 is configured with common parts as of the casing K1.

In FIGS. 9A and 9B, reference numeral M2 refers to an electric motor inserted into the rear portion of the take-up roller 38 and rotatable forwardly and reversely. As is the case of the electric motor M1 described above, a motor output shaft 181 is protruded from its top end portion and a fixing shank 182 is protruded from its rear end portion, respectively.

Reference numeral 42 refers to a gear socket having a groove to be fitted to the inner peripheral surface of the take-up roller 38, and the motor output shaft 181 fits to an axial bore 181 of the socket 42. Reference numerals 43, 44 refer to end caps having grooves to be fitted to the fore and rear end portions of the take-up roller 38, respectively. Among them, a shank 431 of the end cap 43 at the top end portion of the take-up roller 38 is rotatably bearing supported by a bearing 401 of the end cap 40.

Reference numeral 441 refers to a circular hole formed at a center of the main body of the end cap 44, and a rear portion of the main body of the electric motor M2 is inserted into and supported by the circular hole 441.

Then, the electric motor M2 is inserted into the rear portion of the take-up roller 38 with the gearing socket 42 fitted to the motor output shaft 181. On the other hand, the end cap 44 is inserted into the rear portion of the main body of the electric motor M2, and the cap 44 is fitted to the rear end portion of the take-up roller 38, so as to fit and fix the shank 182 of the electric motor M2 to the bearing 401 of the end cap 40.

Thereby, when the electric motor M2 incorporated in the take-up roller 38 starts to drive, its output shaft 181 and gear socket 42 forwardly and reversely rotate integrally with the take-up roller 38.

Reference numeral 381 refers to a fitting groove formed on the take-up roller 38 in the axial direction. The canvas top side 5 of the rectangular canvas P is faced to the fitting groove 381 as shown in FIGS. 4A and 6, and is fixed thereto by inserting an attachment wire 45 into pouched passage of the canvas top side 5 to prevent the canvas top side 5 from slipping off.

The left top end portion of the rectangular canvas P is overlapped with the right rear portion of the exploded protruded corner canvas G1 at proper widths to be above and below each other.

As to Front Bar

Reference numeral F2 refers to a front bar for attaching the canvas bottom side 6 of the rectangular canvas P. Its front plate is shaped into an arcuate shape (or a perpendicular shape) substantially the same as of the front bar F1, and is shaped into a size slightly smaller than that of the front bar F1 so that the front bar F1 can be inserted into and supported by the front bar F2 to be slidably guided.

Reference numerals 461, 462 refer to an upper guide groove and a lower guide groove formed on an upper plate and a lower plate of the front bar F2, respectively. Among them, the projection of the upper fitting groove 291 of the front bar F1 is fitted to the upper guide groove 461, and the projection of the lower fitting groove 292 of the front bar F1 is fitted to the lower guide groove 462, respectively. Thereby, the inner front bar F2 also serves as a slide guide rail for the outer front bar F1.

Reference numerals 471, 472 refer to an upper fitting groove opened upward and a lower fitting groove opened downward. These grooves are formed longitudinally at stepped recessed corner portions formed at the latter half portions of the upper plate and the lower plate of the front bar F2.

Then, the canvas bottom side 6 of the rectangular canvas P is faced to the upper fitting groove 471 as shown in FIGS. 4A and 6, and is fixed thereto by inserting an attachment wire 48 into the pouched passage of the canvas bottom side 6 to prevent the canvas bottom side 6 from slipping off.

Reference numeral 49 refers to a front skirt hanging down from the front bar F2, the front skirt 49 being fixed to the front bar F2 by facing its upper edge portion to the lower fitting groove 472 and then inserting a wire 50 into the pouched passage formed in the front skirt 31 to prevent the front skirt 31 from slipping off.

Thereby, the canvas take-up device for the rectangular canvas P is configured.

The top end portion and the rear end portion of the extended rectangular canvas P are perpendicular canvas perpendicular sides 7, 8.

As to Swing Arm

Reference numerals V1, V2 refer to a pair of two bi-foldable swing arms in the shape of horizontally oriented letter V (hereinafter, referred to as V-like arms) for supporting the front bar F2 at its both the fore and rear positions. Each arm is comprised of a rear link 511 and a front link 512 connected to each other to be bi-foldable inward, and a spring or stretching wire (not shown) is incorporated into a bi-foldable connecting portion 513 to push and bias the V-like arms V1, V2 toward a stretching direction. Reference numeral 52 refers to a bracket for pivotally supporting the base end portions of V-like arms V1, V2, that is, the base end portions of the rear links 511 with a pin. The brackets 52 are attached on the outer wall W1 at positions below the vicinity of the opposite fore and rear end portions of the casing K2. Reference numeral 53 refers to brackets for pivotally supporting the front end portions of the V-like arms V1, V2, that is, the front end portions of the front links 512 with a pin 531. As shown in the left perspective view in FIG. 4C, the former half portion of the bracket 53 is raised to be a rising portion 532 substantially in the shape of letter L when seen from side, and the rising portion 532 is pressed against the back surface of the front bar F2.

Reference numeral 54 refers to attachment plates fitted to the back surface of the front bar F2 at positions in proximity to both the fore and rear end portions thereof. A screw 533 is screwed to the attachment plate 54 from the back surface of the rising portion 532, thereby pinching the bracket 53 with the front bar F2 to fix the bracket 53.

As to Effect of Composite Awning Device

Process of Winding Canvas

To store the extended composite device SQIII1 into a wall side, the electric motor M1 for the protruded corner canvas G1 and the electric motor M2 for the rectangular canvas P are synchronously driven to take up the canvases. Then, the composite device SQIII1 extended toward the corner space portion of the protruded corner portion N1 is stored by the wall surface as it changes its posture as shown in FIGS. 10A to 10D and 11A to D.

Specifically, when the take-up roller 38 is rotated by the electric motor M2 at one side to start taking up the rectangular canvas P, the front bar F2 at the front end portion of the canvas P is retracted toward the wall. At the same time, the V-like arms V1, V2 supporting the front bar F2 are gradually bi-folded inward against their elastic biasing force, and move linearly toward the wall surface in parallel with each other while keeping a winding-up balance.

Thereby, the rectangular canvas P is stored into the casing K1 as it is upper-wound by the take-up roller 38. In addition, the V-like arms V1, V2 are folded into compactly by the wall surface below the casing K1, and the front bar F2 is overlapped with the front surface of the casing K1 and is stored by the wall surface.

Further, the inner rotation shaft 11 and the outer roller 12 rotate integrally by the electric motor M1 at the other side to wind the canvas from bottom to top so that the face of the canvas top side 1 fixed to the outer roller 12 is wound inside and the rear face thereof outside. That is, the protruded corner canvas G1 is lower-wound.

Then, the I-like arm I1 supporting the front bar F1 rotates obliquely rearward against its elastic force, and at the same time, the front bar F1 is moved rearward as it is slidably guided in the axial direction of the front bar F2 which is being translated, so that the front bar F1 is translated obliquely rearward.

At this time, the tensioning force of the protruded corner canvas G1, that is, the stretching force by the connection wires 26, 27 inserted through the canvas G1 and extended between the outer roller 12 and the front bar F1 is transmitted to the outer roller 12, and then is vector-converted into the rearward sliding force, that is, the retracting force of the outer roller 12.

Thereby, the outer roller 12 moves rearward as it is slidably guided along the inner rotation shaft 11, and the canvas main body R1 of the protruded corner canvas G1 is gradually wound around the outer roller 12. Subsequently, the canvas extension R2 is wound around the external perimeter surface of the inner rotation shaft 11 exposed with the outer roller 12 moved rearward.

Thus, the protruded corner canvas G1 is wound around the take-up shaft J1 in the casing K1 so as to be stored therein, and the I-like arm I1 is folded by the wall beneath the casing K1 into a state where it falls down to collapse. In addition, the front bar F1 retracts to the vicinity of the midpoint of the front bar F2 and fitted and inserted therein, and is retracted to the position below the front surface of the casing K1 so as to be stored by the wall surface compactly.

In the foregoing case, in practical use, the connection wires 26, 27 play an important role for preventing distortion, in-plane deformation, or shrinkage of the canvas main body R1 which are assumed at the time of winding the protruded corner canvas G1, enabling smooth and regular winding of the protruded corner canvas G1 as well as ensuring its smooth rearward movement relative to the outer roller 12.

As to Process of Extending Canvas

To the contrary to the above, to extend the composite device SQIII1 along the periphery of the building including the corner space portion, the electric motor M1 of the take-up shaft J1 and the electric motor M2 of the take-up roller 38 are driven to rotate in the opposite direction from the above.

Then, the elastic biasing force of the I-like arm I1 and the V-like arms V1, V2 folded by the wall are released, and the I-like arm I1 and the V-like arms V1, V2 are rotated toward the spreading direction by the pressure biasing force. Thereby, the front bar F2 is pushed forward to be translated linearly, and expands forward the rectangular canvas P wound around the take-up roller 38 while unwinding it.

At the same time, the front bar F1 fitted and inserted into the front bar F2 is pushed to be translated obliquely forward as the front bar F1 is slidably guided along the axial direction thereof, so that the protruded corner canvas G1 wound around the take-up shaft J1 is expanded around the periphery of the building including the corner space obliquely forward as the protruded corner canvas G1 wound around the take-up shaft J1 is unwound.

Thus, two pairs of thus-structured composite devices SQIII1 are installed in the vicinity of the corner of the front wall W1 and in the vicinity of the side wall W2 in orthogonally (or at obtuse angle or acute angle) butted against each other as shown in FIGS. 1 and 2, and are extended independently and separately from each other or are extended interlockingly, so that the periphery of the building including the corner space of the protruded corner portion N1 is attractively covered.

As to Modified Embodiment

In the foregoing case, it is configured not to stand out the gap at the overlapped portions between the canvases G1 and P when expanded, by lower-winding the protruded corner canvas G1 and upper-winding the rectangular canvas P. Contrarily, where the protruded corner canvas G1 may be upper-wound and the rectangular canvas P may be lower-wound by changing the layer of the casing K2 of the rectangular awning device Q and the casing K1 of the protruded corner awning device S1 to be upside down.

Further, in the foregoing case, the front bar F1 for the protruded corner canvas G1 is located outside whereas the front bar F2 for the rectangular canvas P is located inside. Alternatively, this relationship may be reversed.

Further, in the foregoing case, it is configured that the front bar F1 for the protruded corner canvas G1 is slidably guided along the front bar F2 for the rectangular canvas P. Alternatively, this relationship may be changed so that they are guided while rolling as is the case of front bars E1, E2 shown in FIGS. 59A and 59B to 61A to 61C (whose details will be described later).

As to Embodiment of Driving Method

In the first embodiment, the description has been made as to the case where the electric motors M1, M2 of the protruded corner awning device S1 and the rectangular awning device Q are interlocked with each other. Alternatively, either one of their take-up shaft J1 and take-up roller 38 may be configured as a driven unit with a spring structure as shown in FIGS. 12 and 13 whereas the remaining may be configured as an electrically or manually driven unit, and these are then combined with each other.

Second Embodiment of Canvas Take-Up Shaft

Here, in the case where the electric motor M2 is incorporated into the take-up roller 38 of the rectangular canvas P shown in FIG. 9, or the take-up roller 38 is driven to rotate by a manual device (not shown) incorporated in the shaft end portion, a take-up shaft J2 with a spring structure such as shown in FIG. 12 is incorporated into the protruded corner awning device S1 which is a driven unit.

In FIG. 12, reference numeral 55 refers to a coil spring inserted into a latter half of the inner rotation shaft 11. Reference numeral 56 refers to a discoid Spring stopping socket having a hole 562 at its eccentric core position through which a top end portion 551 of the coil spring 55 is inserted and supported therein. A rear end 552 of the spring 55 is inserted into a hole 172 drilled at an eccentric core position on an end cap 17*a* and supported therein. Reference numeral 57 refers to a fix shaft for threading and supporting the coil spring 55, and threads the coil spring 55 from the center hole 170 of the end cap 17*a*. The shaft top end portion thereof 571 is fitted and fixed to the center hole 561 of the Spring stopping socket 56, and the shaft rear end portion thereof 572 is fitted and fixed to the center hole of the bearing 151 of the end cap 15, respectively.

Thus, when the take-up shaft J2 with a spring structure shown in FIG. 12 is driven to rotate as the electric motor M2 shown in FIG. 9 drives, the inner rotation shaft 11 rotates via the outer roller 12, so that the coil spring 55 is gradually compressed via the end cap 17*a* of said rotation shaft 11 to accumulate an elastic energy in said coil spring 55, or the stored elastic energy is released.

Specifically, at the time when winding of the protruded corner canvas G1 on the take-up shaft J2 is completed, the elastic energy is released with some preload remaining.

Contrarily to the above, as the protruded corner canvas G1 is expanded, an elastic energy is gradually accumulated in the coil spring 55, and the maximum elastic force is accumulated at the completion of expansion.

As to Second Embodiment of Take-Up Roller

Contrary to the foregoing embodiment, when the take-up shaft J1 is driven by the electric motor M1 shown in FIG. 7, or the take-up shaft J3 is driven by the manually driven unit shown in FIG. 14, a spring structure such as shown in FIG. 13 is incorporated in the take-up roller 38 which is a driven unit.

Specifically, when the coil spring 55 is inserted into the latter half of the take-up roller 38, and a top end 551 of the coil spring 55 is fitted and supported by a hole 562 drilled at an eccentric core position of a spring socket 56, and a rear end 552 of the coil spring 55 is fitted and supported by a hole 442 drilled at an eccentric core position of an end cap 44*a*, respectively.

Then, a fix shaft 57 is passed through the coil spring 55 from a center hole 440 of an end cap 44*a*. In addition, a shaft top end portion 571 of the fix shaft 57 is fitted and fixed to a center hole 561 of a Spring stopping socket 56, and a shaft rear end portion 572 thereof is fitted and fixed to a center hole of a bearing 411 of an end cap 41, respectively.

Thus, when the take-up roller 38 shown in FIG. 13 is driven to rotate as the electric motor M1 shown in FIG. 7 drives, the coil spring 55 is gradually compressed via the end cap 44*a* of said roller 38, and an elastic energy is accumulated in said coil spring 55 or the stored elastic energy is released.

Specifically, at the time when winding of the rectangular canvas P onto the take-up roller 38 is completed, the elastic energy is released with some preload remaining.

Contrarily to the above, as the rectangular canvas P is expanded, an elastic energy is gradually accumulated in the coil spring 55, and the maximum elastic force is accumulated at the time when the expansion of the rectangular canvas P is completed.

Thus, when one is structured as an electrically or manually driven unit, and the other is combined with either one of the take-up roller J2 and the take-up shaft 38 provided with the core spring 55, a proper elastic biasing force can be always exerted at the time when the take-up shaft J2 or the take-up roller 38 as a driven unit is operated for winding the canvases and they are operated for unwinding to expand the canvases. Thereby, a shortage of tensioning force is supplemented to prevent the occurrence of a trouble that winding of the canvases G1, P at the driven sides is finished with the canvases G1, P loose or the canvases G1, P at the driven sides are expanded insufficiently when they are unwound, or a tensioning force is adjusted by giving a buffering effect when the tensioning force becomes too strong beyond necessity.

Similarly, when the take-up shaft J1 and the take-up roller 38 are synchronously driven by the electric motors M1, M2 to wind or unwind to expand the canvases G1, P, in effect, the occurrence of trouble is assumed that winding or unwinding for expansion of either one of the canvases becomes insufficient, or contrarily, the tensioning force for either one of the canvases G1, P becomes too much stronger than the other.

To address such a trouble, the coil spring 55 or a helical spring (not shown) is incorporated in the take-up shaft J1 shown in FIG. 7 or the take-up roller 38 shown in FIG. 9. Thereby, the shortage of tensioning force can be supplemented or the tensioning force can be properly reduced and buffered to adjust tensioning force.

As to Manual Device

Instead of the synchronous driven units by the electric motors M1, M2 described above, for example, the take-up shaft J3 for the protruded corner canvas G1 may be configured into a manual structure as shown in FIG. 14. Thus-structured take-up shaft J3 may be combined with the take-up roller 38 with a spring structure shown in FIG. 13.

In FIG. 14, reference numeral 58 refers to a worm gear fitted and fixed to a support shaft 161 of an end cap 16. Reference numeral 59 refers to a worm to be meshed with the worm gear 58. A worm rotation shaft 60 of the worm 59 is perpendicularly bearing supported by an end cap 14, and a hook 601 is formed on the lower end portion of the worm rotation shaft 60.

In this case, when an operation handle (not shown) is engaged with the hook 601 and the take-up shaft J3 is manually operated to rotate, an inner rotation shaft 11 and an outer roller 12 integrally rotate via the meshed gears 58, 59. The process of subsequent operation is substantially the same as the above, and its description is omitted.

As to Casing

In the first embodiment, the casing K1 of the protruded corner canvas G1 and the casing K2 of the rectangular canvas P are installed in a state where the casing K2 is overlapped beneath the linear zone in proximity to the latter half of the casing K1 to cover its rearward bottom portion. Alternatively, either one of the take-up shafts J1 to J3 and either one of the take-up rollers 38 shown in FIGS. 9 and 13 may be incorporated into an integral casing K3 shown in FIGS. 15A and 15B.

In FIGS. 15A and 15B, end caps 14*a*, 15*a* are fitted to both the fore and rear end portions of the casing K3. On the internal upper side within the casing K3, the inner rotation shaft 11*a* of either one of the take-up shafts J1 to J3 is extended rearward and is bearing supported. On the internal lower side within the casing K3, either one of the take-up rollers 38 shown in FIGS. 9 and 13 is bearing supported, and the top end portion of said take-up roller 38 is supported by an intermediate bearing 40*a*. Reference numeral 13*a* refers to an outlet opened at a midpoint on the front surface of the casing K3 for withdrawing the protruded corner canvas G1 and the rectangular canvas P.

As to Interlocking Configuration

By the way, when either one of the take-up shafts J1 to J3 and the take-up roller 38 are incorporated in the integral casing K3 as shown in FIGS. 15A and 15B, the rear end portions of the take-up shaft and the take-up roller may be in an interlocking configuration by means of spur gears 61, 62 such as shown in FIG. 16C.

In this case, one of the protruded corner awning device S1 and the rectangular awning device Q is in an electrically or manually driven structure, and the remaining is driven to rotate via the meshed spur gears 61, 62.

In FIGS. 17A and 17B, reference numeral 63 refers to a corner cap for two casings K3 faced to each other at the protruded corner portion N1. Among them, in the case shown in FIG. 17A, an oblique teeth gear 64 (or bevel gear) is fitted to a top end portion of the inner rotation shaft 11*a* of the respective take-up shafts J1, J2 placed in one and the other sides of the protruded corner portion N1 to be faced to each other, so that the take-up shafts J1, J2 are interlocked with each other. In the case of FIG. 17B, a worm gear 58 is fitted to the top end portion of the respective inner rotation shafts 11*a* placed to be butted against each other, and the gear 58 and the worm 59 are meshed with each other and manually driven to interlock two take-up shafts J2, J3 located to be butted against each other. Alternatively, the take-up roller 38 of the rectangular canvas P is interlocked with the inner rotation shaft 11*a* via the meshed spur gears 61, 62 shown in FIG. 16C.

Further, as shown in FIGS. 56A and 56B, a rotation shaft 37 of the take-up roller 38 of the rectangular canvas P is extended to reach the corner end portion of the protruded corner portion N1. Then, a worm gear 58*a* is fitted to the top end portion of the respective rotation shafts 37 butted against each other, and a worm 59*a* capable of meshing with the worm gears 58*a* is fitted to a rotation shaft 60 so that the worms 58*a* and 59*a* are meshed and engaged with each other. Thereby, two take-up shafts J2, J3 butted against each other at one side and the other side on the upper side are interlocked with two take-up rollers 38 abutted against each other on the lower side by a double manual interlocking structure to be forwardly and reversely rotatable.

Second Embodiment

In FIGS. 18A, 18B, 19A to 19D showing a composite device SQIII2 of a second embodiment, reference numeral 65 refers to a connection rod 65. A top end portion 651 of the connection rod 65 is pivotally supported with a pin at a midpoint of an I-like arm I1, whereas a rear end portion 652 thereof is pivotally supported with a pin at a bi-foldable connecting portion 513 of a V-like arm V1 located at a midpoint of the device. The connection rod 65 is attached in parallel with front bars F1, F2.

In the structure where the connection rod 65 is connected to the I-like arm I1 and the V-like arm V1 as described above, when the respective canvases P, G1 are wound or unwound, the folding movement and the extending movement of the V-like arms V1, V2 of the rectangular awning device Q are structurally assuredly synchronized with the collapsing movement and the extending movement of the I-like arm I1 of the projected corner awning device S1, so that the arms are folded as they change their postures as shown in FIGS. 19A to 19D.

In this regard, in the case of the composite device SQIII1 of the first embodiment, the movement of the front bar F1 of the protruded corner awning device S1 relies, in fact, on the tensioned states of the protruded corner canvas G1 and the connection wires 26, 27. Contrarily, the connection rod 65 incorporated as described above ensures the obliquely parallel movement of the front bar F1 to follow the parallel movement of the front bar F2 of the rectangular awning device Q, so that winding and unwinding of the protruded corner canvas G1 can be smoothly achieved.

The other structures are the same as of the composite device SQIII1 of the first embodiment, and thus, their description is omitted.

Third Embodiment

In FIGS. 20 to 22 showing a composite device SQIII3 of a third embodiment, reference numeral Y1 refers to a swing arm in the shape of a reversed letter y when seen from above (hereinafter, referred to as a Y-like arm) expandably supported with a bias. The Y-like arm includes a main link 66 having substantially the same length as of the I-like arm I1, and a sub-link 67 pivotally supported with a pin in the vicinity of a midpoint of the main link 66 and having a length substantially half of the main link 66.

The composite device SQIII3 has a structure in which the V-like arm V1 incorporated into a midpoint of the composite device SQIII1 of the first embodiment, that is, incorporated into a top end portion of the rectangular awning device Q, is replaced by the Y-like arm Y1.

Then, the front end portion of the sub-link 67 of the Y-like arm Y1 is attached to the bracket 53 fixed in the vicinity of the top end portion of the front bar F1. A shaft pin 661 is provided at a vertically standing-up posture at the front end portion of the main link 66 as shown in FIGS. 21A and 21B. A bracket 68 is horizontally rotatably supported by the shaft pin 661 with the bracket 68 attached to be slidably guided along the front bar F2. Specifically, the front surface of the bracket 68 is formed into the shape of the letter L when seen from side to create a vertically stand-up rising portion 681. The upper and lower surfaces of the rising portion 681 are pressed against upper and lower flanged edges 481, 482 provided at the back surface of the front bar F2. Further, a center protrusion of the rising portion 681 is fitted to an opening of the back surface of the front bar F2. Then, screws 691 are screwed to an attachment plate 69 fitted inside the front bar F2 toward the rising portion 681, so that the attachment plate 69 is fixed for retention. Specifically, the upper and lower flanged edges 481, 482 are pinched and fixed between the front surface of the rising portion 681 of the bracket 68 and the attachment plate 69. Then, the upper and lower flanged edges 481, 482 formed on the back surface of the front bar F2 are fitted to the rail grooves formed above and below the rising portion 681 and the attachment plate 69 so that the flanged edges 481, 482 slide along the rail grooves.

Reference numeral 70 refers to a rod fitted and inserted to a fitting groove 292 formed at a rear side of the front bar F1. Screws 701 are screwed from the underside of a receiving stand 682 of the bracket 68, so that the bottom of the rear end portion of the front bar F1 is fixed.

Thereby, the bracket 68 at the front end portion of the main link 66 is stably slidably guided relative to the front bar F2, so that the front bar F1 for the protruded corner canvas G1 is moved forward and rearward.

A spring (not shown) having appropriate spring elasticity is incorporated into a pivot shaft of either one or both of the base end portion and the front end portion of the main link 66. The spring biasing force of the spring biases the main link 66 to rotate in the spreading direction so as to push the front bar F1 toward the corner space portion. Further, a spring or stretching wire (not shown) is incorporated into a bi-foldable connecting portion between the link rear portion of the main rink 66 and the sub-link 67 so as to bias and push the connecting portion in a stretching direction. When the rectangular canvas P and the protruded corner canvas G1 are wound, as shown in FIGS. 22A to 22D, the V-like arm V2 at the rear end portion of the device, and the link portion of the Y-like arm Y1 at the midpoint of the device, comprised of the link latter-half portion of the main link 66 and the sub-link 67, are bi-folded against the elastic biasing force of the spring incorporated in the bi-foldable connecting portion. Further, the I-like arm I1 and the main link 66 attached in parallel with each other are rotated to be translated obliquely rearward against the elastic biasing force of the spring incorporated in their respective base end portions.

At this time, the front end portion of the main link 66 is slidably guided along the front bar F2 via the bracket 68, and is moved rearward in the axial direction of the front bar F2 with the rear end portion of the front bar F1 fixed.

Thereby, both the canvases G1, P of the composite device SQIII3 are wound around their respective take-up shafts J1 to J3 and the take-up roller 38, and at the same time, the entire device is folded compactly and stored by the wall.

As describe above, the Y-like arm Y1 incorporated in the midpoint of the device ensures the front bar F1 to be always moved in parallel with the front bar F2, and also ensures the front bar F1 to be slidably guided in the axial direction thereof and to be translated rearward and obliquely frontward.

The other structures are the same as of the first embodiment, and thus, their description will be omitted.

Fourth to Eighth Embodiments

Figure 23A:
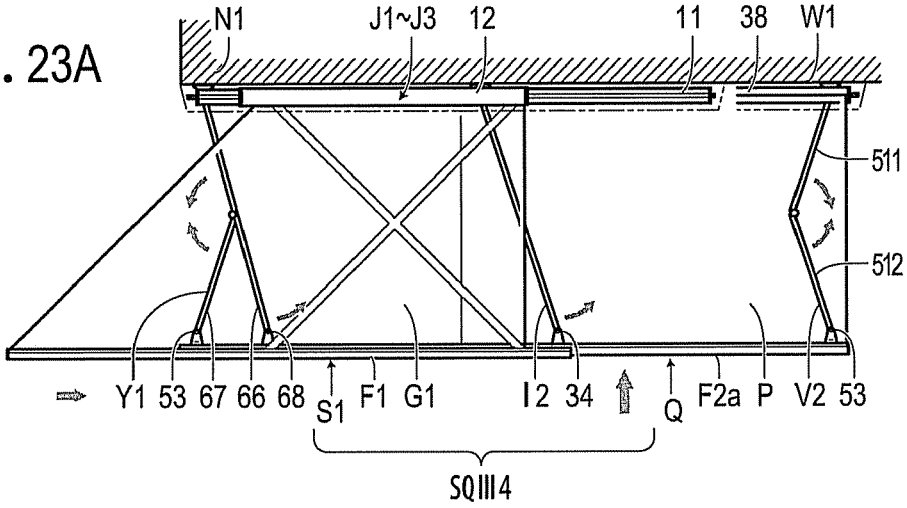

A composite device SQIII4 of a fourth embodiment shown in FIG. 23A corresponds to a case where the attached positions of the I-like arm I1 at the top end portion of the composite device SQIII3 of the third embodiment and the Y-like arm Y1 at the midpoint thereof are exchanged with each other. Specifically, a Y-like arm Y1 is attached to the leftward top end portion of the device; an I-like arm I2 is attached to the midpoint of the device; and a V-like arm V2 is attached at a rightward rear portion of the device.

Then, a bracket 53 at a front end portion of a sub-link 67 of the Y-like arm Y1 is fixed to the top end portion of a front bar F2*a* extended toward the leftward top end portion into a length longer than that of the foregoing embodiment. Thus, a bracket 68 at a front end portion of a main link 66 is supported on the back surface of the front bar F2*a* to be slidably guided as shown in FIG. 21B, and at the same time, is also connected and fixed to the bottom in the vicinity of the midpoint of the front bar F1. Further, a bracket 34 of a front end portion of an I-like arm I2 in parallel with the main link 66 is connected and fixed to the rear end portion of the front bar F1.

As a matter of course, a spring for biasing the front bar F1 toward a pushing direction is incorporated into the base end portion of the main link 66 of the Y-like arm Y1 and the base end portion of the I-like arm I2. Further, a spring or wire is incorporated into the bi-foldable connecting portion between the midpoint of the main link 66 and the sub-link 67 and the bi-foldable connecting portion of the V-like arm V2.

A canvas bottom side 6 of the rectangular canvas P is attached to the latter half of the front bar F2*a* as shown in FIGS. 25A and 25B. If necessary, cross passages 24*a*, 25*a* are formed into the shape of letter X when seen from top on the main body of the canvas P, in order to prevent the in-plane deformation thereof. The opposite end portions of the connection wire (not shown) passed through the cross passages 24*a*, 25*a* are attached to a take-up roller 38 and the front bar F2*a*. Alternatively, as shown in FIG. 25B, a connection wire is passed through pouched passages 24*b*, 25*b* formed into the shape of letter V when seen from top and the opposite ends thereof are attached to the take-up roller 38 and the front bar F2*a* to tension and support the rectangular canvas P.

Figure 23B:
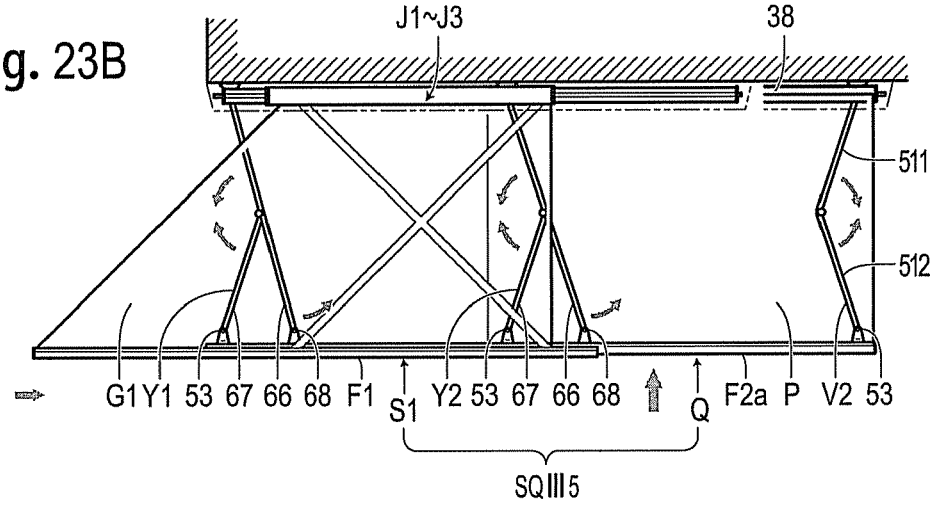

A composite device SQIII5 of a fifth embodiment shown in FIG. 23B corresponds to a case where the I-like arm I1 at the top end portion of the composite device SQIII3 of the third embodiment is replaced by a Y-like arm Y1, or alternatively, to a case where the I-like arm I2 at a midpoint of the composite device SQIII4 of the fourth embodiment is replaced by a Y-like arm Y2.

Then, Y-like arms Y1, Y2 are attached to the top end and midpoint of the device, respectively, and a V-like arm V2 is attached to the rear end portion of the device. Among them, brackets 53 at front end portions of sub-links 67 of the Y-like arms Y1, Y2 are fixed to a top end and a midpoint of the extended front bar F2*a*, respectively. Brackets 68 at front end portions of main links 66 are supported to be slidably guided along the back surface of the front bar F2*a*, and are also fixed to a midpoint and rear end portion of the front bar F1, respectively.

Figure 23C:
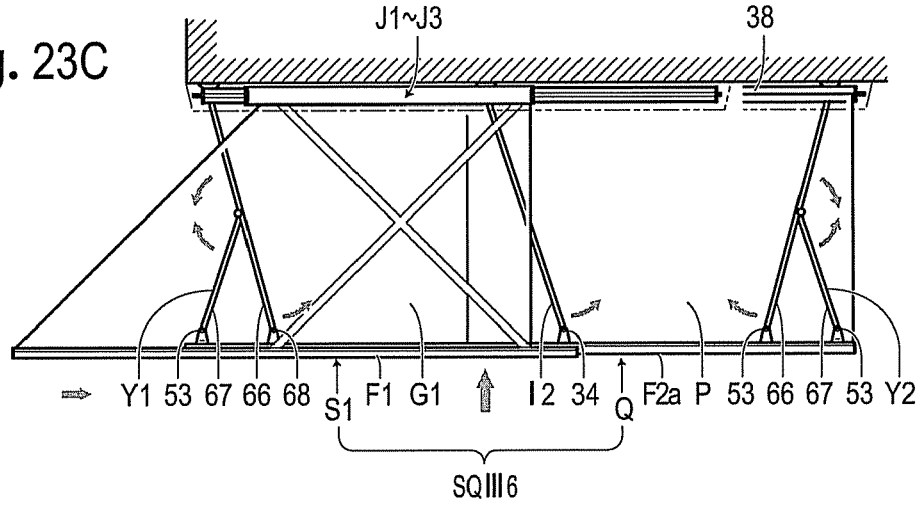

A composite device SQIII6 of a sixth embodiment shown in FIG. 23C is structured by replacing the V-like arm V2 at the rear end portion of the composite device SQIII4 of the fourth embodiment by a Y-like arm Y2.

An I-like arm I2 is attached to a midpoint of the device, and Y-like arms Y1, Y2 are attached to a top end and a rear end portion of the device to be symmetric to each other at fore and rear positions. Among them, a bracket 53 at the front end portion of the main link 66 of the Y-like arm Y2 at the rear end portion of the device is attached to be simply slidably guided along the back surface of the front bar F2*a*.

Among the Y-like arms Y2, the bracket 53 at the front end portion of the sub-link 67 is usually attached on the back surface of the front bar F2 as shown in FIG. 4C.

On the other hand, the bracket 53 at the front end portion of the main link 66 is comprised of the same parts as of the bracket 53. However, as is the case of the bracket 68 shown in FIGS. 21A and 21B, the upper and lower flanged edges of the back surfaces of the front bar F2 are pinched and fixed between the front surface of the rising portion 532 of the bracket 53 and the attachment plate 54 to form rail grooves above and below the rising portion 532, so that these upper and lower flanged edges serve as guide rails. Thereby, the bracket 53 at the front end portion of the main link 66 is slidably guided along the front bar F2.

Figure 24A:
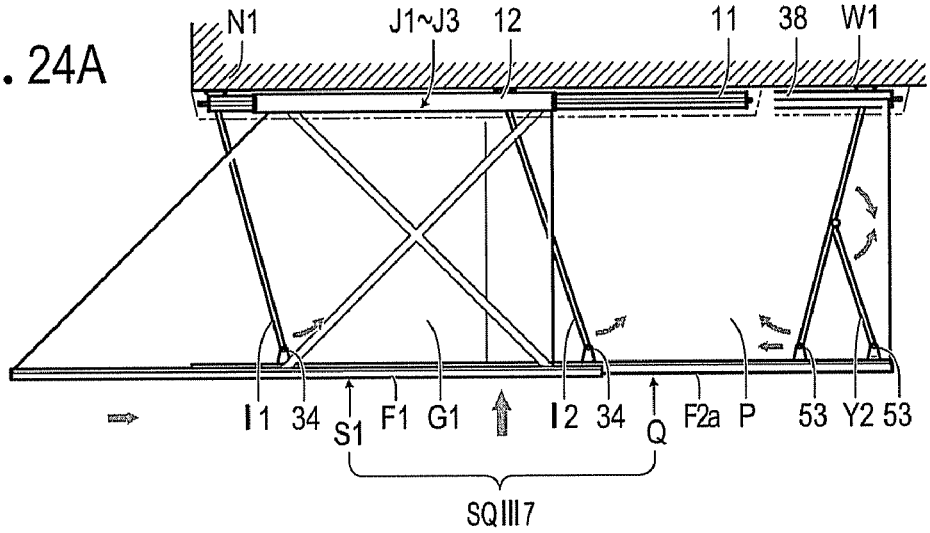
Figure 24B:
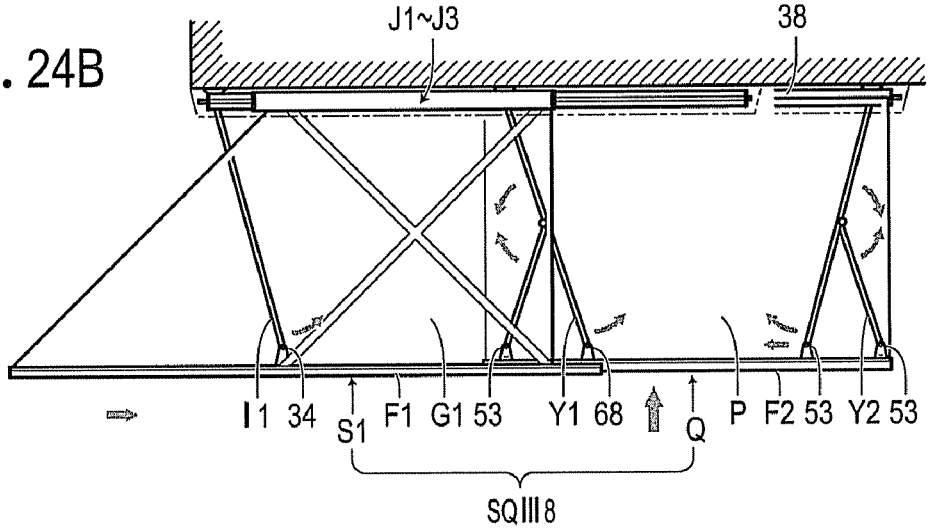
Figure 24C:
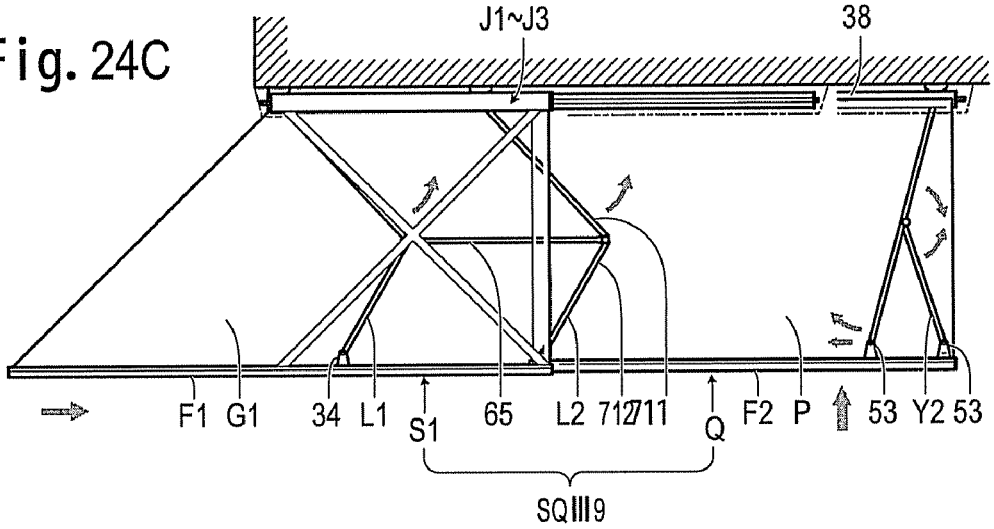
Figure 24D:
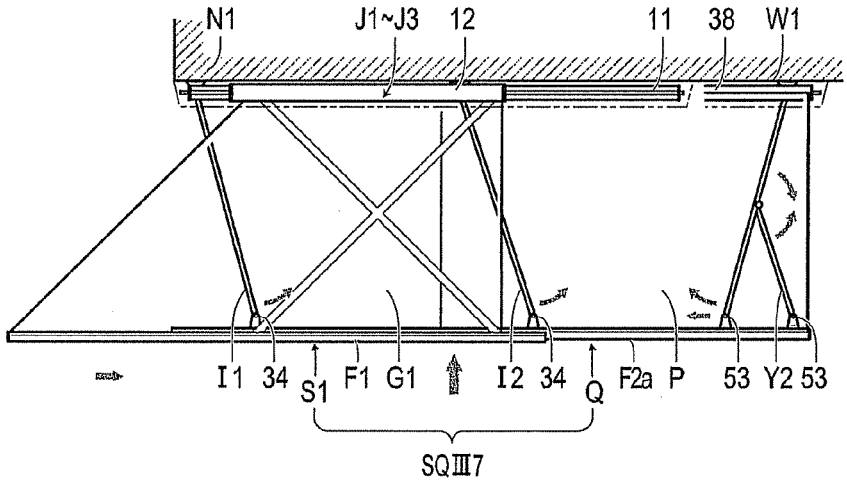

A composite device SQIII7 of a seventh embodiment shown in FIG. 24D is structured by replacing the Y-like arm Y1 at the top end portion of the composite device SQIII6 of the sixth embodiment by an I-like arm I1.

Two I-like arms I1, I2 are attached to a top end and a midpoint of the device to be parallel to each other, and a Y-like arm Y2 is attached to a rear end portion of the device. Among them, brackets 34 at the front end portions of the I-like arms I1, I2 are fixed to the vicinity of a midpoint and to a rear end portion of the front bar F1.

Figure 24E:
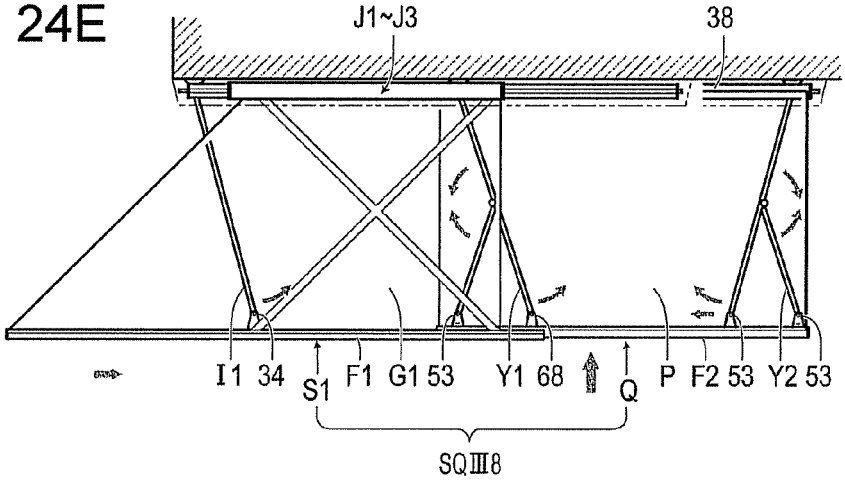

A composite device SQIII8 of an eighth embodiment shown in FIG. 24E corresponds to a case where the V-like arms V1, V2 of the composite device SQIII1 of the first embodiment are replaced by Y-like arms Y1, Y2; or alternatively, to a case where the V-like arm V2 at the rear end portion of the composite device SQIII3 of the third embodiment by a Y-like arm Y2; or still alternatively, to a case where the I-like arm I2 at a midpoint of the composite device SQIII7 of the seventh embodiment by a Y-like arm Y1, respectively.

An I-like arm I1 is attached to a top end portion of the device, and Y-like arms Y1, Y2 are symmetrically attached to a midpoint and a rear end portion of the device, respectively.

In the composite devices SQIII 4 to 7 of the fourth to seventh embodiments, the front bar F2*a* is extended into a length longer than the front bar F2 shown in the first to third and eighth embodiments without going beyond the end portion of the protruded corner portion N1.

Ninth Embodiment

Figure 24F:
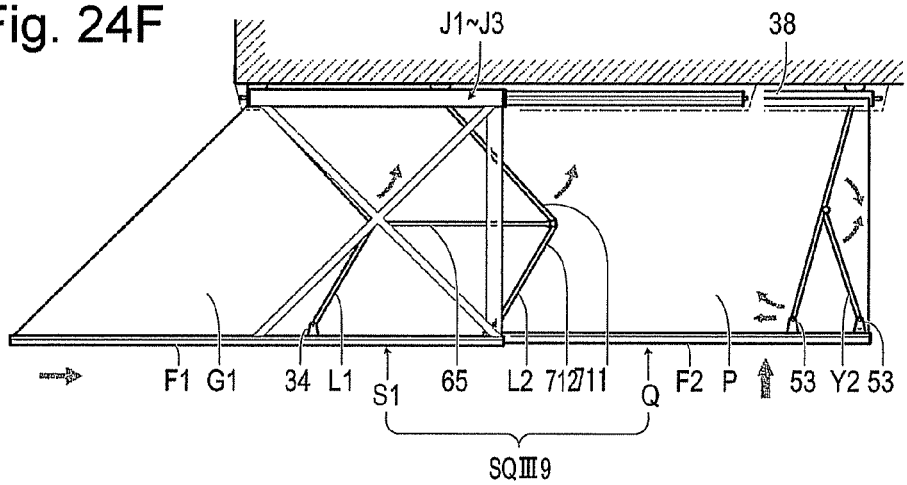

A composite device SQIII9 of a ninth embodiment shown in FIG. 24F is structured by replacing two I-like arms I1, I2 of the composite device SQIII7 of the seventh embodiment by L-like arms L1, L2. Two swing arms L1, L2 (hereinafter referred to as L-like arms) inclined into the shape of reversed letter L that expand and contract in two phases are attached to a top end and a midpoint of the device to be linked with each other. Further, a Y-like arm Y2 is attached to the rear end portion of the device. Each of the L-like arms L1, L2 is comprised of a rear link 711 and a front link 712, and a connection rod 65 is connected at their bi-foldable connecting portion in parallel with the front bar F1.

Then, brackets pivotally provided at front end portions of the L-like arms L1, L2 are fixed to a midpoint and a rear end portion of the front bar F1, respectively. A spring (not shown) with relatively weak spring elastic force is incorporated into a bracket 33 at a base end portion of the rear link 711. On the other hand, a spring (not shown) with relatively strong spring elastic force is incorporated into a bending connecting portion between the rear link 711 and the front link 712.

Figure 32A:
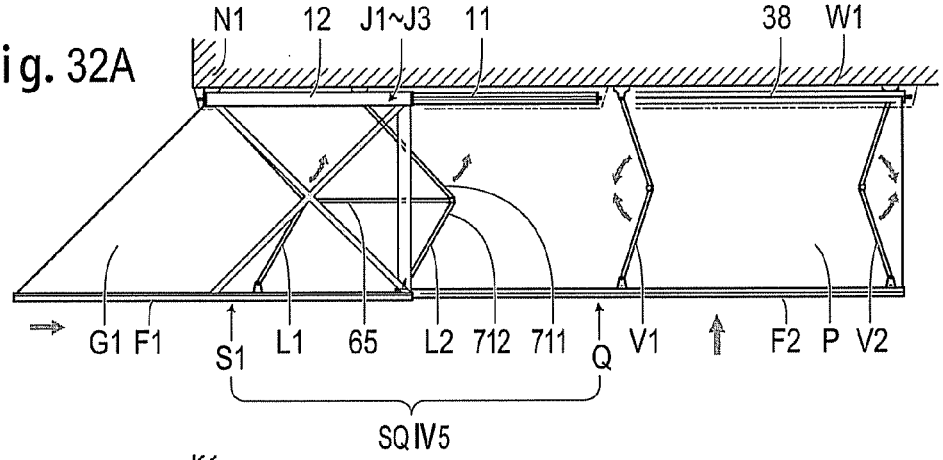
Figure 32B:
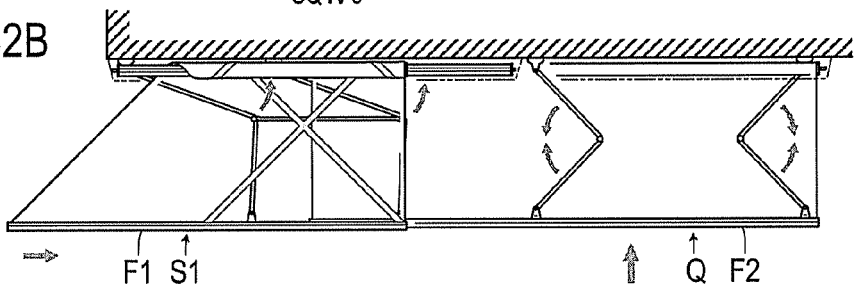
Figure 32C:
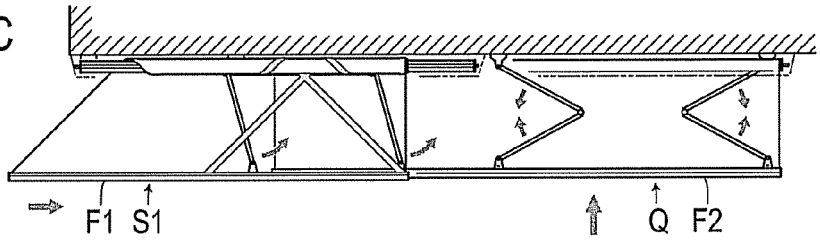

To wind the protruded corner canvas G1 around the take-up shafts J1 to J3 of the composite device SQIII9, firstly, a pair of rear links 771 of the L-like arms L1, L2 biased with relatively weak spring elastic force and the connecting rod 61 are translated to rotate rearward against the elastic biasing force, so that these rear links 771 and the connecting rod 61 are folded by the wall (see FIGS. 32A to 32C).

Figure 32D:
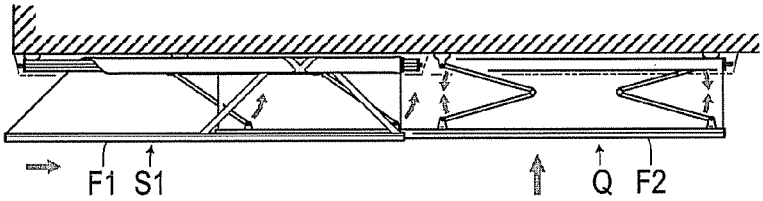
Figure 32E:
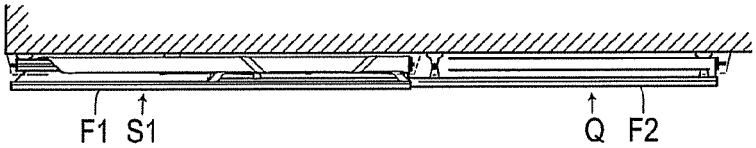

Further, as the take-up shafts J1 to J3 rotate, secondly, a pair of front links 772 of the L-like arms L1, L2 biased by relatively strong spring elastic force and their front bar F1 are translated to rotate rearward against the elastic biasing force, so that the front links 772 is stretched rearward the rear link 771 substantially linearly and stored (see FIGS. 32C to 32E).

As a matter of course, the rectangular canvas P is wound around the take-up roller 38 as a result that the Y-like arm Y2 is bi-folded to translate the front bar F2. Further, the protruded corner canvas G1 is wound around an outer roller 12 and an inner rotation shaft 11 that is exposed as the outer roller moves rearward, as the L-like arms L1, L2 expand and contract in two phases.

Tenth Embodiment

Next, a composite device SQII1 shown in FIGS. 26A and 26B including two swing arms will be described as a tenth embodiment.

The composite device SQII1 includes a Y-like V1 arm in the vicinity of a corner end portion of protruded corner portion N1, that is, at a top end portion of the device, whereas a V-like arm V2 is attached to the rear portion of the device. A bracket 53 at the front end portion of the sub-link 67 of the Y-like arm Y1 is fixed to the top end portion of the front bar F2*a* extended to the top end portion of the device as shown in FIG. 27A.

In FIG. 27B, reference numeral 72 refers to an engagement piece protruded rearward from the vicinity of the midpoint of the bottom on the back surface of the front bar F1. The engagement piece 72 is formed with a long hole 721. Then, a shaft pin 661 raised at a front end portion of the main link 66 of the Y-like arm Y1 is idly engaged and supported in the long hole 721. The composite device SQII1 is in the same structure as of the composite device SQIII4 of the fourth embodiment, except that the I-like arm located at the midpoint of the device is eliminated, and also in the same structure as of the composite device SQIII5 of the fifth embodiment, except that the Y-like arm Y2 at the midpoint of the device is eliminated. The composite device SQII1 is folded or stretched while changing its posture as shown in FIGS. 28A to 28C and 29A to 29D.

In the third, fourth to sixth, and eighth embodiments described above, the brackets 68 of the main links 66 of the Y-like arms Y1, Y2 are supported to be slidably guided along the front bars F2, F2*a* as shown in FIGS. 21A and 21B, and at the same time, are connected and fixed to the front bar F1 to enable the front bar F1 to smoothly and assuredly move forward and rearward relative to the front bar F2, F2*a*. Contrarily, in the tenth embodiment, the smooth and assured forward and rearward movement of the front bar F1 is achieved by a simple structure in which the shaft pin 661 of the front end portion of the main link 66 is idly engaged with the engagement piece 72 of the front bar F1. Thus, in the tenth embodiment, the bracket 68 shown in FIGS. 21A and 21B may be alternatively incorporated instead of the engagement piece 72.

Eleventh Embodiment

In a composite device SQII2 of an eleventh embodiment shown in FIGS. 30A and 30B, reference numeral 37 refers to a rotation shaft of a take-up roller 38. This rotation shaft 37 is extended to the point in proximity to immediately above a bracket 52 of a base end portion of a Y-like arm Y1 provided to a top end portion of the device. Reference numeral 73 refers to a narrow-width take-up roller fitted and fixed to the top end portion of the rotation shaft 37, whereas reference numeral 74 refers to a narrow-width synchronized belt. The base end portion of the synchronized belt 74 is fixed to the roller 73 and the front end portion of the synchronized belt 74 is fixed to the upper edge portion in the vicinity of the top end portion of the front bar F2*a*.

The belt winding device operates in synchronization with a take-up roller 38 for a rectangular canvas P, so that application of irregular load P to the rectangular canvas P is prevented during when it is wound, and a front bar F2*a* can be translated forward and rearward smoothly and assuredly with good balance, without being tilted. Contrarily, if an inner rotation shaft 11 of the respective take-up shafts J1 to J3 of a protruded corner canvas G1 is extended to the rear portion of the device, and a synchronized belt (not shown) is bridged between the shaft end portion of the inner rotation shaft 11 and the rear end portion of the front bar F2*a*, uneven winding can be also prevented.

Obviously, the take-up roller 38 itself may be extended to the top end portion of the device, and the rectangular canvas P may be attached over the full lengths of thus-extended long roller (not shown) and the front bar F2*a*. In this case, there is no need of a belt-winding device comprised of a take-up roller 73 and a synchronized belt 74.

In the composite devices SQII1, SQII2 of the tenth and eleventh embodiments respectively, the V-like arm V2 located at the rear end portion of the respective devices may be replaced by the Y-like arm Y2 as of the fourth to ninth embodiments. In this case, the front end portion of the main link 66 of the Y-like arm Y2 at the rear end portion of the device is attached to be slidably guided to the bracket 53 shown in FIGS. 27A and 4C. Thereby, the linear frontward and rearward mobility of the front bar F2*a* in parallel direction is enhanced.

Twelfth to Sixteenth Embodiments

FIGS. 31A to 31D and 32A show composite devices SQIV1 to SQIV5 of first type, each including four swing arms. General structures of these devices will be sequentially described by way of twelfth to sixteenth embodiments.

Figure 31A:
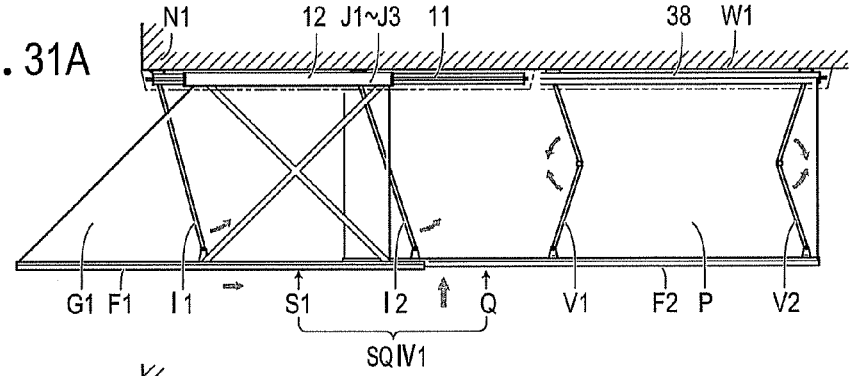

A composite device SQIV1 of a twelfth embodiment shown in FIG. 31A includes two V-like arms V1, V2 located symmetrically at fore and rear positions. The front end portions of the V-like arms V1, V2 are attached to the vicinity of a midpoint and to the rear end portion of a front bar F2 of a rectangular canvas P, respectively. Front end portions of two parallel I-like arms I1, I2 are attached to the vicinity of a midpoint and to the rear end portion of a front bar F1 for a protruded corner canvas G1, respectively.

When the protruded corner canvas G1 and the rectangular canvas P are synchronously wound or unwound, the front bar F2 at one side is translated forward and rearward, whereas the front bar F1 at the other side is translated obliquely rearward or is translated obliquely frontward as it is slidably guided by the front bar F2.

Figure 31B:
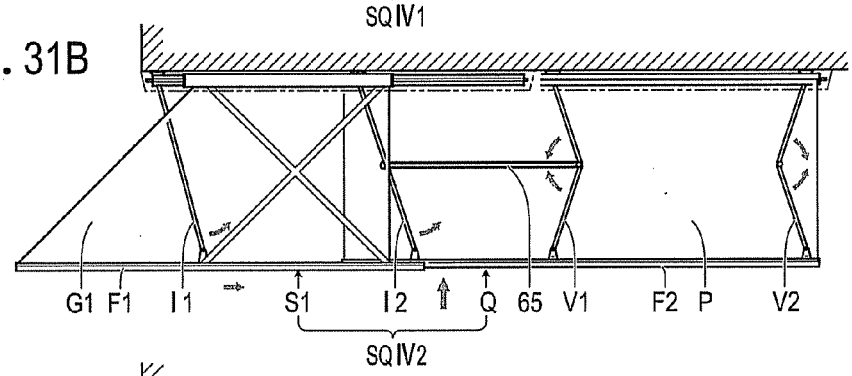

A composite device SQIV2 of a thirteen embodiment shown in FIG. 31B basically has the same structure as of the composite device SQIV1 of the twelfth embodiment, except that the midpoint of the I-like arm I2 is connected with the bi-foldable connecting portion of a V-like arm V1 by a connection rod 65 to be parallel with the front bars F1, F2.

Thereby, the interlocking property on the mechanism is ensured at the time when the swinging arms are folded and extended.

Figure 31C:
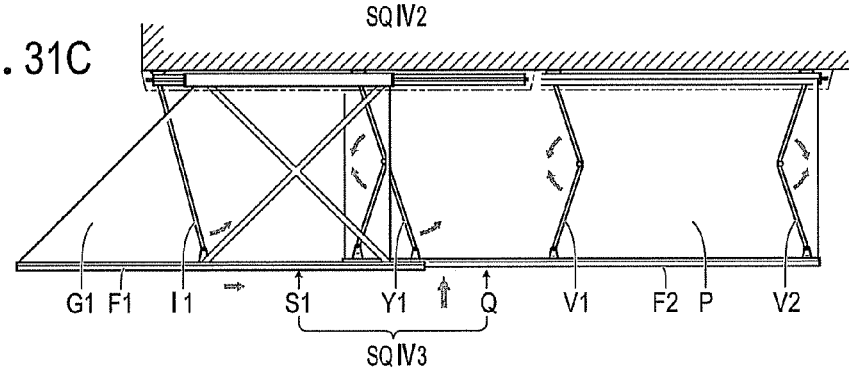

A composite device SQIV3 of a fourteenth embodiment shown in FIG. 31C basically has the same structure as of the composite device SQIV1 of the twelfth embodiment, except that the I-like arm I2 of the composite device IV1 is replaced by a Y-like arm Y1 comprised of a main link 66 and a sub-link 67. A front end portion of the sub-link 67 is attached to a top end portion of a front bar F2 for the rectangular canvas P, whereas a front end portion of the main link 66 is attached to the rear end portion of the front bar F1 for the protruded corner canvas G1 and is also attached to the front bar F2 to be slidably guided.

At this time, the front end portion of the main link 66 is connected to be supported by the front bars F1, F2 via a bracket 68 shown in FIGS. 21A and 21B, or alternatively, is engaged to be supported idly as shown in FIG. 27B.

Thereby, the straightforward movement property of the front bar F2 in forward and backward directions is enhanced at the time of winding and unwinding the rectangular canvas P, and the interlocking property of the mechanism is enhanced at the time of folding and extending the swing arms.

Figure 31D:
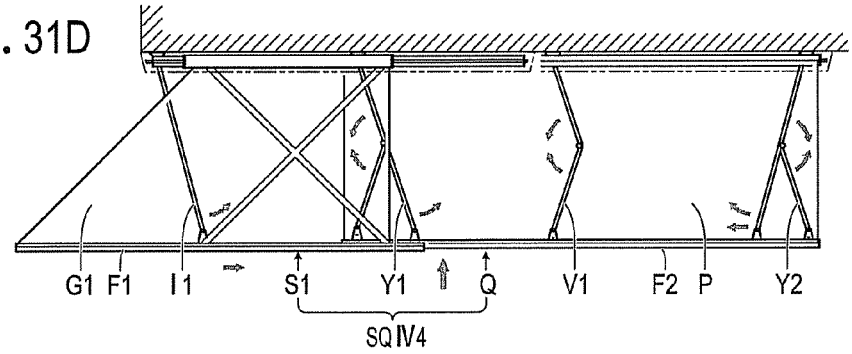

A composite device SQIV4 of a fifteenth embodiment shown in FIG. 31D basically has the same structure as of the composite device SQIV3 of the fourteenth embodiment, except that the V-like arm V2 at the rear end portion of the device is replaced by an Y-like arm Y2.

In other words, the composite device SQIV4 is structured by replacing the I-like arm I2 and the V-like arm V2 of the composite device SQIV1 of the twelfth embodiment by Y-like arms Y1, Y2 each comprised of a main link 66 and a sub-link 67 located at symmetrically fore and rear positions.

Front end portions of the sub-links 67 of the Y-like arms Y1, Y2 are attached to the front end portion and the rear end portion of the front bar F2 for the rectangular canvas P, respectively. Then, a front end portion of the main link 66 of the Y-like arm Y1 located in the vicinity of the top end portion of the front bar F2 is attached to the rear end portion of the front bar F1 for the protruded corner canvas G1 and is also attached to the front bar F2 to be slidably guided. Further, a front end portion of the main link 66 of the Y-like arm Y2 in the vicinity of the rear end portion of the front bar F2 is attached to the front bar F2 to be slidably guided.

In this manner, the straightforward movement property of the front bar F2 in the forward and backward directions at the time of winding and unwinding a rectangular canvas P is further enhanced, and the interlocking property of the mechanism at the time of operating the swing arms is enhanced.

A composite device SQIV5 of a sixteenth embodiment shown in FIG. 32A has a structure in which a front bar F1 for a protruded corner canvas G1 is supported by two parallel L-like arms L1, L2 that expand and contract in two phases, and a front bar F1 for a rectangular canvas P is supported by V-like arms V1, V2.

In this case, a rectangular awning device Q winds or unwinds as in the case of the composite device SQIII1 of the first embodiment. Further, a protruded corner awning device S1 winds a protruded corner canvas G1 around canvas take-up shafts J1 to J3 as in the case of the composite device SQIII9 shown in FIG. 24F where a rear link 711 and a front link 712 of the respective L-like arms L1, L2 are folded in two phases to change their postures stepwise as shown in FIGS. 32A to 32E.

Specifically, to wind the protruded corner canvas G1 expanded as shown in FIG. 32A around the canvas take-up shafts J1 to J3, firstly, a pair of rear links 711 biased with relatively weak spring elastic force is driven to arcuately rotate rearward against the elastic biasing force, so that the rear links 711 are folded by the wall through the swinging process shown in FIGS. 32A to 32C as they translate the front bar F1 obliquely rearward.

Further, the canvas take-up shafts J1 to J3 are rotated for winding, a pair of front links 712 biased with relatively strong spring elastic force is folded by the wall through the swinging process shown in FIGS. 32C to 32E as they translate the front bar F1 obliquely rearward against its elastic biasing force.

Contrarily, to unwind the protruded corner canvas G1 wound around the canvas take-up shafts J1 to J3, firstly, a pair of front links 712 biased with relatively strong spring elastic force is arcuately rotated by the biasing force in a forward spreading direction, and pushes the front bar F1 to be translated obliquely frontward toward the corner space portion as sliding the front bar F1 in the axial direction of the front bar F2. When the front link 712 swings to reach the spreading angle shown in FIG. 32C, next, a pair of rear links 711 biased by relatively weak spring elastic force starts to rotate forward and swings to reach the spreading angle shown in FIG. 32A as they push the front bar F1 to be translated further obliquely forward to the corner space portion.

Thereby, a canvas main body R1 of the protruded corner canvas G1 is expanded around the peripheries of the building in the vicinity of the corner end portion of the protruded corner portion N1, and a canvas expanded portion R2 is expanded across the corner space of a protruded corner 1. Thus, when the front bar F1 for the protruded corner canvas G1 is extended in two phases obliquely forward to the corner space portion by a parallel movement mechanism comprised of the L-like arms L1, L2 and their connection rod 66, the front bar F1 can be pushed to further obliquely forward than the cases using the composite devices SQIII1 to 8, SQII1 to 2, and SQIV 1 to 4.

In the foregoing case, the angle connecting the base end portions and the front end portions of the L-like arms L1, L2 that push and bias the front bar F1 is practically adjusted to a spreading angle of about 70 to 80 degrees as shown in FIG. 32A. Among them, the rotation is restricted by an appropriate stopper (not shown) if necessary, in such a manner that the swing angle of the rear link 711 does not exceed about 45 to 50 degrees, and the swing angle created between the connection rod 65 and the front link 712 does not exceed about 120 degrees.

As to Movement Stroke Increasing Device for Front Bar

FIGS. 33A, 33B, 34A and 34B show a mechanism for increasing the lateral movement stroke of a protruded corner canvas G1 relative to a front bar F1.

This is the case of an embodiment where the front bar F1 for the protruded corner canvas G1 is slidably guided by a long front bar F2*a* extended to the top end portion of the device. For example, when this movement stroke increasing device is installed to main link of the Y-like arm Y1 and the front end portion of the I-like arm I2 of the composite devices SQIII4, SQIII6 shown in the fourth and sixth embodiments, the front end portions of the main links 66 of the Y-like arms Y1, Y2 of the composite device SQIII5 shown in the fifth embodiment, the front end portions of the I-like arms I1, I2 of the composite device SQIII7 shown in the seventh embodiment, and the front end portion of the main link 66 of the Y-like arm Y1 of the composite devices SQII1, SQII2 shown in the tenth and eleventh embodiments, respectively, their lateral movement strokes can be mechanically increased.

In FIGS. 33A, 33B, 34A, and 34B, a bracket 68*a* is attached on the back surface of the front bar F2*a* to be slidably guided. The bracket 68*a* is formed into the same structure as the upper structure of the bracket 68 shown in FIGS. 21A and 21B. The bracket 68*a* is pivotally supported to be horizontally rotatable about a shaft pin 661 raised in the vicinity of the front end portions of main links 66 of Y-like Y1, Y2 or I-like arms I1, I2.

Further, a protrusion 662 horizontally bent obliquely forward at about 45 degrees is formed on the front end portions of main links 66 or the I-like arms I1, I2, and a long hole 663 is opened at a front portion of the protrusion 662. On the other hand, a rod 70*a* with a screw 702 is fitted and inserted into a downward fitting groove 292 of the front bar F1. Then, a cylindrical nut 703 fitted to the long hole 663 of the protrusion 662 is screwed and fixed to the screw 702.

When thus-structured device is incorporated, for example, into the front end portions of the main links 66 of the Y-like arms Y1, Y2 of the composite device SQIII5 shown in FIG. 23B, respectively, a function of lateral straightforward movement can be mechanically obtained by the rotation movement of the protrusion 662 that slides integrally with the main links 66, and the effect that the cylindrical nut fitted in the long hole 663 of the protrusion 662 slides in the long hole 663.

As a result, as compared with the case of the bracket 68 shown in FIGS. 21A and 21B, the stroke of axially pushing the front bar F1 for the protruded corner canvas G1 can be increased.

This contributes to further reduction of the mutual space between the canvas oblique sides facing to each other obliquely in the case where two pairs of the composite devices SQIII3 to 6, SQIII8, SQII1, and SQII2 are attached to the protruded corner portion N1 to be faced to each other, and their respective front bar F1 is translated obliquely forward beyond one or two Y-like arms Y1, Y2 to expand their respective protruded corner canvas G1 into the corner space portion.

As to Second Type of Composite Awning Device

Composite devices SUIII, SUII of a second type are applied to an outer wall W1 zone including a protruded corner portion N1 at one side and a recessed corner portion Z at the other side. As shown in FIGS. 35 to 38, instead of the rectangular canvas P of the composite devices SQIII1 to 9, SQII1 and 2, and SQIV1 to 5 of the first type, corner canvases T1, T2 each having a substantially right-angled reversed trapezoidal shape that covers the corner space portion of the recessed corner portion Z when expanded (hereinafter, referred to as recessed corner canvases) are combined with each other.

In summary, a protruded corner awning device S1 is overlapped in back-to-back relation with an awning device U for the recessed canvases T1, T2 that cover the recessed corner portion Z, located at a position rearward next to the protruded corner awning device S1 (hereinafter, referred to as a recessed corner awning device). Further, a front bar F1 for the protruded corner canvas G1 is fitted on and supported into the front bar F2 for the recessed corner canvases T1, T2 to be slidably guided. Then, both the front bars F1, F2 are structured to be translated by about two to four foldable swinging arms selected from the I-like arms I1, I2, V-like arms V1, V2, Y-like arms Y1, Y2, and L-like arms L1, L2.

First Embodiment

Figure 35A:
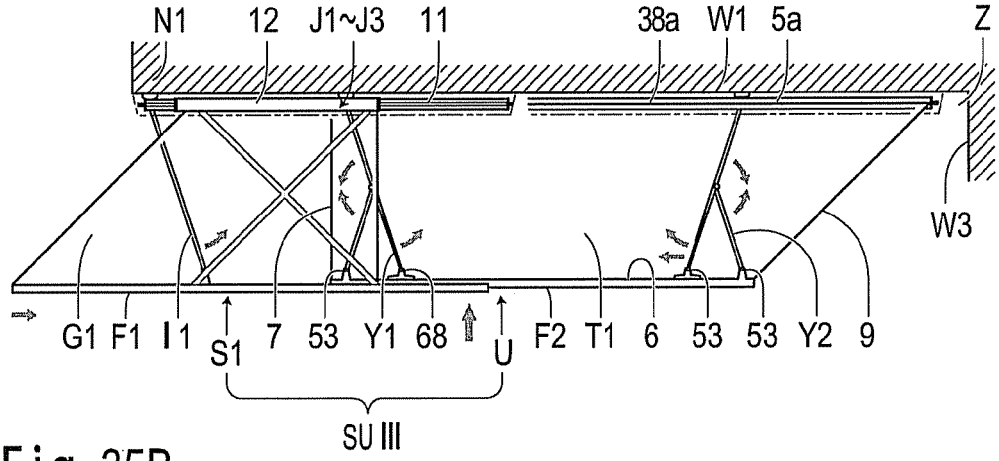

As a first embodiment, a composite device SUIII including three swing arms shown in FIG. 35A will be described.

The composite device SUIII basically has the same structure as of the composite device SQIII8 of the first type shown in FIG. 24, except that the rectangular canvas P is replaced by a recessed corner canvas T1, and a canvas top side 5*a* of the recessed corner canvas T1 is attached to a take-up roller 38*a* extended to the vicinity of the corner portion of the recessed corner portion Z.

The recessed corner canvas T1 is formed into a flat geometry in a substantially right-angled reversed trapezoidal shape when expanded. As to its outer geometry, as shown in FIG. 36, a canvas top side 5*a* and a canvas bottom side 6 are formed in parallel with each other, where the canvas top side 5*a* being longer than the canvas bottom side 6. A canvas oblique side 9 extends from the rear end portion of the canvas bottom side 6 to the rear end portion of the canvas top side 5*a* at about 45 degrees. The top end portions of the canvas top side 5*a* and the canvas bottom side 6 are respectively formed at a perpendicular canvas perpendicular side 7.

Figure 35B:
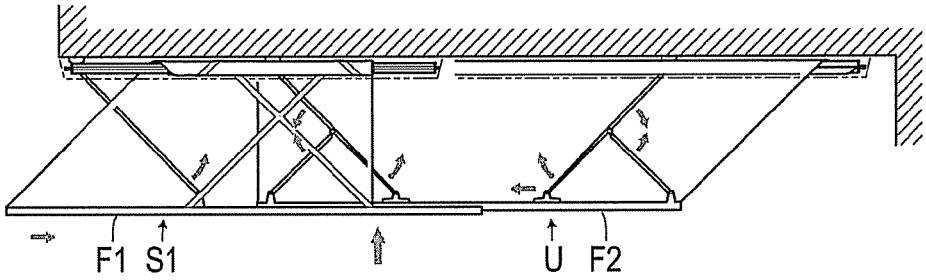
Figure 35C:
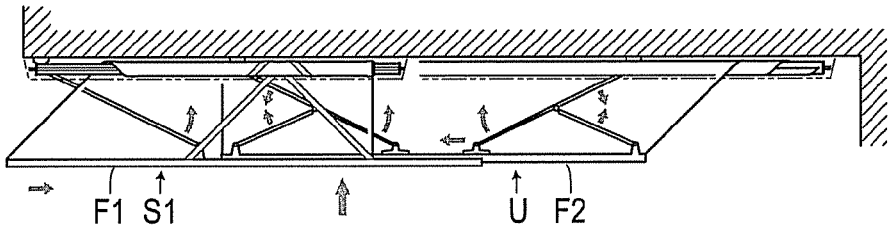

Further, in FIG. 36, reference numerals 24*c*, 25*c* refer to cross passages formed into the shape of the letter X (or V) when seen from top on the main body rectangular portion of a recessed corner canvas T1. One of connection wires (not shown) passed through the cross passages is connected to take-up rollers 38, 38*a*, whereas the other wire is connected to front bars F2, F2*b*. Thereby, in-plane deformation of the recessed corner canvas T1 is prevented, and the recessed corner canvas T1 is expanded and supported in a stretched state. Then, the recessed corner canvas T1 is wound around the take-up roller 38*a* to linearly translate the front bar F2 toward the wall, spreading the Y-like arms Y1, Y2 against their spreading biasing force as shown in FIGS. 35A to 35C.

At the same time, the protruded corner canvas G1 is wound around the take-up shafts J1 to J3, and the I-like arm I1 is rotated obliquely rearward against its spreading biasing force to translate the front bar F1 obliquely rearward as the front bar F1 is slidably guided along the front bar F2 of the recessed corner canvas T1.

Figure 35D:
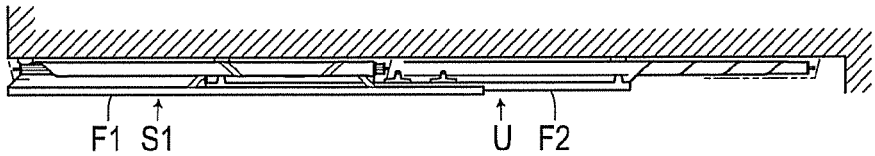

Thereby, the recessed corner canvas T1 and the protruded corner canvas G1 are wound, and the entire device is folded and stored by the wall between the protruded corner portion N1 and the recessed corner portion Z as shown in FIG. 35D.

Second Embodiment

A composite device SUII of a second embodiment shown in FIGS. 37A to 37C has a structure in which a front bar F1 for a protruded corner canvas G1 is supported by an I-like arm I1; a bracket 53 at a front end portion of a sub-link 67 of a Y-like arm Y1 attached to a midpoint of the device is fixed to a top end portion of a short front bar F2*b* of a recessed corner canvas T2; a bracket 68 at a front end portion of a main link 66 is attached to the front bar F2*b* to be slidably guided and is also fixed to a right rearward bottom of the front bar F1.

This device is intended for use in the region where the distance between a protruded corner portion N1 and a recessed corner portion Z is supposed to be relatively short. In particular, the device can be used in such a region without a need of incorporating a V-like arm and a Y-like arm into the rear portion of the device. This is because a sufficient overlapping margin of the front bar F1 moving frontward rearward can be always ensured relative to the total length of the front bar F2*b*.

The composite device of the second type is not limited only those of the first and second embodiments. As in the case of the device of the first type, numerous embodiments are established by replacing the rectangular canvas P of the composite devices SQIII1 to 9, SQII1 to 2, and SQIV1 to 5 of first type by recessed corner canvases T1, T2 in a right-angled reversed trapezoidal shape.

As to Composite Awning Device of Third Type

Composite devices SQSIV1 to 4 and SQSVI of a third type are attached to a site where its opposite fore and rear end portions are protruded corners N1, N2, and an outer wall W1 therebetween is a linear portion having an appropriate length. As shown in FIGS. 39 to 45, each of these devices is comprised of organically composing a protruded corner awning device S1 to be attached at a position in the vicinity of one protruded corner portion N1, a protruded awning device S2 to be attached to a position in the vicinity of the other protruded corner N2 in a fore and rear symmetrical relation to the awning device S1, and a rectangular awning device Q to be attached in a linear zone between these awning devices S1, S2.

Then, front bars F1, F3, F11, F13 for the protruded corner canvases G1, G2 at the fore and rear positions are fitted and supported to front bars F2, F12 for the rectangular canvas P at a midpoint to be slidably guided. These front bars F1 to F3, F11 to F13 are structured to be movable in parallel by means of about four to six foldable swing arms selected from I-like arms I1, I2, V-like arms V1, V2, Y-like arms Y1, Y2, and L-like arms L1, L2.

First Embodiment

As shown in FIGS. 39A and 39B, a composite device SQSIV1 of a first embodiment has a structure in which casings K1 of protruded awning devices S1, S2 including take-up shafts J1 to J3 are attached substantially in back-to-back relation on one side and the other side of a front wall W1. Then, a casing K2 of a rectangular awning device Q is attached at a center position on the bottom of two fore and rear casings K1 into an upper and lower overlapped relation.

Then, a front bar F2 of a rectangular canvas P is supported at its opposite end portions by V-like arms V1, V2 distanced at an appropriate space. The front bars F1, F3 for the protruded corner canvases G1, G2 at the fore and rear positions are supported at their midpoints by I-like arms I1, I2 into a symmetrically fore and rear relation. Further, front bars F1, F2 of protruded corner canvas G1, G2 are slidably fitted and inserted into the front bar F2 for the rectangular canvas P at its fore and rear positions.

Figure 40A:
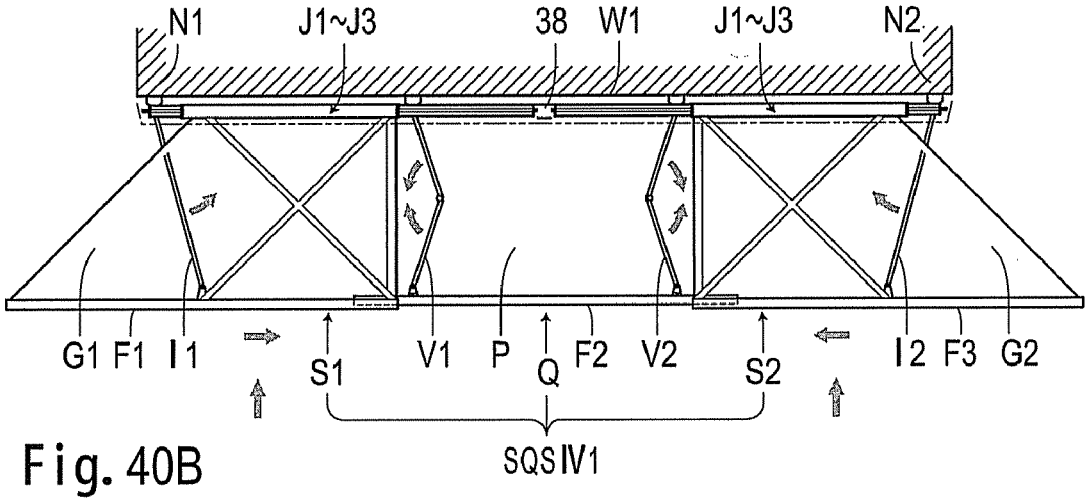
Figure 40B:
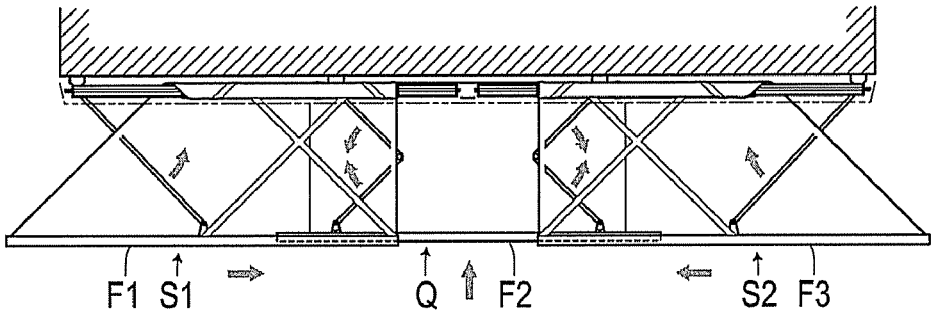
Figure 40C:
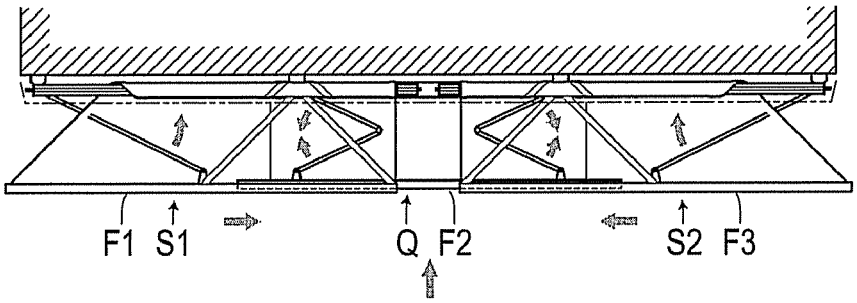

When three canvases G1, G2, and P are synchronously wound, the rectangular canvas P is wound around the intermediate take-up roller 38, so that the V-like arms V1, V2 are gradually bi-folded inward against their spreading biasing force as shown in FIGS. 40A to 40C to linearly translate the front bar F2 toward the wall.

Figure 40D:
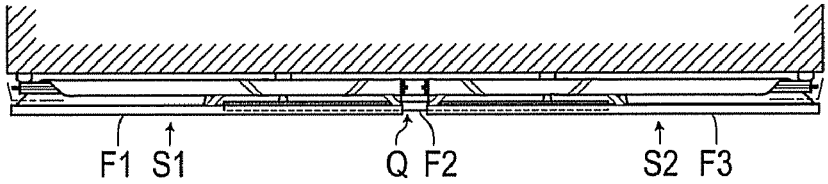

Further, the protruded corner canvases G1, G2 at the fore and rear positions are wound around their respective take-up shafts J1 to J3, so that one I-like arm I1 is rotated obliquely rearward against its biasing force whereas the other I-like arm I2 is rotated in an oblique direction forward and rearward symmetric to the movement direction of the I-like arm I1. At the same time, the respective front bars F1, F3 are obliquely translated as they are slidably guided along the front bar F2. Thereby, three canvases G1, P, P2 are wound, and the entire device is folded and stored by the wall between the protruded corners N1, N2 as shown in FIG. 40D.

Second Embodiment

Figure 41A:
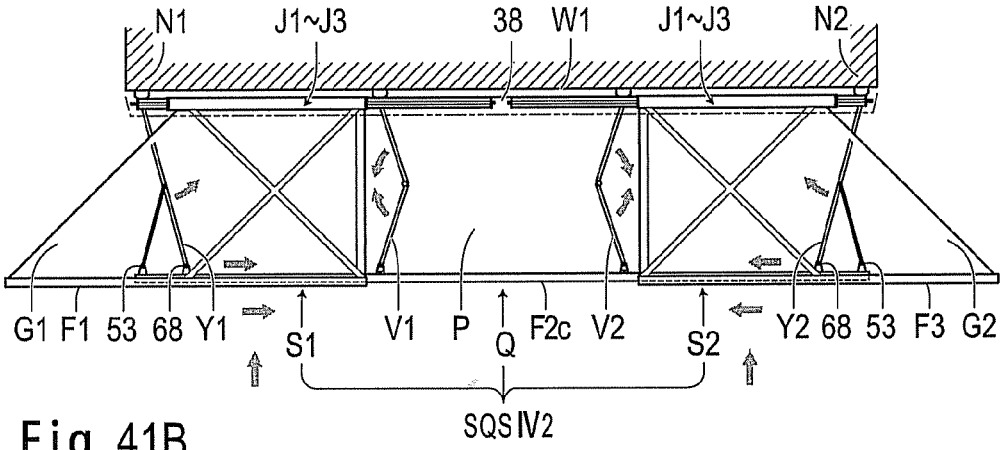
Figure 41B:
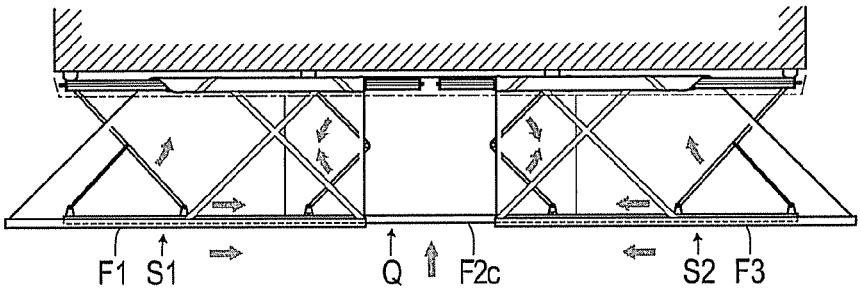
Figure 41C:
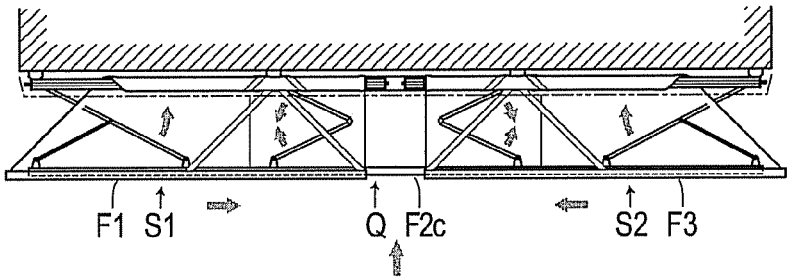
Figure 41D:
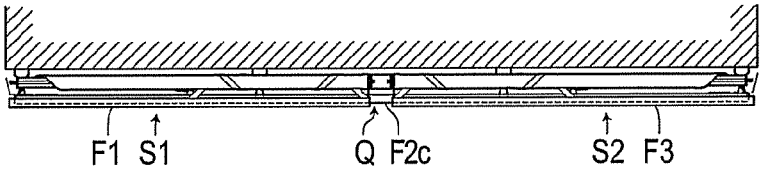

A composite device SQSIV2 of a second embodiment shown in FIG. 41A has a structure in which front bars F1, F3 for protruded corner canvases G1, G2 attached symmetrically at fore and rear positions are supported by Y-like arms Y1, Y2. In this case, a front bar F2*c* of a rectangular awning device Q at an intermediate position is in a length extended to the vicinity of the end portions of protruded corners N1, N2. At front and rear end portions of the front bar F2*c*, brackets 53 at front end portions of sub-links 67 of the Y-like arms Y1, Y2 are attached, respectively. Bracket 68 at front end portions of main links 66 are supported by the front bar F2*c* to be slidably guided, and are also fixed to the bottoms of their respective front bars F1, F3.

Thereby, three canvases G1, P, G2 are stored by the wall through the winding process and the folding process by means of the V-like arms V1, V2 and the Y-like arms Y1, Y2 shown in FIGS. 41A to 41D.

Third Embodiment

A composite device SQSIV3 of a third embodiment shown in FIGS. 42A to 42C has a structure in which a rectangular awning device Q is organically combined at an upper center position of protruded corner awning devices S1, S2 laid out at fore and rear positions in back-to-back relation.

Then front bars F11, F13 of protruded corner awning devices S1, S2 laid out symmetrically at fore and rear positions are inserted and supported at fore and rear opposite end portions of a front bar F12 of a rectangular awning device Q to be slidably guided. Further, the front bars F11, F13 are supported by I-like arms I1, I2 and Y-like arms Y1, Y2. Among them, brackets 53 at front end portions of main links 66 are attached to the front bars F11, F13. A rising portion 751 formed at a base end portion of a sub-rod 75 is pivotally provided to the vicinity of a midpoint of each main link 66, and a rising portion 752 formed at a front end portion of the sub-rod 75 is engaged and fixed to an engagement piece 76 attached to the bottom of a front bar F12 at its respective fore and rear opposite end portions.

Unlike foregoing numerous embodiments, this is the case where the front bar F12 is located outside whereas the front bars F11, F13 at the fore and rear positions are located inside. Usually, protruded corner canvases G1, G2 are upper-wound around take-up shafts J1 to J3, whereas a rectangular canvas P is lower-wound around a take-up roller 38.

Thereby, three canvases G1, P, and G2 are stored by the wall through the winding process and the folding process by Y-like arms Y1, Y2 and I-like arms I1, I2 shown in FIGS. 43A to 43D.

Fourth Embodiment

A composite device SQSIV4 of a fourth embodiment shown in FIGS. 44A to 44D has a structure where I-like arms I1 to I4, two of which respectively constitutes one pair, for supporting front bars F11, F13 of protruded corner awning devices S1, S2 are relatively rotated in parallel with each other inwardly to translate the front bars F11, F13 rearward toward the intermediate position of the device, so that an intermediate front bar F12 is translated linearly forward and rearward.

Thereby, three canvases G1, P, G2 are stored by the wall through winding process and folding process by I-like arms I1 to I4 shown in FIGS. 44A to 44D.

In this case as well, as in the case of the composite device SQSIV3 of the third embodiment, the front bar F12 is located outside, whereas the front bars F11, F13 are located inside.

Fifth Embodiment

Figure 45A:
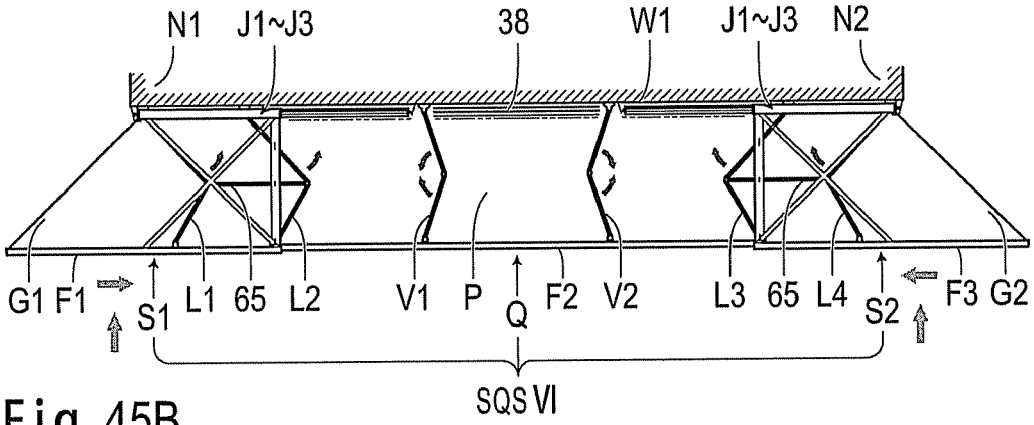
Figure 45B:
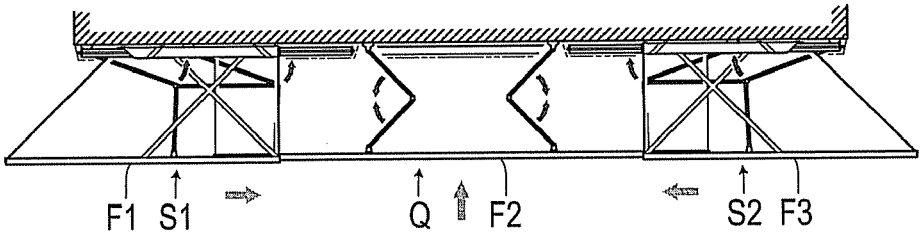
Figure 45C:
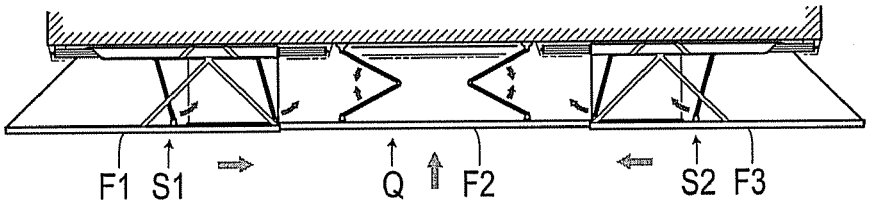
Figure 45D:
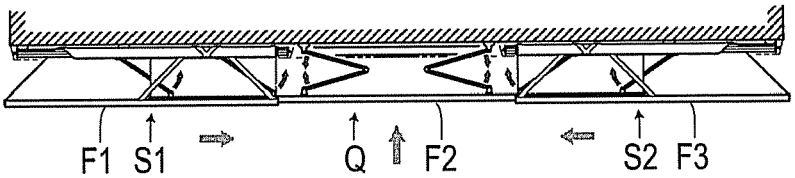
Figure 45E:
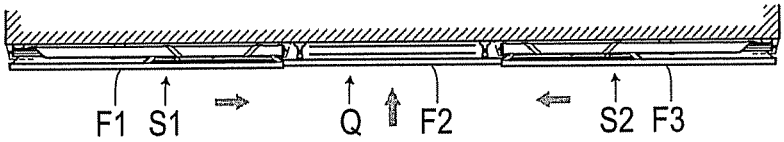

A composite device SQSVI of a fifth embodiment shown in FIG. 45A includes six swing arms in total. The composite device SQSVI has a structure in which two-phase extendable L-like arms L1 to L4, two of which respectively constitute one pair, are incorporated into protruded awning devices S1, S2 symmetrically at fore and rear positions, whereas two bi-foldable V-like arms V1, V2 are incorporated into an intermediate rectangular awning device Q.

Thereby, three canvases G1, P, G2 are stored by the wall through winding process, bi-folding movement of the V-like arms V1, V2, and two-phase extending and contracting operation by the L-like arms L1 to L4 shown in FIGS. 45A to 45E.

As to Composite Awning Device of Fourth Type

As shown in FIGS. 46 to 48, composite devices SSII, SSIV of fourth type are intended for use in the case where the distance between one protruded corner portion N1 and the other protruded corner portion N1 is supposed to be shorter than that of the third type. The composite devices SSII, SSIV have a structure in which two protruded corner awning devices S1, S2 are overlapped in back-to-back relation to be symmetrical at fore and rear positions, and their respective casings K1 are attached at positions deviated upward and downward from each other.

First Embodiment

In the composite device SSII of a first embodiment shown in FIGS. 46A to 46C, reference numeral F4 refers to a guide rail for slidably supporting front bars F1, F3 for protruded corner canvas G1, G2 fitted thereto. At the opposite fore and rear end portions of the guide rail F4, front end portions of sub-links 67 of Y-like arms Y1, Y2 are attached to be faced to each other symmetrically in the fore and rear relation.

The front bars F1, F3 of the protruded awning devices F1, S2 are slidably fitted and inserted to be supported relatively by the guide rail F4. Then, a shaft pin 661 at a front end portion of a main link 66 of the respective Y-like arms Y1, Y2 is engaged into a long hole 721 of an engagement piece 72 fixed at a midpoint on the bottom of the respective front bars F1, 3. Thereby, the canvases G1, G2 of the composite device SSII are stored by the wall through canvas winding process and folding process by the Y-like arms Y1, Y2, without protruding from the portion of the protruded corners N1, N2.

Second Embodiment

Figure 48A:
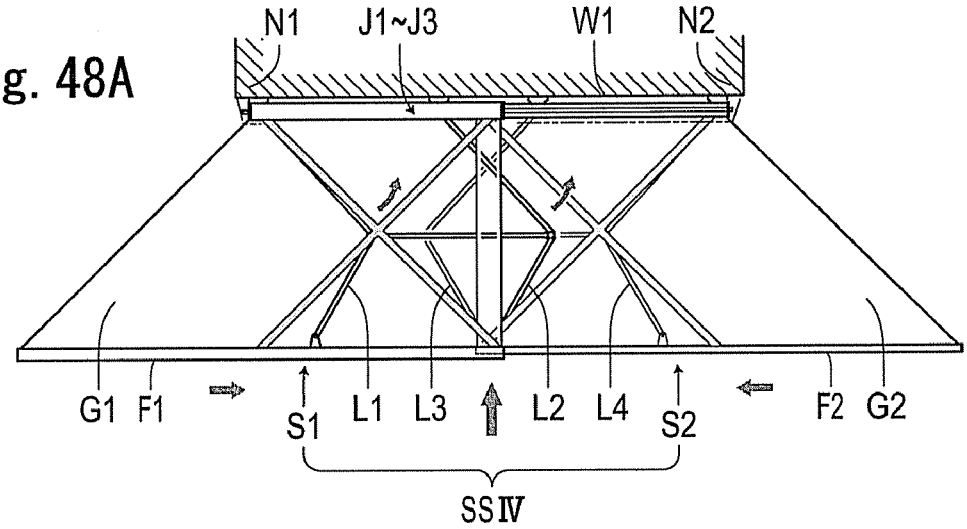
Figure 48B:
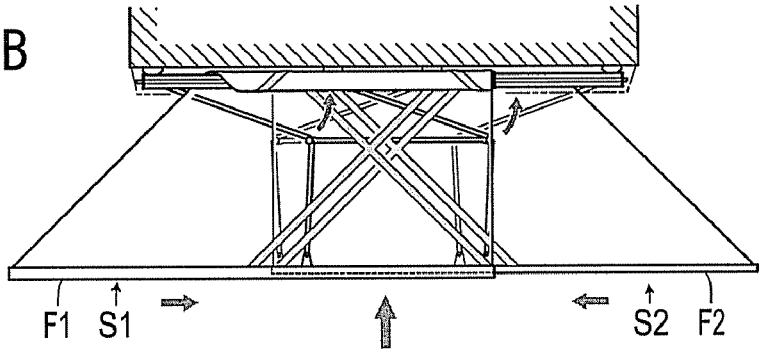
Figure 48C:
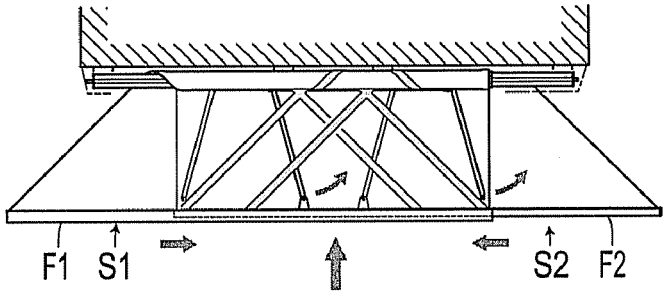
Figure 48D:
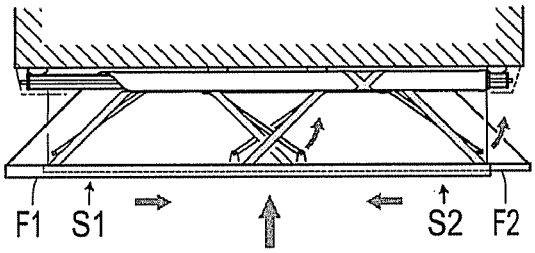
Figure 48E:
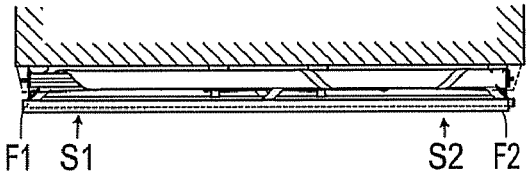

A composite device SSIV of a second embodiment shown in FIG. 48A has a structure in which front bars F1, F2 for protruded corner canvases G1, G12 are relatively fitted and inserted to be supported so that they are slidably guided, and these front bars F1, F2 are supported by two-phase extendable L-like arms L1 to L4 two of which respectively constitute one pair. Unlike the first embodiment, there is no need of a guide rail F4.

Thereby, the canvases G1, G2 of the composite device SSIV are stored by the wall in the portion created by protruded corners N1, N2 through canvas take-up process and two-phase folding process by the L-like arms L1 to L4 shown in FIGS. 48A to 48E.

In the composite devices SSII, SSIV of fourth type, the guide rail F4 and front bars F11, F13 are supported by the Y-like arms Y1, Y2 and the L-like arms L1 to L4. Alternatively, the guide rail F4 and the front bars F11, F13 may be supported by incorporating I-like arms and V-like arms at appropriate locations in appropriate manner.

As to Composite Awning Device of Fifth Type

A composite device WSQ of fifth type is comprised of a typical combination of any two of the composite devices SQIII1 to 9, SQII1 to 2, SQIV1 to 5 of first type located to be faced to each other at one and the other protruded corner portions N1 as shown in FIGS. 1A, 1B, and 2. These devices may be operated independently and separately from each other, or alternatively, may be interlocked with each other.

Another combination is comprised of the composite devices SQIII1 to 9, SQII1 to 2, SQIV1 to 5 of the first type located at one protruded corner portion N1, and the composite devices SUIII, SUII of the second type located at the other protruded corner portion N1 to be faced to each other. Still another combination is comprised of the composite devices SUIII, SUII of the second type at one and the other protruded corners N1 to be faced to each other.

Further, in the case of the composite devices of the second type, two composite devices may be located at one and the other recessed corners Z to be faced to each. These may be operated independently and separately from each other, or alternatively, may be interlocked with each other.

As a matter of course, the composite devices SQSIV 1 to 4, SQSVI of the third type or the composite devices SSII, SSIV of the fourth type may be located at one or both of the protruded corners N1 in combination and may be interlocked with each other.

In the case where any two pairs of the composite devices SQIII1 to 9, SQII1 to 2, SQIV1 to 5, SUIII, SUII located at one and the other protruded corners N1 and the recessed corners Z to be faced to face each other are interlocked with each other, they can be designed as if they are integral in one piece unit by connecting the top end portions of their respective front bars F1 to each other by a stretching rope, chain, or other connecting tools (not shown).

The following composite devices WSQIV1, 2 correspond to further developed types of typical combinations of the composite devices described above.

First Embodiment

In FIGS. 49A to 49C showing a composite device WSQIV1 of a first embodiment, reference numeral F5 refers to a corner frame for a protruded corner canvas formed at a substantially right angle same as the angle of a protruded corner portion N1. The corner frame F5 is comprised of two front bars F1 faced to each other at one and the other protruded corners N1 and butted to be connected and fixed to each other.

The composite device WSQIV1 includes either two pairs of the awning devices SQIII1 to 9, SQII1 to 2, SQIV1 to 5 attached to a front wall W1 at one side of a protruded corner portion N1 and a side wall W2 at the other side of the protruded corner portion N1 to be faced to each other, wherein each of the composite devices SQIII1 to 9, SQII1 to 2, SQIV1 to 5 is comprised of a combination of a protruded corner awning device S1 including a take-up device for winding and unwinding a protruded corner canvas G1, and a rectangular awning device Q including a take-up device for winding and unwinding a rectangular canvas P.

Then, the top end portions of the front bar F1 at the front surface side and the front bar F1 at the side surface side fitted and inserted to be supported by their respective front bar F2*a* are connected and fixed to be butted against each other to assemble an integral corner frame F5. As a result, two pairs of composite devices SQIII1 to 9, SQII1 to 2, and SQIV12 to 5 are integrated into one piece unit.

Thus, the composite device WSQIV is characterized in that it eliminates the necessity of swing arms for moving the front bars F1 for the protruded corner canvases G1, G2 in the axial direction of the front bars F1, F2, F2*a*, F2*b* for the rectangular canvas P and the recessed corner canvases T1, T2 frontward and rearward, and for translating them obliquely, although all the foregoing embodiments need the swing arms.

Further, at the top end portions of inner rotation shafts 11 butted against each other, oblique tooth gears (or bevel gear) 64 are fitted to be meshed with each other as shown in FIG. 17A, or manually driven devices may be incorporated as shown in FIGS. 17B, 62A, and 62B, so that the entire device is structured interlockingly. Alternatively, instead of using an interlocking structure comprised of the oblique tooth gears 64, or worm gear 58 and worm 59 on the like, all the electric motors M1, M2 may be driven synchronously. Alternatively, either one of the electric motors is synchronized, whereas the other take-up shafts J1 to J3 and the take-up roller 38 are combined so as to be driven to rotate. Alternatively, either one of the electric motors M1, M2 is synchronized, whereas the take-up rollers J1 to J3 and the take-up shaft 38 are driven to rotate in mesh between the spur gears 61, 62 shown in FIG. 16C.

As to Canvas Winding Process

When the composite device WSQIV1 is interlocked to wind both the canvases G1, P expanded across one and the other sides of the protruded corner portion N1 including the protruded corner portion N1 itself, the composite device WSQIV1 is retracted toward one and the other walls and stored by the walls as it changes its geometry as shown in FIGS. 50A to 50D and 51A to 51D.

In this case, as one and the other rectangular canvases P are wound by their respective take-up rollers 38, the respective front bars F2*a* are retracted toward the walls as they are translated. At this time, the V-like arms V1, V2 are folded by the walls as they are bi-folded against their elastic biasing force. Thereby, one front bar F2*a* is linearly translated toward the front wall S1 for example, whereas the other front bar F2*a* is linearly translated toward the side wall W2, for example.

On the other hand, in the protruded awning device S1 that interlocks with the rectangular awning device Q, the take-up shafts J1 to J3 for the protruded corner canvas G1 rotates to start winding of the protruded corner canvas G1 around the outer roller 12. At the same time, one and the other front bars F1 of the integral corner frame F5 follow one and the other front bars F2*a* linearly translated as described above, so that the front bars F1 are moved to be translated while moving rearward in their axial directions. Thereby, the entire corner frame F5 is linearly retracted obliquely rearward. That is, the protruded corner canvas G1 is wound around the take-up shafts J1 to J3 and is stored compactly by the wall including the protruded corner portion N1 by linearly moving the entire corner frame F5 in an oblique direction identical to the line equally dividing the protruded corner portion N1.

As to Canvas Extending Process

Contrarily, in order to extend the composite device WSQIV1 stored into the protruded corner portion N1 by the wall toward the peripheries of the building including said corner space, the rectangular canvas P wound around the take-up roller 38 and the protruded corner canvas wound around the take-up shafts J1 to J3 are synchronously unwound. Then, the elastic biasing force of the V-like arms V1, V2 folded by the wall is released, and this pushing biasing force biases the V-like arms V1, V2 to rotate in a stretching direction, so that the front bar F2*a* at the front surface side and the front bar F2*a* at the side surface side are respectively pushed in parallel with each other linearly. Thereby, the rectangular canvas P wound around the respective rollers 38 is unwound and extended forward.

At the same time, the corner frame F5 fitted and inserted into the front bars F2*a* at the front surface side and at the side surface side respectively is linearly pushed obliquely forward to the corner space as it moves the front bars F2*a* forward in their axial directions. As a result, the protruded corner canvas G1 wound around the take-up shafts J1 to J3 is unwound and drawn to be expanded around the peripheries of the building including the corner space of the protruded corner portion N1.

Thereby, the building peripheries including the corner spaces of various building can be attractively covered.

In FIGS. 49A and 49B, reference numeral H refers to a corner signboard attached to the bar butted point in the corner frame F5. Alternatively, a fringed signboard (not shown) may be fixedly attached to the upper edge of the corner frame F5.

In the case described above, the V-like arms V1 in the vicinity of the corner end may be replaced by a Y-like arm Y1 comprised of a main link 66 and a sub-link 67 as in the case of the composite device SQII1 shown in FIGS. 26A and 26B. Among them, a front end portion of the sub-link 67 may be attached to the top end portion of the front bar F2*a* for the rectangular canvas P, whereas the front end portion of the main link 66 may be attached to the vicinity of a midpoint of the front bar F1 of the front bar F5.

Second Embodiment

Next, in FIGS. 52A and 52B showing a composite device WSQIV of a second embodiment, and in FIGS. 55A and 55B showing a trail of movement of its main parts, reference numeral 514 refers to a bending link bent at a substantially right angle to protrude from a front end portion of a front link 512 of a V-like arm V1 outward. Its bent portion is pivotally supported by a pin 531 of a bracket 53 attached to a top end portion of a front bar F2*a*. Reference numeral 78 refers to a connection rod connected to a top end portion of a bending link 514 of which top end is pivotally supported by a corner plate 77 fixed to a recessed corner of a corner frame F5. A structure identical to this is incorporated into one and the other recessed corners of the corner frame F5 to be symmetric to each other.

When the composite devices WSQIV2 are interlocked with each other to wind both canvases G1, P extended in one and the other sides of the protruded corner portion N1 including a corner space, the composite devices WSQIV2 are retracted into one and the other walls including the protruded corner portion N1 to be compactly stored as they change their geometries as shown in FIGS. 53A to 53D and 54A to 54D.

At this time, the main parts operate as follows. As shown in FIG. 55B, a rear link 511 and a front link 512 of a V-like arm V1 are bi-folded against their elastic biasing force. Following to this movement, a bending link 514 integral with the front arm 512 is rotated rearward about a bracket 53 as a supporting point, and at the same time, the bending link 514 and a connection rod 78 are gradually bi-folded downward. Thereby, the rear link 511 and the front link 512 are folded and stored into a corner end portion of the front surface of the protruded corner portion N1, and the bending link 514 and the connection rod 78 come into the corner end at the side surface side of the protruded corner portion N1 where they are folded and stored.

According to the slide link mechanism as described above, the corner frame F5 linearly moves in an oblique direction that equally dividing the corner space as it mechanically interlocks with one and the other front bars F2*a* linearly moving in parallel with each other toward the wall.

In the case described above, the bending angel θ created between the front link 512 and the bending link 514 is set at a substantially right angle. Alternatively, when the protruded corner portion N1 is at an acute angle or an obtuse angle, the angle θ is arranged at substantially the same angle as the angle of the protruded corner portion N1.

As to Fourth Embodiment of Canvas Take-Up Shaft

By the way, in the case of the take-up shafts J1 to J3 of the first to third embodiments, the outer roller 12 is structured to be slidably guided along the inner rotation shafts 11, 11*a*. Alternatively, in FIGS. 57A to 57C, and 58, a take-up shaft J4 of a fourth embodiment is shown where the inner rotation shafts and the outer roller are in a rolling structure relative to each other. In FIGS. 57A to 57C, reference numeral 122 refers to a fitting groove of a wheel unit D formed at a position where an inner surface of an outer roller 12*a* is equally divided into three. In the unit D, a wheel 79 is pinched between a rectangular seat plate 80 and a protruding cover plate 80, and is axially attached and clamped to be fixed by a shaft pin 82.

Then, the overlapped portions of the seat plate 80 and the cover plate 81 of the wheel unit D are fitted into the fitting groove 122.

Reference numeral 113 refers to a wheel guiding groove formed between guiding ribs 112 of the inner rotation shaft 11*b*. Stepped rail edges 114 are formed at opposite positions of the guiding ribs. Between the rail edges, a wheel 79 exposed from the wheel unit D is fitted to be guided while rolling.

Reference numeral 20*a* refers to an end cap of the outer roller 12*a*. Inside the end cap, there are formed a guiding protrusion 201 to be fitted with a guiding groove 111 of the inner rotation shaft 12*b*, a guiding groove 202 to be fitted with the guiding rib 112, and a guiding protrusion 203 to be fitted to the wheel guiding groove 113, respectively.

Other structures are substantially the same as either one of the take-up shafts J1 to J3, and therefore, the same reference numerals are assigned thereto and their descriptions will be omitted.

Thus, when the take-up shafts J1 to J3 of a sliding structure are replaced by the take-up shaft J4 of a rolling structure described above, the sliding resistance at the time when the outer roller 12*a* is moved forward and rearward can be reduced, and the smoothness of movement thereof can be further enhanced.

Front Bar of a Rolling Structure

In the case described above, the front bar F1 at an outer side is structured to be slidably guided along the front bar F2 at an inner side. Alternatively, the front bars F1, F2 may be replaced by front bars E1, E2 of a rolling structure shown in FIGS. 59A, 59B, 60, and 61A to C.

The front bar E1 at an outer side is made of a molded steel member having an opening on the center at its back surface. The front bar E1 includes a front plate 83 and an upper plate 832. Further, at a boundary between a scratched plate 834 expanded rearward and the upper plate 832, an upper fitting groove 841 to which a canvas bottom side 2 of the respective corner canvases G1, G2 is fitted is formed. From the lower portion of the upper fitting groove 841, an engagement flange edge 851 is extended downward, and a horizontal flange edge 852 is formed to extend toward the inside of the front bar E1. At a rear position of the bottom plate 833, a lower fitting groove 842 to which a front skirt 31 is attached is formed. From the upper portion of the bottom plate, an engagement flanged edge 853 is protruded perpendicularly.

Reference numerals 861, 862 refer to guiding wheels incorporated into upper and lower positions of the rear end portion of the front bar E1. Among them, the upper wheel 861 is fixedly supported at a protruding portion of the flange edge 852 by means of a shaft pin 863 to be horizontally rotatable. The lower wheel 862 is fixedly supported at a position inside the lower plate 833 to be horizontally rotatable by a shaft pin 864.

The front bar E2 at an inner side is made of a molded steel member having a rectangular cylindrical shape in cross section, and is comprised of a front plate 871, a rear plate 872, an upper plate 873, and a lower plate 874. Moreover, above and below the front bar E2, wheel rooms 881, 882 for storing the upper wheel 861 and the lower wheel 862 to be guided while rolling are formed. The wheel rooms 881, 882 are partitioned from each other by partitions 891, 892.

At the end positions of the partitions 891, 892 protruded rearward from rear plate 872, an upper fitting groove 901 and a lower fitting groove 902 are formed respectively. The upper fitting groove 901 is to fit either one of canvas bottom sides 6 of a rectangular canvas P or retracted canvases T1, T2, or in the case of the composite device SSIV of fourth type shown in FIG. 48, a canvas bottom side 2 of a protruded corner canvas G2. The lower fitting groove 902 is to fit a front skirt 49. An engagement flange edge 911 is protruded from the bottom of the upper fitting groove 901. An upward engagement flange edge 912 is projected from the upper portion of the lower engagement.

Reference numeral 92 refers to a wheel holder fitted and fixed to a top end portion of the front bar E2. Above and below the top end protrusion thereof, guide wheels 931, 932 are supported by a wheel shaft 933 to be horizontally rotatable. Reference numeral 941 refers to a guide slit formed to open at a center on the lower plate 874, for movably guiding the shaft pin 864 of the lower wheel 862. Reference numeral 942 refers to a guide slit opened above the rear plate 872, for guiding the flanged edge 852 inserted therein.

The front bar E1 incorporating the guide wheels 861, 862 above and below its rear end is inserted and fitted to the front bar E2 provided with the guide wheels 931, 932 at its front end and the wheel rooms 881, 882 at its upper and lower portions. Then, the guide wheels 931, 932 located at one side are fitted to the upper and lower positions of the front bar E1, whereas the guide wheels 861, 862 at the other side are fitted to the wheel rooms 881, 882. Thereby, the front bar E2 and the front bar E1 are assembled with each other to be guided while rolling.

Thus, if the front bars E1, E2 having a rolling structure described above is incorporated into the composite devices of the first to fifth types according to the present invention, the sliding resistance at the time when the front bar E1 is moved forward and rearward can be significantly reduced, thereby further enhancing the smoothness of operation.

When the front bars E1, E2 are supported by the swing arms such as the V-like arms V1, V2, I-like arms I1, I2, Y-like arms Y1, Y2, and L-like arms L1, L2 disclosed in the present invention, the attached state of the front bars E1, E2 with brackets is structured as shown in FIGS. 62A-62C to 65.

FIGS. 62A-62C, 63A, and 63B respectively show a case where the front bars E1, E2 of a rolling structure are incorporated into the composite device SQIII1 of the first type, and brackets 34, 53 same as that shown in FIG. 4C are attached thereto.

FIGS. 64A to 64C respectively show a case where the front bars E1, E2 are assembled into the composite device SQIII3 of first type, and a bracket 95 having a geometry slightly changed from that shown in FIGS. 21A to 21C is incorporated therein.

FIGS. 65A to 65C respectively show a case where a bracket 96 having a geometry slightly changed from the bracket 68*a* shown in FIGS. 33A and 33B is incorporated, for increasing the lateral movement stroke of the front bar E1.

The brackets 95, 96 are attached to the front bars E1, E2 having a rolling structure in substantially the same process and configuration as of the case where the brackets 68, 68*a* are attached to the front bars F1 to F3 and F11 to F13. Thus, the same reference numerals are denoted and their descriptions will be omitted.

As to Device for Narrowing a Gap at a Canvas Top Portion

By the way, in the present invention, care is made to make a gap inconspicuous at the canvas top and a boundary between the protruded corner canvases G1, G2 and the rectangular canvas P when extended, by lower-winding the protruded corner canvas G1 and the rectangular canvas P (or recessed corner canvases T1, T2; same thing is applicable to the following description), or contrarily, by lower-winding the rectangular canvas P and upper-winding the protruded corner canvases G1, G2.

However, the shaft distance between the take-up shafts J1 to J4 for the protruded corner canvases G1, G2 and the take-up roller 38 of the rectangular canvas P is constant. It is inevitable that the gap between the canvas top portions of the canvases G1, G2, P when drawn and expanded results in becoming larger than the gap in the state where they are wound and stored.

Thus, FIGS. 66, 67A to 67E disclose means for reducing the gap at the canvas top portion in a simple structure when the canvas is extended.

In these drawings, reference numeral 97 refers to a swinging flap incorporated into a casing K1. Its upper end shaft portion 971 is fitted on and supported by a bearing 100 formed at an inner wall position immediately above a canvas outlet 13. Reference numeral 98 refers to a reversed V-like plate spring for biasing and pushing up the lower end portion of the swinging flap 97, and is pinched between the lower surface of the upper portion of the flap 97 and the upper inside wall surface of the outlet 13.

Reference numeral 99 refers to a protrusion formed on the front surface in the vicinity of the top of the protruded corner canvas G1. The protrusion 99 is in a positional relationship such that it is exposed in a drawing step shown in FIG. 67C where the remaining protruded corner canvas G1 is about one and fourths of the outer peripheral length of the take-up shafts J1 to J4.

Thus, as the lower end portion of the swinging flap 97 is locked with the protrusion 99 and the protruded corner canvas G1 is further drawn, the swinging flap 97 is pushed up against the biasing force of a plate spring 98 as shown in FIGS. 67C to 67E. As a result of this, a gap having a height of λ shown in FIG. 67E is reduced, whereas an appropriate tension supporting force is imparted to an extended protruded corner canvas G1.

Reference numeral 101 refers to a coil spring for biasing a shaft end 971 of the swinging flap 97. The coil spring 101 stops the forward movement of the swinging flap 97 by biasing force when it is locked with the protrusion 99 and depressed downward.

In the case described above, the swinging flap 97 is locked with the protrusion 99. Alternatively, the lower end portion of the swinging flap 97 may be formed with recesses and protrusions into a waving shape, or protrusions (not shown), and thus-formed lower end may be locked with locking holes (not shown) formed at intervals at positions in the vicinity of the top portion of the protruded corner canvas G1. Further, in the case described above, the swinging flap 97 is incorporated into the casing K1 of the protruded corner canvas G1. Alternatively, when the swinging flap 97 is incorporated additionally into the casing K2 of the rectangular canvas P, the gap reducing device described above is structured upside-down from that described above.

Further, when the take-up shafts J1 to J4 for the protruded corner canvas G1 and the take-up roller 38 of the rectangular canvas P are incorporated into one and the same casing K3, the swinging flaps 97 are biased and supported at upper and lower positions symmetrically by an inner wall bearing of the casings K3 located at upper and lower positions of the canvas outlet 13*a*, thereby reducing the gap.

Further, in the case described above, the swinging flap 97 is incorporated into the casings K1 to K3. Even in the case of the composite device not having casings K1 to K3, if it is a composite device of which upper portion is covered with a cover plate, such a composite device can be easily coped with by attaching a swing arm 97 to this cover plate to bias and support it.

By the way, in the present invention, building peripheries including protruded corners and recessed corners of the building are efficiently covered with several kinds of composite devices. In the case where a linear zone of the building is long, as shown in FIG. 68, one or two or more of various kinds of movable long and short awning devices Q for winding and unwinding only a rectangular canvas P will be incorporated.

Further, into a recessed corner portion Z shown in FIG. 69, a movable awning device U1 for winding and unwinding only a recessed corner canvas T1 in a right-angled reversal trapezoidal shape is incorporated.

Further, into recessed corners Z1, Z2 shown in FIG. 70, a movable awning device U3 for winding and unwinding only a recessed corner canvas T3 in a reversal trapezoidal shape is incorporated.

As a matter of course, the take-up rollers 38, 38*a*, 38*b* of the respective canvases are attached substantially on the same line of the take-up rollers 38, 38*a* of the rectangular canvas P and recessed corner canvases T, T2 of the present invention. Their respective front bars F2 are also supported substantially on the same line.

Thus, one or two or more of composite devices according to the present invention and one or two or more of single devices of the foregoing three embodiments are laid out in accordance with necessity to be suitable for the appearance of the building, the peripheries of various buildings including protruded corners and recessed corners can be efficiently unified in terms of design. In addition, a system awning configurable as if it is a corridor can be provided to this industrial field.

INDUSTRIAL APPLICABILITY

The present invention provides an epoch-making and fresh composite awning device providing sufficient technical interest and serviceability. Thus, the present invention dramatically increases the decoration property and aesthetic appearance of the peripheries of the building including the protruded corners and recessed corners, and in turn, remarkably contributes to progress and development in this field of industry.

The invention claimed is:

1. A composite awning device comprising a combination of a protruded corner awning device (S1) equipped with a take-up device for winding and unwinding a protruded corner canvas (G1), and a rectangular awning device (Q) equipped with a winding device for winding and unwinding a rectangular canvas (P);

wherein, the take-up device of a protruded corner awning device (S1) is equipped with a take-up shaft (J1 to J4) for a protruded corner canvas (G1), and a front bar (F1, E1), said take-up shaft (J1 to J4) being comprised of an inner shaft and an outer roller (12, 12*a*) supported movably in the axis direction of said inner shaft;

the winding device of a rectangular awning device (Q) is equipped with a take-up roller (38) of said rectangular canvas (P) and a front bar (F2, F2*a*, E2) for the rectangular canvas;

the front bar (F1, E1) for the protruded corner canvas (G1) is fitted on and supported by the front bar (F2, F2*a*, E2) for the rectangular canvas (P) to be slidably guided; and the front bar (F2, F2*a*, E2) of the rectangular canvas (P) at one side is translated forward and rearward by swing arms supporting the front bar (F1, F2, F2*a*, E1, E2) of the protruded corner canvas (G1) and the rectangular canvas (P), whereas the front bar (F1, E1) of the protruded corner canvas (G1) at the other side is structured to be translated in a direction parallel to an axis of the front bar (F1, E1) of the protruded corner canvas when the protruded corner canvas is wound or unwound by the take-up device for winding and unwinding a protruded corner canvas; and the protruded corner canvas being wider at a leading edge that is connected to the front bar of the protruded corner canvas than it is at a rear edge connected to the take up shaft of the protruded corner canvas.

2. A composite awning device according to claim 1, wherein the front bars (F1, F2, F2*a*, E1, E2) are supported by either two or more of swing arms selected from linear I-like arms (I1, I2), bi-foldable V-like arms (V1, V2), and Y-like arms (Y1, Y2) in the shape of reversed letter y.

3. A composite awning device comprising a combination of a protruded corner awning device (S1) equipped with a take-up device for winding and unwinding a protruded corner canvas (G1), and a recessed corner awning device (U) equipped with a take-up device for winding and unwinding recessed corner canvas (T1, T2), wherein the take-up device of the recessed corner awning device (U) is equipped with a take-up roller (38) for the recessed corner canvas (T1, T2) and front bar (F2, F2*a*, F2*b*, E2) for the recessed corner canvas;

a front bar (F1, E1) for the protruded corner canvas (G1) is fitted on and supported by the front bar (F2, F2*a*, F2*b*, E2) for the recessed corner canvas (T1, T2) to be movably guided;

the front bar (F2, F2*a*, F2*b*, E2) for the recessed corner canvas at one side is translated forward and rearward by swing arms supporting both the front bar (F2, F2*a*, F2*b*, E2) for the recessed corner canvas, and the front bar (F1, E1) for the protruded corner canvas, and at the other side is structured to be translated in a direction parallel to an axis of the front bar (F1, E1) of the protruded corner canvas when the protruded corner canvas is wound or unwound by the take-up device for winding and unwinding a protruded corner canvas; the protruded corner canvas being wider at a leading edge that is connected to the front bar of the protruded corner canvas than it is at a rear edge that is connected to the take up device for the protruded corner canvas; and the recessed corner canvas is wider at the rear edge connected to the take up device for the recessed corner canvas than it is at a front edge connected to the front bar of the recessed corner canvas.

4. A composite awning device according to claim 1, wherein the protruded corner canvas (G1, G2) in a substantially right-angled trapezoidal shape when extended, and is comprised of a rectangular canvas main body portion (R1) and a canvas extending portion (R2) extended from one side of the can vas main body portion (R1); and a canvas top side (1) of the protruded corner canvases (G1, G2) is attached to the outer roller (12, 12*a*), whereas a canvas bottom side (2) thereof is attached to the front bar (F1, E1) of the protruded corner canvas.

5. A composite awning device according to claim 4, wherein the canvas main body portion (R1) is structured to be wound around the outer roller (12, 12*a*), whereas the canvas extending portion (R2) is structured to be exposed as the outer roller (12, 12*a*) is moved rearward, and wherein, to unwind the protruded corner canvas (G1, G2) wound around the take-up shaft (J1, J4), the outer roller (12, 12*a*) is moved forward in the axial direction as it is rotated to be unwound.

6. A composite awning device according to claim 1, wherein the inner shaft is an inner rotation shaft (11, 11*a*, 11*b*); and the outer roller (12, 12*a*) is fitted on and supported by the inner rotation shaft (11, 11*a*, 11*b*) to be movably guided.

7. A composite awning device according to claim 6, wherein guide grooves and a guide projection (112) are formed in the axial direction of the inner rotation shaft (11, 11*a*, 11*b*).

8. A composite awning device according to claim 1, wherein the front bar (F1, F3, E1) for the protruded corner canvases (G1, G2) is at an outer side, whereas the front bar (F2, F2*a*, F2*b*, F2*c*, E2) of the rectangular canvas (P) is at an inner side, and wherein the front bar (F1, E1) at the outer side is formed with, in the longitudinal direction, fitting grooves (291, 841) to which the canvas bottom side (2) of the protruded corner canvases (G1, G2) is to be fitted, and fitting grooves (292, 842) of a front skirt (31), respectively; and the front bar (F2 F2*a*, F2*b*, F2*c*, E2) at the inner side is formed with fitting grooves (471, 901) to which the canvas bottom side (6) of the rectangular canvas (P) or the recessed corner canvases (T1, T2), respectively, in the longitudinal direction.

9. A composite awning device according to claim 8, wherein, to fittedly inserting the front bar (E1) at the outside into the front bar (E2) at the inner side to be guided while rolling, guide wheels (861, 862) which horizontally rotate are contained into the front bar (E1) at its rear end portion; and guide wheels (931, 932) that horizontally rotate are provided to the top end portion of the front bar (E2), so that the guide wheels (931, 932) roll on the inner side surface of the front bar (E1), whereas the guide wheels (861, 862) roll in wheel rooms (881, 882) formed above and below the front bar (E2).

10. A composite awning device according to claim 1, wherein front end portions of two V-like arms (V1, V2) located at symmetrically fore and rear positions are attached to opposite fore and rear end portions of the front bar (F2, E2) for the rectangular canvas (P), respectively; and a front end portion an I-like arm (I1) is attached in the vicinity of the midpoint of the front bar (F1, E1) for the protruded corner canvas (G1) (SQIII1).

11. A composite awning device according to claim 1, further comprising a Y-like arm (Y1) comprised of a main link (66) and a sub-link (67);

wherein a front end portion of the sub-link (67) is attached to a top end portion of the front bar (F2, E2) for the rectangular canvas (P); and whereas a front end portion of the main link (66) is attached to a rear end portion of the front bar (F1, E1) for the protruded corner canvas (G1) and is also attached to the front bar (F2, E2) for the rectangular canvas to be movably guided (SQIII3).

12. A composite awning device according to claim 1, wherein a Y-like arm (Y1) comprised of a main link (66) and a sub-link (67) is attached in the vicinity of a top end portion of the front bar (F2*a*, E2) for the rectangular canvas (P) extended to reach a top end portion of the device;

wherein a front end portion of the sub-link (67) is attached to a top end portion of the front bar (F2*a*, E2);

a front end portion of the main link (66) is attached in the vicinity a midpoint of the front bar (F1, E1) for the protruded corner canvas, and at the same time, is supported by the front bar (F2*a*, E2) for the rectangular canvas to be movably guided;

a front end portion a V-like arm (V2) is attached to a rear end portion of the front bar (F2*a*, E2) for the rectangular canvas;

a front end portion of an I-like arm (I2) is attached to a rear end portion of the front bar (F1, E1) for the protruded corner canvas; and the I-like arm (12) and the main link (66) are formed to be parallel to each other (SQIII4).

13. A composite awning device according to claim 1, further comprising a Y-like arm (Y2) comprised of a main link (66) and a sub-link (67);

wherein a front end portion of the main link (66) is attached to a rear end portion of the front bar (F1, E1) for the protruded corner canvas (G1), and at the same time, is attached to the front bar (F2*a*, E2) for the rectangular canvas (P) to be slidably guided; and a front end portion of the sub-link (67) is attached in the vicinity of a midpoint of the front bar (F2*a*, E2) for the rectangular canvas (P) (SQIII5).

14. A composite awning device according to claim 1, further comprising a Y-like arm (Y2) comprised of a main link (66) and a sub-link (67);

wherein a front end portion of the sub-link (67) is connected to a rear end portion of the front bar (F2*a*, E2) for the rectangular canvas (P); and a front end portion of the main link (66) is attached to the front bar (F2*a*, L2) for the rectangular canvas to be movably guided (SQIII6).

15. A composite awning device according to claim 1, wherein a Y-like arm (Y2) comprised of a main link (66) and a sub-link (67) is attached to the vicinity of the rear end portion of the front bar (F2*a*, L2) for the rectangular canvas (P) extended to the top end portion of the device;

wherein a front end portion of the sub-link (67) is attached to a rear end portion of the front bar (F2*a*, L2);

a front end portion of the main link (66) is attached to the front bar (F2*a*, L2) for the rectangular canvas to be movably guided; and front end portions of two I-like arms (I1, I2) parallel to each other are attached in the vicinity of a midpoint and a rear end portion of the front bar (F1, E1) for the protruded corner canvas (G1) (SQIII7).

16. A composite awning device according to claim 1, further comprising a Y-like arm (Y1) comprised of a main link (66) and a sub-link (67);

wherein a front end portion of the sub-link (67) is attached to a top end portion of the front bar (F2, E2) for the rectangular canvas (P); and a front end portion of the main link (66) is attached to a rear end portion of the front bar (F1, E1) for the protruded corner canvas (G1), and at the same time, is attached to the front bar (F2, E2) for the rectangular canvas to be movably guided (SQIII8).

17. A composite awning device according to claim 1, wherein a Y-like arm (Y1) comprised of a main link (66) and a sub-link (67) is attached in the vicinity of a front end portion of the front bar (F2*a*, E2) for the rectangular canvas (P) extended to the top end portion of the device;

among them, a front end portion of the sub-link (67) is attached to a top end portion of the front bar (F2*a*, E2) for the rectangular canvas;

a front end portion of the main link (66) is attached in the vicinity of the midpoint of a front bar (F1, E1) for the protruded corner canvas (G1); and a front end portion of the V-like arm (V2) is attached to a rear end portion of the front bar (F2*a*, E2) for the rectangular canvas (SQI(I1)).

18. A composite awning device according to claim 1, further comprising a Y-like arm (Y2) comprised of a main link (66) and a sub-link (67);

wherein a front end portion of the sub-link (67) is attached to a rear end portion of the front bar (F2*a*, L2) for the rectangular canvas (P); and a front end portion of the main link (66) is attached to the front bar (F2*a*, L2) for the rectangular canvas to be movably guided (SQII1).

19. A composite awning device comprising a combination of a protruded corner awning device (S1) equipped with a take-up device for winding and unwinding a protruded corner canvas (G1), and a recessed corner awning device (U) equipped with a winding device for winding and unwinding a recessed corner canvas (T1, T2);

wherein, the take-up device of a protruded corner awning device (S1) is equipped with a take-up shaft (J1 to J4) for a protruded corner canvas (G1), and a front bar (F1, E1), said take-up shaft (J1 to J4) being comprised of an inner shaft and an outer roller (12, 12*a*) supported movably in the axis direction of said inner shaft;

wherein said recessed awning device further comprises a front bar (F2, F2*a*, F2*b*, E2) for the recessed corner canvases (T1, 12); and wherein the front bar (F1, E1) for the protruded corner canvas (G1) is structured to be translated in a direction parallel to an axis of the front bar (F1, E1) of the protruded corner canvas when the protruded corner canvas is wound or unwound by the take-up device for winding and unwinding a protruded corner canvas; the protruded corner canvas being wider at a leading edge that is connected to the front bar of the protruded corner canvas than it is at a rear edge that is connected to the take up device for the protruded corner canvas; and the recessed corner canvas is wider at the rear edge connected to the take up device for the recessed corner canvas than it is at a front edge connected to the front bar of the recessed corner canvas.

20. A composite awning device according to claim 19, wherein two Y-like arms (Y1, Y2) each comprised of a main link (66) and a sub-link (67) are attached symmetrically at fore and rear positions in the vicinity of a top end and in the vicinity of a rear end of the front bar (F2, F2*a*, F2*b*, L2) of the recessed corner canvas (T1);

wherein front end portions of the sub-links (67) are attached to opposite fore and rear portions of the front bar (F2, L2) of the recessed corner canvas;

a front end portion of the main link (66) of the Y-like arm (Y2) at the rear end portion is attached to the front bar (F2, L2) of the recessed corner canvas to be movably guided;

a front end portion of the main link (66) of the Y-like arm (Y1) located at a midpoint of the device is attached to a rear portion of the front bars (F1, L1) for the protruded corner canvas (G1); and a front end portion of an I-like arm (I1) at a top end portion of the device is attached in the vicinity of a midpoint of the front bars (F1, E1) for the protruded corner canvas (SUIII).

21. A composite awning device according to claim 6, wherein an electric motor (M1) for forwardly and reversely rotating the inner rotation shaft (11, 11*a*, 11*b*) and the outer roller (12, 12*a*) is incorporated inside the inner rotation shaft (11, 11*a*, 11*b*).

22. A composite awning device according to claim 1, wherein a manually or electrically driven unit for forwardly and reversely rotating the inner rotation shaft (11, 11*a*, 11*b*) and the outer roller (12, 12*a*) are incorporated into the shaft end portion of the inner rotation shaft (11, 11*a*, 11*b*).

23. A composite awning device according to claim 1, wherein the take-up shaft (J1 to J4) for the protruded corner canvas (G1) and the take-up roller (38, 38*a*) of the rectangular canvas (P) is incorporated into one casing (K3) at its upper side and lower side, respectively.

24. A composite awning device according to claim 1, wherein at a last stage of the canvas withdrawing, a position in the vicinity of a canvas top portion of either one or both of the protruded corner canvas (G1, G2) and the rectangular canvas (P) is depressed down or pushed upward by a swinging flap (97) to narrow a gap of the vicinity of the canvas top portion.

25. A composite awning device according to claim 2, wherein a bracket (68, 95) is pivotally provided to a front end portion of a main link (66) of the Y-like arms (Y1, Y2); and the bracket (68, 95) is fixed to the front bar (F1, E1) for the protruded corner canvas at an outer side, and is also slidably attached to the front (F2, F2*a*, F2*b*, E2) for the rectangular canvas at an inner side.

26. A composite awning device according to claim 17, wherein an engagement piece (72) is protruded from the bottom on a back surface of the front bar (F1), and a shaft pin (661) formed at the front end portion of the main link (66) is loosely fitted and engaged with a long hole (721) of the engagement piece (72).

* * * * *